US007824029B2

(12) United States Patent
Jones et al.

(10) Patent No.: US 7,824,029 B2
(45) Date of Patent: Nov. 2, 2010

(54) IDENTIFICATION CARD PRINTER-ASSEMBLER FOR OVER THE COUNTER CARD ISSUING

(75) Inventors: Robert Jones, Andover, MA (US); Daoshen Bi, Boxborough, MA (US); Dennis Mailloux, Westminster, MA (US)

(73) Assignee: L-1 Secure Credentialing, Inc., Billerica, MA (US)

( * ) Notice: Subject to any disclaimer, the term of this patent is extended or adjusted under 35 U.S.C. 154(b) by 0 days.

(21) Appl. No.: 10/436,729

(22) Filed: May 12, 2003

(65) Prior Publication Data

US 2004/0066441 A1 Apr. 8, 2004

Related U.S. Application Data

(60) Provisional application No. 60/379,704, filed on May 10, 2002, provisional application No. 60/379,646, filed on May 10, 2002.

(51) Int. Cl.
*B41J 2/01* (2006.01)
*B41J 3/00* (2006.01)

(52) U.S. Cl. ..... 347/101; 347/104; 347/2; 347/4

(58) Field of Classification Search ..... 347/2, 347/4, 104, 101; 156/351, 364, 521, 563; 400/120.18

See application file for complete search history.

(56) References Cited

U.S. PATENT DOCUMENTS

| | | | |
|---|---|---|---|
| 1,094,593 | A | 4/1914 | Reed |
| 1,472,581 | A | 10/1923 | Britt |
| 2,815,310 | A | 12/1957 | Anderson |
| 2,957,830 | A | 10/1960 | Goldberg |
| 3,140,214 | A | 7/1964 | Hofe |
| 3,153,166 | A | 10/1964 | Thornton. Jr. et al. |
| 3,225,457 | A | 12/1965 | Schure |
| 3,238,595 | A | 3/1966 | Schwartz |
| 3,413,171 | A | 11/1968 | Hannon |
| 3,455,768 | A | 7/1969 | Neimeyer |
| 3,496,262 | A | 2/1970 | Long et al. |

(Continued)

FOREIGN PATENT DOCUMENTS

CA 2235002 A1 12/1998

(Continued)

OTHER PUBLICATIONS

U.S. Appl. No. 60/344,685, filed Dec. 24, 2001, Bi et al.

(Continued)

*Primary Examiner*—Stephen D Meier
*Assistant Examiner*—Leonard S Liang
(74) *Attorney, Agent, or Firm*—Mintz Levin Cohn Ferris Glovsky and Popeo, P.C.

(57) ABSTRACT

The present invention relates to assembling identification documents in an over-the-counter issuing environment. In one implementation of the present invention, an ink jet printer-based assembling system is provided. An identification document substrate receives ink jet printed information. The printed substrate is laminated. In another implementation, a carrier web carries lamination pieces. Both the carrier web and the document substrate include form feed holes or other registration notches. The holes or notches are used to align the substrate with the lamination pieces, and to align a laminated document substrate for final cutting.

6 Claims, 12 Drawing Sheets

U.S. PATENT DOCUMENTS 3,496,263 A 2/1970 Nakayama et al.
3,536,550 A 10/1970 Hofe
3,565,724 A 2/1971 Yamaguchi
3,569,619 A 3/1971 Simjian
3,571,957 A 3/1971 Cumming et al.
3,582,439 A 6/1971 Thomas
3,601,913 A 8/1971 Pollock
3,614,430 A 10/1971 Berler
3,614,839 A 10/1971 Thomas
3,625,801 A 12/1971 Reed et al.
3,625,803 A * 12/1971 Masulis et al. ..... 156/563
3,640,009 A 2/1972 Komiyama
3,647,275 A 3/1972 Ward
3,658,629 A 4/1972 Cramer et al.
3,665,162 A 5/1972 Yamamoto et al.
3,703,628 A 11/1972 Philipson, Jr.
3,713,948 A 1/1973 Kluger
3,758,970 A 9/1973 Annenberg ..... 40/2.2
3,802,101 A 4/1974 Scantlin
3,805,238 A 4/1974 Rothfjell
3,825,317 A 7/1974 Inoue et al.
3,838,444 A 9/1974 Loughlin et al.
3,845,391 A 10/1974 Crosby
3,860,558 A 1/1975 Klemchuk
3,914,484 A * 10/1975 Creegan et al. ..... 428/41.5
3,914,877 A 10/1975 Hines
3,922,074 A 11/1975 Ikegami et al.
3,929,701 A 12/1975 Hall
3,932,036 A * 1/1976 Ueda et al. ..... 355/40
3,936,613 A 2/1976 Nishigori et al.
3,949,501 A 4/1976 Andrews et al.
3,953,869 A 4/1976 Lo et al.
3,956,595 A 5/1976 Sobanski
3,961,956 A 6/1976 Fukada et al.
3,975,291 A 8/1976 Claussen et al.
3,984,624 A 10/1976 Waggener
3,987,711 A * 10/1976 Silver ..... 493/110
4,009,337 A 2/1977 Sakai et al.
4,021,288 A 5/1977 Hannon et al.
4,022,983 A 5/1977 Braun et al.
4,025,380 A 5/1977 Bernardo
4,035,740 A 7/1977 Schafer et al.
4,046,615 A * 9/1977 Jansen ..... 156/544
4,051,374 A 9/1977 Drexhage et al.
4,069,487 A 1/1978 Kasai et al.
4,072,911 A 2/1978 Walther et al.
4,082,873 A 4/1978 Williams
4,096,015 A 6/1978 Kawamata et al.
4,100,509 A 7/1978 Walther et al.
4,104,555 A 8/1978 Heming
4,119,361 A 10/1978 Greenway
4,121,003 A 10/1978 Williams
4,131,337 A 12/1978 Moraw et al.
4,155,618 A 5/1979 Regnault et al.
4,171,766 A 10/1979 Ruell
4,181,558 A 1/1980 Neubronner
4,183,989 A 1/1980 Tooth
4,184,701 A 1/1980 Franklin et al.
4,213,038 A 7/1980 Silverman et al.
4,225,967 A 9/1980 Miwa et al.
4,230,990 A 10/1980 Lert, Jr. et al.
4,231,113 A 10/1980 Blasbalg
4,238,849 A 12/1980 Gassmann
4,252,995 A 2/1981 Schmidt et al.
4,256,900 A 3/1981 Raue
4,268,345 A 5/1981 Semchuck
4,270,130 A 5/1981 Houle et al.
4,271,395 A 6/1981 Brinkmann et al.
4,272,311 A 6/1981 D'Angelo et al.
4,274,062 A 6/1981 Brinkmann et al.
4,289,957 A 9/1981 Neyroud et al.
4,301,091 A 11/1981 Scieder et al.
4,304,809 A 12/1981 Moraw et al.
4,313,197 A 1/1982 Maxemchuk
4,313,984 A 2/1982 Moraw et al.
4,317,782 A 3/1982 Eckstein et al.
4,324,421 A 4/1982 Moraw et al.
4,326,066 A 4/1982 Eckstein et al.
4,338,258 A 7/1982 Brinkwerth et al.
4,356,052 A 10/1982 Moraw et al.
4,359,633 A 11/1982 Bianco
4,360,548 A 11/1982 Skees et al.
4,367,488 A 1/1983 Leventer et al.
4,379,947 A 4/1983 Warner
4,380,027 A 4/1983 Leventer et al.
4,384,973 A 5/1983 Harnisch
4,395,600 A 7/1983 Lundy et al.
4,415,225 A 11/1983 Benton et al.
4,417,784 A 11/1983 Knop et al.
4,423,415 A 12/1983 Goldman
4,425,642 A 1/1984 Moses et al.
4,428,997 A 1/1984 Shulman
4,443,438 A 4/1984 Kasamatsu et al.
4,448,631 A 5/1984 Eaton et al.
4,450,024 A 5/1984 Haghiri-Tehrani et al.
4,467,209 A 8/1984 Maurer et al.
4,468,468 A 8/1984 Benninghoven et al.
4,476,468 A 10/1984 Goldman
4,485,470 A 11/1984 Reali
4,491,492 A 1/1985 Hetherington
4,504,084 A 3/1985 Jauch
4,505,772 A 3/1985 Renz
4,506,148 A 3/1985 Berthold et al.
4,507,346 A 3/1985 Maurer et al.
4,510,311 A 4/1985 Eckstein
4,517,042 A 5/1985 Singer
4,519,865 A 5/1985 Bradler et al.
4,522,881 A 6/1985 Kobayashi et al.
4,523,777 A 6/1985 Holbein et al.
4,527,059 A 7/1985 Benninghoven et al.
4,528,588 A 7/1985 Lofberg
4,529,992 A 7/1985 Ishida et al.
4,532,508 A 7/1985 Ruell
4,536,013 A 8/1985 Haghiri-Therani et al.
4,544,181 A 10/1985 Maurer et al.
4,547,804 A 10/1985 Greenberg
4,551,265 A 11/1985 Brinkwerth et al.
4,553,261 A 11/1985 Froessl
4,568,824 A 2/1986 Gareis et al.
4,579,754 A 4/1986 Maurer et al.
4,585,509 A 4/1986 Obayashi
4,590,366 A 5/1986 Rothfjell
4,595,950 A 6/1986 Lofberg
4,596,409 A 6/1986 Holbein et al.
4,597,592 A 7/1986 Maurer et al.
4,597,593 A 7/1986 Maurer
4,599,259 A 7/1986 Kobayashi et al.
4,617,216 A 10/1986 Haghiri-Tehrani et al.
4,619,728 A 10/1986 Brink
4,621,271 A 11/1986 Brownstein ..... 346/76
4,627,997 A 12/1986 Ide
4,629,215 A 12/1986 Maurer et al.
4,637,051 A 1/1987 Clark
4,638,289 A 1/1987 Zottnik
4,652,722 A 3/1987 Stone et al.
4,653,775 A 3/1987 Rapheal et al. ..... 283/108
4,653,862 A 3/1987 Morozumi
4,654,290 A 3/1987 Spanjer
4,654,867 A 3/1987 Labedz et al.
4,656,585 A 4/1987 Stephenson
4,660,221 A 4/1987 Dlugos
4,663,518 A 5/1987 Borror et al.
4,665,431 A 5/1987 Cooper
4,670,882 A 6/1987 Telle et al.

4,672,605 A 6/1987 Hustig et al.
4,672,891 A 6/1987 Maurer et al.
4,675,746 A 6/1987 Tetrick et al.
4,677,435 A 6/1987 Causse D'Agraives et al.
4,679,154 A 7/1987 Blanford
4,680,079 A 7/1987 Tanaka
4,682,794 A 7/1987 Margolin
4,687,526 A 8/1987 Wilfert
4,689,477 A 8/1987 Goldman
4,702,789 A 10/1987 Ceraso
4,703,476 A 10/1987 Howard
4,709,384 A 11/1987 Schiller
4,711,690 A 12/1987 Haghiri-Tehrani
4,712,103 A 12/1987 Gotanda
4,717,441 A 1/1988 Seki et al.
4,718,106 A 1/1988 Weinblatt
4,725,462 A 2/1988 Kimura
4,732,410 A 3/1988 Holbein et al.
4,735,670 A 4/1988 Maurer et al.
4,736,405 A 4/1988 Akiyama
4,738,949 A 4/1988 Sethi et al. ..... 503/227
4,739,377 A 4/1988 Allen
4,748,452 A 5/1988 Maurer
4,750,173 A 6/1988 Bluthgen
4,751,525 A 6/1988 Robinson
4,754,128 A 6/1988 Takeda et al.
4,765,636 A 8/1988 Becker et al.
4,765,656 A 8/1988 Becker et al.
4,766,026 A 8/1988 Lass et al.
4,773,677 A 9/1988 Plasse
4,775,901 A 10/1988 Nakano
4,776,013 A 10/1988 Kafri et al.
4,790,566 A 12/1988 Boissier et al.
4,790,703 A 12/1988 Wing
4,803,114 A 2/1989 Schledorn
4,804,949 A 2/1989 Faulkerson
4,805,020 A 2/1989 Greenberg
4,807,031 A 2/1989 Broughton et al.
4,809,321 A 2/1989 Morganstein et al.
4,811,357 A 3/1989 Betts et al.
4,811,408 A 3/1989 Goldman
4,816,372 A 3/1989 Schenk et al.
4,816,374 A 3/1989 Lecompte
4,820,912 A 4/1989 Samyn
4,822,973 A 4/1989 Fahner et al.
4,832,783 A 5/1989 Nechay et al.
4,835,517 A 5/1989 van der Gracht et al.
4,841,134 A 6/1989 Hida et al.
4,855,827 A 8/1989 Best
4,859,361 A 8/1989 Reilly et al.
4,861,620 A 8/1989 Azuma et al.
4,863,550 A * 9/1989 Matsuo et al. ..... 156/353
4,864,618 A 9/1989 Wright et al.
4,866,025 A 9/1989 Byers et al.
4,866,027 A 9/1989 Henzel
4,866,771 A 9/1989 Bain
4,869,946 A 9/1989 Clay
4,871,714 A 10/1989 Byers et al.
4,876,234 A 10/1989 Henzel
4,876,237 A 10/1989 Byers et al.
4,876,617 A 10/1989 Best et al.
4,878,167 A 10/1989 Kapulka et al.
4,879,747 A 11/1989 Leighton et al.
4,884,139 A 11/1989 Pommier
4,888,798 A 12/1989 Earnest
4,889,749 A 12/1989 Ohashi et al.
4,891,351 A 1/1990 Byers et al.
4,893,336 A 1/1990 Wuthnow
4,894,110 A 1/1990 Lass et al.
4,903,301 A 2/1990 Kondo et al.
4,908,836 A 3/1990 Rushforth et al.
4,908,873 A 3/1990 Philibert et al.
4,921,278 A 5/1990 Shiang et al.
4,925,521 A 5/1990 Asbury, Jr. et al.
4,931,793 A 6/1990 Fuhrmann et al.
4,935,335 A 6/1990 Fotland
4,939,515 A 7/1990 Adelson
4,941,150 A 7/1990 Iwasaki
4,943,973 A 7/1990 Werner
4,943,976 A 7/1990 Ishigaki
4,944,036 A 7/1990 Hyatt
4,947,028 A 8/1990 Gorog
4,959,406 A 9/1990 Foltin et al.
4,963,998 A 10/1990 Maufe
4,964,066 A 10/1990 Yamane et al.
4,965,827 A 10/1990 McDonald
4,966,644 A 10/1990 Clark, Jr. et al.
4,967,273 A 10/1990 Greenberg
4,968,063 A 11/1990 McConville et al.
4,969,041 A 11/1990 O'Grady et al.
4,972,471 A 11/1990 Gross et al.
4,972,476 A 11/1990 Nathans
4,977,594 A 12/1990 Shear
4,979,210 A 12/1990 Nagata et al.
4,985,096 A 1/1991 Bekker-Madsen
4,990,759 A 2/1991 Gloton et al.
4,992,130 A 2/1991 Vermeulen et al.
4,993,068 A 2/1991 Piosenka et al.
4,994,831 A 2/1991 Marandi
4,994,926 A 2/1991 Gordon et al.
4,996,530 A 2/1991 Hilton
4,999,065 A 3/1991 Wilfter
5,005,872 A 4/1991 Lass et al.
5,005,873 A 4/1991 West
5,006,503 A 4/1991 Byers et al.
5,010,405 A 4/1991 Schreiber et al.
5,011,816 A 4/1991 Byers et al.
5,013,900 A 5/1991 Hoppe
5,023,907 A 6/1991 Johnson et al.
5,024,989 A 6/1991 Chiang et al. ..... 503/227
5,027,401 A 6/1991 Soltesz
5,036,513 A 7/1991 Greenblatt
5,040,208 A 8/1991 Jolissaint
5,046,087 A 9/1991 Sakai
5,051,147 A * 9/1991 Anger ..... 156/355
5,051,835 A 9/1991 Bruehl et al.
5,053,608 A 10/1991 Senanayake
5,053,956 A 10/1991 Donald et al.
5,058,926 A * 10/1991 Drower ..... 283/109
5,060,981 A 10/1991 Fossum et al.
5,061,341 A 10/1991 Kildal et al.
5,063,446 A 11/1991 Gibson
5,066,947 A 11/1991 Du Castel
5,073,899 A 12/1991 Collier et al.
5,075,195 A 12/1991 Babler et al.
5,079,411 A 1/1992 Lee
5,079,648 A 1/1992 Maufe
5,086,469 A 2/1992 Gupta et al.
5,087,507 A 2/1992 Heinzer
5,089,350 A 2/1992 Talvalkar et al.
5,093,147 A 3/1992 Andrus et al.
5,095,196 A 3/1992 Miyata
5,099,422 A 3/1992 Foresman et al.
5,100,711 A 3/1992 Satake et al.
5,103,459 A 4/1992 Gilhousen et al.
5,113,445 A 5/1992 Wang
5,113,518 A 5/1992 Durst, Jr. et al.
5,122,813 A 6/1992 Lass et al.
5,128,779 A 7/1992 Mallik
5,128,859 A 7/1992 Carbone et al.
5,138,070 A 8/1992 Berneth
5,138,604 A 8/1992 Umeda et al.
5,138,712 A 8/1992 Corbin
5,146,457 A 9/1992 Veldhuis et al.
5,148,498 A 9/1992 Resnikoff et al.
5,150,409 A 9/1992 Elsner 5,156,938 A 10/1992 Foley et al.
5,157,424 A 10/1992 Craven et al.
5,161,210 A 11/1992 Druyvesteyn et al.
5,166,676 A 11/1992 Milheiser
5,169,155 A 12/1992 Soules et al.
5,169,707 A 12/1992 Faykish et al.
5,171,625 A 12/1992 Newton
5,172,281 A 12/1992 Ardis et al.
5,173,840 A 12/1992 Kodai et al.
5,179,392 A 1/1993 Kawaguchi
5,180,309 A 1/1993 Egnor
5,181,786 A 1/1993 Hujink
5,185,736 A 2/1993 Tyrrell et al.
5,191,522 A 3/1993 Bosco et al.
5,199,081 A 3/1993 Saito et al.
5,200,822 A 4/1993 Bronfin et al.
5,201,044 A 4/1993 Frey, Jr. et al.
5,208,450 A 5/1993 Uenishi et al.
5,212,030 A 5/1993 Figov
5,212,551 A 5/1993 Conanan
5,213,337 A 5/1993 Sherman
5,213,648 A 5/1993 Vermeulen et al.
5,215,864 A 6/1993 Laakmann
5,216,543 A 6/1993 Calhoun
5,224,173 A 6/1993 Kuhns et al.
5,228,056 A 7/1993 Schilling
5,233,513 A 8/1993 Doyle
5,237,164 A 8/1993 Takada
5,239,108 A 8/1993 Yokoyama et al.
5,243,423 A 9/1993 DeJean et al.
5,243,524 A 9/1993 Ishida et al.
5,245,329 A 9/1993 Gokcebay
5,249,546 A 10/1993 Pennelle ..... 116/234
5,250,492 A 10/1993 Dotson et al.
5,253,078 A 10/1993 Balkanski et al.
5,258,998 A 11/1993 Koide
5,259,025 A 11/1993 Monroe et al.
5,260,582 A 11/1993 Danek et al.
5,261,987 A 11/1993 Luening et al. ..... 156/235
5,262,860 A 11/1993 Fitzpatrick et al.
5,267,334 A 11/1993 Normille et al.
5,267,755 A 12/1993 Yamaguchi et al.
5,270,526 A 12/1993 Yoshihara
5,272,039 A 12/1993 Yoerger
5,276,478 A 1/1994 Morton
5,280,537 A 1/1994 Sugiyama et al.
5,284,364 A 2/1994 Jain
5,288,976 A 2/1994 Citron et al.
5,291,243 A 3/1994 Heckman et al.
5,291,302 A 3/1994 Gordon et al.
5,293,399 A 3/1994 Hefti
5,294,774 A 3/1994 Stone
5,294,944 A 3/1994 Takeyama et al.
5,295,203 A 3/1994 Krause et al.
5,298,922 A 3/1994 Merkle et al.
5,299,019 A 3/1994 Pack et al.
5,301,981 A 4/1994 Nesis
5,304,513 A 4/1994 Haghiri-Tehrani et al.
5,304,789 A 4/1994 Lob et al.
5,305,400 A 4/1994 Butera
5,308,736 A 5/1994 Defieuw et al.
5,315,098 A 5/1994 Tow
5,317,503 A 5/1994 Inoue
5,319,453 A 6/1994 Copriviza et al.
5,319,724 A 6/1994 Blonstein et al.
5,319,735 A 6/1994 Preuss et al.
5,321,751 A 6/1994 Ray et al.
5,325,167 A 6/1994 Melen
5,334,573 A 8/1994 Schild
5,336,657 A 8/1994 Egashira et al.
5,336,871 A 8/1994 Colgate, Jr.
5,337,361 A 8/1994 Wang et al.
5,351,302 A 9/1994 Leighton et al.
5,363,212 A 11/1994 Taniuchi et al.
5,374,675 A 12/1994 Plachetta et al.
5,374,976 A 12/1994 Spannenburg
5,379,345 A 1/1995 Greenberg
5,380,044 A 1/1995 Aitkens et al.
5,380,695 A 1/1995 Chiang et al.
5,384,846 A 1/1995 Berson et al.
5,385,371 A 1/1995 Izawa
5,386,566 A 1/1995 Hamanaka et al.
5,387,013 A 2/1995 Yamauchi et al.
5,393,099 A 2/1995 D'Amato
5,394,274 A 2/1995 Kahn
5,394,555 A 2/1995 Hunter et al.
5,396,559 A 3/1995 McGrew
5,404,377 A 4/1995 Moses
5,404,537 A 4/1995 Olnowich et al.
5,408,542 A 4/1995 Callahan
5,409,797 A 4/1995 Hosoi et al.
5,410,142 A 4/1995 Tsuboi et al.
5,413,651 A 5/1995 Otruba
5,418,208 A 5/1995 Takeda et al.
5,421,619 A 6/1995 Dyball
5,421,869 A 6/1995 Gundjian et al.
5,422,213 A 6/1995 Yu et al.
5,422,230 A 6/1995 Boggs et al.
5,422,963 A 6/1995 Chen et al.
5,422,995 A 6/1995 Aoki et al.
5,424,119 A 6/1995 Phillips et al.
5,428,607 A 6/1995 Hiller et al.
5,428,731 A 6/1995 Powers, III
5,432,329 A 7/1995 Colgate, Jr. et al.
5,432,864 A 7/1995 Lu et al.
5,432,870 A 7/1995 Schwartz
5,434,908 A 7/1995 Klein
5,434,994 A 7/1995 Shaheen et al.
5,435,599 A 7/1995 Bernecker
5,436,970 A 7/1995 Ray et al.
5,446,273 A 8/1995 Leslie
5,446,659 A 8/1995 Yamawaki
5,448,050 A 9/1995 Kostizak
5,448,053 A 9/1995 Rhoads
5,449,200 A 9/1995 Andric et al.
5,450,490 A 9/1995 Jensen et al.
5,450,504 A 9/1995 Calia
5,451,478 A 9/1995 Boggs et al.
5,454,598 A 10/1995 Wicker
5,455,947 A 10/1995 Suzuki et al.
5,458,713 A 10/1995 Ojster
5,459,584 A 10/1995 Gordon et al.
5,463,209 A 10/1995 Figh et al.
5,463,212 A 10/1995 Oshima et al.
5,466,012 A 11/1995 Puckett et al.
5,466,293 A 11/1995 Tanaka et al.
5,467,169 A 11/1995 Morikawa
5,467,388 A 11/1995 Redd, Jr. et al.
5,469,506 A 11/1995 Berson et al.
5,471,533 A 11/1995 Wang et al.
5,473,631 A 12/1995 Moses
5,474,875 A 12/1995 Loerzer et al.
5,479,168 A 12/1995 Johnson et al.
5,479,188 A 12/1995 Moriyama
5,481,377 A 1/1996 Udagawa et al.
5,483,442 A 1/1996 Black et al.
5,483,632 A 1/1996 Kuwamoto et al.
5,488,664 A 1/1996 Shamir
5,489,639 A 2/1996 Faber et al.
5,490,217 A 2/1996 Wang et al.
5,493,677 A 2/1996 Balogh et al.
5,495,411 A 2/1996 Ananda
5,495,581 A 2/1996 Tsai
5,496,071 A 3/1996 Walsh
5,499,294 A 3/1996 Friedman
5,499,330 A 3/1996 Lucas et al.

5,502,576 A 3/1996 Ramsay et al.
5,504,674 A 4/1996 Chen et al.
5,505,494 A 4/1996 Belluci et al.
5,506,697 A 4/1996 Li et al.
5,509,693 A 4/1996 Kohls
5,514,860 A 5/1996 Berson
5,515,081 A 5/1996 Vasilik
5,515,451 A 5/1996 Tsuji et al.
5,516,362 A 5/1996 Gundjian et al.
5,522,623 A 6/1996 Soules et al.
5,523,125 A 6/1996 Kennedy et al.
5,523,942 A 6/1996 Tyler et al.
5,524,489 A 6/1996 Twigg
5,524,933 A 6/1996 Kunt et al.
5,525,403 A 6/1996 Kawabata et al.
5,526,524 A 6/1996 Madduri
5,528,222 A 6/1996 Moskowitz et al.
5,529,345 A 6/1996 Kohls
5,530,751 A 6/1996 Morris
5,530,759 A 6/1996 Braudaway et al.
5,530,852 A 6/1996 Meske, Jr. et al.
5,532,104 A 7/1996 Goto
5,533,102 A 7/1996 Robinson et al.
5,534,372 A 7/1996 Koshizuka et al.
5,548,645 A 8/1996 Ananda
5,550,346 A 8/1996 Andriash et al.
5,550,976 A 8/1996 Henderson et al.
5,553,143 A 9/1996 Ross et al.
5,557,412 A 9/1996 Saito et al.
5,560,799 A 10/1996 Jacobsen
5,568,555 A 10/1996 Shamir
5,573,584 A 11/1996 Ostertag et al.
5,574,804 A 11/1996 Olschafskie et al.
5,576,377 A 11/1996 El Sayed et al.
5,577,111 A 11/1996 Iida et al.
5,579,479 A 11/1996 Plum
5,579,694 A 12/1996 Mailloux
5,583,918 A 12/1996 Nakagawa
5,586,310 A 12/1996 Sharman
5,594,226 A 1/1997 Steger
5,594,809 A 1/1997 Kopec et al.
5,602,377 A 2/1997 Beller et al.
5,612,943 A 3/1997 Moses et al.
5,613,004 A 3/1997 Cooperman et al.
5,617,119 A 4/1997 Briggs et al.
5,619,557 A 4/1997 Van Berkum
5,621,810 A 4/1997 Suzuki et al.
5,629,093 A 5/1997 Bischof et al.
5,629,512 A 5/1997 Haga
5,629,980 A 5/1997 Stefik et al.
5,633,119 A 5/1997 Burberry et al.
5,633,489 A 5/1997 Dvorkis et al.
5,634,012 A 5/1997 Stefik et al.
5,635,012 A 6/1997 Belluci et al.
5,635,697 A 6/1997 Shellhammer et al.
5,636,276 A 6/1997 Brugger
5,636,292 A 6/1997 Rhoads
5,636,874 A 6/1997 Singer
5,637,174 A 6/1997 Field et al.
5,637,447 A 6/1997 Dickerson et al.
5,638,443 A 6/1997 Stefik et al.
5,638,508 A 6/1997 Kanai et al.
5,639,819 A 6/1997 Farkas et al.
5,640,193 A 6/1997 Wellner
5,640,647 A 6/1997 Hube
5,640,677 A 6/1997 Karlsson
5,643,389 A 7/1997 Kalisiak et al.
5,646,997 A 7/1997 Barton
5,646,999 A 7/1997 Saito
5,651,054 A 7/1997 Dunn et al.
5,652,626 A 7/1997 Kawakami et al.
5,652,714 A 7/1997 Peterson et al.
5,653,846 A 8/1997 Onodera et al.
5,653,929 A 8/1997 Miele et al.
5,654,105 A 8/1997 Obringer et al.
5,657,462 A 8/1997 Brouwer et al.
5,658,411 A 8/1997 Faykish
5,659,164 A 8/1997 Schmid et al.
5,659,628 A 8/1997 Tachikawa et al.
5,659,726 A 8/1997 Sandford, II et al.
5,661,574 A 8/1997 Kawana
5,663,766 A 9/1997 Sizer, II
5,664,018 A 9/1997 Leighton
5,665,951 A 9/1997 Newman et al.
5,667,716 A 9/1997 Ziolo et al.
5,668,636 A 9/1997 Beach et al.
5,669,995 A 9/1997 Hong
5,671,005 A 9/1997 McNay et al.
5,671,277 A 9/1997 Ikenoue et al.
5,671,282 A 9/1997 Wolff et al.
5,673,316 A 9/1997 Auerbach et al.
5,680,223 A 10/1997 Cooper et al.
5,681,356 A 10/1997 Barak et al.
5,683,774 A 11/1997 Faykish et al.
5,684,885 A 11/1997 Cass et al.
5,687,236 A 11/1997 Moskowitz et al.
5,688,738 A 11/1997 Lu
5,689,620 A 11/1997 Kopec et al.
5,689,623 A 11/1997 Pinard
5,689,706 A 11/1997 Rao et al.
5,691,757 A 11/1997 Hayashihara et al.
5,694,471 A 12/1997 Chen et al.
5,696,594 A 12/1997 Saito et al.
5,696,705 A 12/1997 Zykan
5,697,006 A 12/1997 Taguchi et al.
5,698,296 A 12/1997 Dotson et al.
5,700,037 A 12/1997 Keller
5,706,364 A 1/1998 Kopec et al.
5,710,834 A 1/1998 Rhoads
5,712,731 A 1/1998 Drinkwater et al.
5,714,291 A 2/1998 Marinello et al.
5,715,403 A 2/1998 Stefik
5,717,018 A 2/1998 Magerstedt et al.
5,717,391 A 2/1998 Rodriguez
5,717,940 A 2/1998 Peairs
5,719,667 A 2/1998 Miers
5,719,948 A 2/1998 Liang
5,721,781 A 2/1998 Deo et al.
5,721,788 A 2/1998 Powell et al.
5,726,685 A 3/1998 Kuth et al.
5,734,119 A 3/1998 France et al.
5,734,752 A 3/1998 Knox
5,738,024 A 4/1998 Winegar
5,742,411 A 4/1998 Walters
5,742,685 A 4/1998 Berson et al.
5,742,845 A 4/1998 Wagner
5,745,308 A 4/1998 Spangenberg
5,745,569 A 4/1998 Moskowitz et al.
5,745,604 A 4/1998 Rhoads
5,745,901 A 4/1998 Entner et al.
5,748,783 A 5/1998 Rhoads
5,751,795 A 5/1998 Hassler et al.
5,754,675 A 5/1998 Valadier
5,760,386 A 6/1998 Ward
5,761,686 A 6/1998 Bloomberg
5,763,868 A 6/1998 Kubota et al.
5,764,263 A * 6/1998 Lin ..... 347/101
5,765,152 A 6/1998 Erickson
5,765,176 A 6/1998 Bloomberg
5,767,496 A 6/1998 Swartz et al.
5,768,001 A 6/1998 Kelley et al.
5,768,426 A 6/1998 Rhoads
5,768,505 A 6/1998 Gilchrist et al.
5,768,506 A 6/1998 Randell
5,769,301 A 6/1998 Hebert et al.
5,769,457 A 6/1998 Warther 5,773,677 A 6/1998 Lansink-Rotgerink et al.
5,774,067 A 6/1998 Olnowich et al.
5,774,168 A 6/1998 Blome
5,774,452 A 6/1998 Wolosewicz
5,776,278 A 7/1998 Tuttle et al.
5,778,102 A 7/1998 Sandford, II et al.
5,783,024 A 7/1998 Forkert ..... 156/351
5,786,587 A 7/1998 Colgate, Jr.
5,787,186 A 7/1998 Schroeder
5,787,269 A 7/1998 Hyodo
5,788,285 A 8/1998 Wicker
5,788,802 A * 8/1998 Raney ..... 156/351
5,788,806 A 8/1998 Bradshaw et al.
5,790,662 A 8/1998 Valerij et al.
5,790,693 A 8/1998 Graves et al.
5,790,703 A 8/1998 Wang
5,795,643 A 8/1998 Steininger et al.
5,797,134 A 8/1998 McMillan et al.
5,798,949 A 8/1998 Kaub
5,799,092 A 8/1998 Kristol et al.
5,801,687 A 9/1998 Peterson et al.
5,801,857 A 9/1998 Heckenkamp et al.
5,804,803 A 9/1998 Cragun et al.
5,805,587 A 9/1998 Norris et al.
5,808,758 A 9/1998 Solmsdorf
5,809,128 A 9/1998 McMullin
5,809,139 A 9/1998 Girod et al.
5,809,317 A 9/1998 Kogan et al.
5,809,633 A 9/1998 Mundigl et al.
5,812,551 A 9/1998 Tsukazoe et al.
5,815,093 A 9/1998 Kikinis
5,815,292 A 9/1998 Walters
5,816,619 A 10/1998 Schaede
5,818,441 A 10/1998 Throckmorton et al.
5,822,432 A 10/1998 Moskowitz et al.
5,822,436 A 10/1998 Rhoads
5,824,447 A 10/1998 Tavernier et al.
5,824,715 A 10/1998 Hayashihara et al.
5,825,867 A 10/1998 Epler et al.
5,825,892 A 10/1998 Braudaway et al.
5,828,325 A 10/1998 Wolosewicz et al.
5,832,119 A 11/1998 Rhoads
5,832,186 A 11/1998 Kawana
5,832,481 A 11/1998 Sheffield
5,834,118 A 11/1998 Ranby et al.
5,838,458 A 11/1998 Tsai
5,840,142 A 11/1998 Stevenson et al.
5,840,791 A 11/1998 Magerstedt et al.
5,841,886 A 11/1998 Rhoads
5,841,978 A 11/1998 Rhoads
5,844,685 A 12/1998 Gontin
5,845,281 A 12/1998 Benson et al.
5,848,413 A 12/1998 Wolff
5,848,415 A 12/1998 Guck
5,848,424 A 12/1998 Scheinkman et al.
5,852,673 A 12/1998 Young
5,853,955 A 12/1998 Towfiq
5,855,969 A 1/1999 Robertson
5,856,661 A 1/1999 Finkelstein et al.
5,857,038 A 1/1999 Owada et al.
5,859,935 A 1/1999 Johnson et al.
5,861,662 A 1/1999 Candelore
5,862,218 A 1/1999 Steinberg
5,862,260 A 1/1999 Rhoads
5,862,262 A 1/1999 Jacobs et al.
5,862,325 A 1/1999 Reed et al.
5,862,500 A 1/1999 Goodwin
5,864,622 A 1/1999 Marcus
5,864,623 A 1/1999 Messina et al.
5,866,644 A 2/1999 Mercx et al.
5,867,199 A 2/1999 Knox et al.
5,867,586 A 2/1999 Liang
5,869,819 A 2/1999 Knowles et al.
5,870,711 A 2/1999 Huffman
5,871,615 A 2/1999 Harris
5,872,589 A 2/1999 Morales
5,872,627 A 2/1999 Miers
5,873,066 A 2/1999 Underwood et al.
5,875,249 A 2/1999 Mintzer et al.
5,877,707 A 3/1999 Kowalick
5,879,502 A 3/1999 Gustafson
5,879,784 A 3/1999 Breen et al.
5,888,624 A 3/1999 Haghiri et al.
5,892,661 A 4/1999 Stafford et al.
5,892,900 A 4/1999 Ginter et al.
5,893,095 A 4/1999 Jain et al.
5,893,101 A 4/1999 Balogh et al.
5,893,908 A 4/1999 Cullen et al.
5,893,910 A 4/1999 Martineau et al.
5,895,074 A 4/1999 Chess et al.
5,897,938 A 4/1999 Shinmoto et al.
5,900,608 A 5/1999 Iida
5,901,224 A 5/1999 Hecht
5,902,353 A 5/1999 Reber et al.
5,903,340 A 5/1999 Lawandy et al.
5,903,729 A 5/1999 Reber et al.
5,905,248 A 5/1999 Russell et al.
5,905,251 A 5/1999 Knowles
5,905,800 A 5/1999 Moskowitz et al.
5,905,819 A 5/1999 Daly
5,907,141 A 5/1999 Deaville et al.
5,907,149 A 5/1999 Marckini
5,907,848 A 5/1999 Zaiken et al.
5,909,209 A 6/1999 Dickinson
5,909,683 A 6/1999 Miginiac et al.
5,911,139 A 6/1999 Jain et al.
5,912,767 A 6/1999 Lee
5,912,974 A 6/1999 Holloway et al.
5,913,205 A 6/1999 Jain et al.
5,913,210 A 6/1999 Call
5,913,214 A 6/1999 Madnick et al.
5,915,027 A 6/1999 Cox et al.
5,915,250 A 6/1999 Jain et al.
5,917,277 A 6/1999 Knox et al.
5,918,213 A 6/1999 Bernard et al.
5,918,214 A 6/1999 Perkowski
5,918,223 A 6/1999 Blum et al.
5,919,730 A 7/1999 Gasper et al.
5,919,853 A 7/1999 Condit et al.
5,920,861 A 7/1999 Hall et al.
5,920,878 A 7/1999 DeMont
5,925,500 A 7/1999 Yang et al.
5,926,822 A 7/1999 Garman
5,928,989 A 7/1999 Ohnishi et al.
5,930,369 A 7/1999 Cox et al.
5,930,377 A 7/1999 Powell et al.
5,930,759 A 7/1999 Moore et al.
5,930,767 A 7/1999 Reber et al.
5,932,863 A 8/1999 Rathus et al.
5,933,798 A 8/1999 Linnartz
5,933,816 A 8/1999 Zeanah et al.
5,933,829 A 8/1999 Durst et al.
5,935,694 A 8/1999 Olmstead et al.
5,936,986 A 8/1999 Cantatore et al.
5,937,189 A 8/1999 Branson et al.
5,938,726 A 8/1999 Reber et al.
5,938,727 A 8/1999 Ikeda
5,939,695 A 8/1999 Nelson
5,939,699 A 8/1999 Perttunen et al.
5,940,595 A 8/1999 Reber et al.
5,943,422 A 8/1999 Van Wie et al.
5,944,356 A 8/1999 Bergmann et al.
5,944,881 A 8/1999 Mehta et al.
5,946,414 A 8/1999 Cass et al.
5,947,369 A 9/1999 Frommer et al.
5,948,035 A 9/1999 Tomita 5,949,055 A 9/1999 Fleet et al.
5,950,169 A 9/1999 Borghesi et al.
5,950,173 A 9/1999 Perkowski
5,951,055 A 9/1999 Mowry, Jr.
5,953,710 A 9/1999 Fleming
5,955,021 A 9/1999 Tiffany, III
5,955,961 A 9/1999 Wallerstein
5,956,687 A 9/1999 Wamsley
5,958,528 A 9/1999 Bernecker
5,960,081 A 9/1999 Vynne et al.
5,960,103 A 9/1999 Graves et al.
5,962,073 A 10/1999 Timmer
5,962,834 A 10/1999 Markman
5,962,840 A 10/1999 Haghiri-Tehrani et al.
5,963,916 A 10/1999 Kaplan
5,965,242 A 10/1999 Patton et al.
5,969,324 A 10/1999 Reber et al.
5,971,277 A 10/1999 Cragun et al.
5,973,842 A 10/1999 Spangenberg
5,974,141 A 10/1999 Saito
5,974,548 A 10/1999 Adams
5,975,583 A 11/1999 Cobben et al.
5,977,514 A 11/1999 Feng et al.
5,978,013 A 11/1999 Jones et al.
5,978,477 A 11/1999 Hull et al.
5,978,773 A 11/1999 Hudetz et al.
5,979,757 A 11/1999 Tracy et al.
5,979,941 A 11/1999 Mosher, Jr. et al.
5,982,912 A 11/1999 Fukui et al.
5,983,218 A 11/1999 Syeda-Mahmood
5,983,237 A 11/1999 Jain et al.
5,984,366 A 11/1999 Priddy
5,985,078 A 11/1999 Suess et al.
5,986,651 A 11/1999 Reber et al.
5,987,434 A 11/1999 Libman
5,988,820 A 11/1999 Huang et al.
5,991,429 A 11/1999 Coffin et al.
5,991,733 A 11/1999 Aleia et al.
5,991,876 A 11/1999 Johnson et al.
5,994,710 A 11/1999 Knee et al.
5,995,978 A 11/1999 Cullen et al.
6,000,607 A 12/1999 Ohki et al.
6,002,383 A 12/1999 Shimada
6,003,581 A 12/1999 Aihara ..... 156/555
6,006,226 A 12/1999 Cullen et al.
6,007,660 A 12/1999 Forkert ..... 156/256
6,007,929 A 12/1999 Robertson et al.
6,009,402 A 12/1999 Whitworth
6,012,641 A 1/2000 Watada
6,016,225 A 1/2000 Anderson
6,017,972 A 1/2000 Harris et al.
6,022,905 A 2/2000 Harris et al.
6,024,287 A 2/2000 Takai et al.
6,025,462 A 2/2000 Wang et al.
6,028,134 A 2/2000 Zhang et al.
6,036,094 A 3/2000 Goldman et al.
6,036,099 A 3/2000 Leighton
6,036,807 A 3/2000 Brongers
6,037,102 A 3/2000 Loerzer et al.
6,037,860 A 3/2000 Zander et al.
6,038,333 A 3/2000 Wang
6,038,393 A 3/2000 Iyengar et al.
6,043,813 A 3/2000 Stickney et al.
6,045,656 A 4/2000 Foster et al.
6,046,808 A 4/2000 Fateley
6,047,888 A 4/2000 Dethloff
6,049,055 A 4/2000 Fannash et al.
6,049,463 A 4/2000 O'Malley et al.
6,049,627 A 4/2000 Becker et al.
6,049,665 A 4/2000 Branson et al.
6,051,297 A 4/2000 Maier et al.
6,052,486 A 4/2000 Knowlton et al.
6,054,021 A 4/2000 Kurrle et al.
6,054,170 A 4/2000 Chess et al.
6,062,604 A 5/2000 Taylor et al.
6,064,414 A 5/2000 Kobayashi et al.
6,064,764 A 5/2000 Bhaskaran et al.
6,064,983 A 5/2000 Koehler
6,066,437 A 5/2000 Kösslinger
6,066,594 A 5/2000 Gunn et al. ..... 503/227
6,071,855 A 6/2000 Patton et al.
6,072,894 A 6/2000 Payne
6,073,854 A 6/2000 Bravenec et al.
6,075,223 A 6/2000 Harrison
6,076,026 A 6/2000 Jambhekar et al.
6,081,793 A 6/2000 Challener et al.
6,081,832 A 6/2000 Gilchrist et al.
6,082,778 A 7/2000 Solmadorf
6,085,205 A 7/2000 Peairs et al.
6,085,976 A 7/2000 Sehr
6,086,971 A 7/2000 Haas et al.
6,089,614 A 7/2000 Howland et al.
6,092,049 A 7/2000 Chislenko et al.
6,094,483 A 7/2000 Fridrich et al.
6,095,566 A 8/2000 Yamamoto et al.
6,097,839 A 8/2000 Liu
6,100,804 A 8/2000 Brady et al.
6,101,602 A 8/2000 Fridrich
6,104,812 A 8/2000 Koltai et al.
6,105,007 A 8/2000 Norris
6,106,110 A 8/2000 Gundjian et al.
6,110,864 A 8/2000 Lu
6,111,506 A 8/2000 Yap et al.
6,111,517 A 8/2000 Atick et al.
6,115,690 A 9/2000 Wong
6,120,142 A * 9/2000 Eltgen et al. ..... 347/104
6,120,882 A 9/2000 Faykish et al.
6,121,530 A 9/2000 Sonoda
6,122,403 A 9/2000 Rhoads
6,127,475 A 10/2000 Vollenberg et al.
6,128,411 A 10/2000 Knox
6,131,161 A 10/2000 Linnartz
6,134,582 A 10/2000 Kennedy
6,136,752 A 10/2000 Paz-Pujalt et al.
6,138,151 A 10/2000 Reber et al.
6,138,913 A 10/2000 Cyr et al.
6,141,611 A 10/2000 Mackey et al.
6,141,753 A 10/2000 Zhao et al.
6,143,852 A 11/2000 Harrison et al.
6,146,032 A 11/2000 Dunham
6,146,741 A 11/2000 Ogawa et al.
6,151,403 A 11/2000 Luo
6,155,168 A 12/2000 Sakamoto
6,155,605 A 12/2000 Bratchley et al.
6,157,330 A 12/2000 Bruekers et al.
6,158,658 A 12/2000 Barclay
6,159,327 A 12/2000 Forkert ..... 156/264
6,160,526 A 12/2000 Hirai et al.
6,160,903 A 12/2000 Hamid et al.
6,161,071 A 12/2000 Shuman et al.
6,162,160 A 12/2000 Ohshima et al.
6,163,770 A 12/2000 Gamble et al.
6,163,842 A 12/2000 Barton
6,164,534 A 12/2000 Rathus et al.
6,164,548 A 12/2000 Curiel
6,165,696 A 12/2000 Fischer
6,166,911 A 12/2000 Usami et al.
6,173,284 B1 1/2001 Brown
6,173,901 B1 1/2001 McCannel
6,174,400 B1 1/2001 Krutak et al.
6,179,338 B1 1/2001 Bergmann et al.
6,182,090 B1 1/2001 Peairs
6,326,128 B1 1/2001 Telser
6,183,018 B1 2/2001 Braun et al.
6,185,042 B1 2/2001 Lomb et al.
6,185,312 B1 2/2001 Nakamura et al.

6,185,316 B1 2/2001 Buffam
6,185,490 B1 2/2001 Ferguson
6,185,540 B1 2/2001 Schreitmueller et al.
6,185,683 B1 2/2001 Ginter et al.
6,186,404 B1 2/2001 Ehrhart et al.
6,188,010 B1 2/2001 Iwamura
6,192,138 B1 2/2001 Yamadaji
6,193,163 B1 2/2001 Fehrman et al.
6,196,460 B1 3/2001 Shin
6,199,048 B1 3/2001 Hudetz et al.
6,199,073 B1 3/2001 Peairs et al.
6,199,144 B1 3/2001 Arora et al.
6,201,879 B1 3/2001 Bender et al.
6,202,932 B1 3/2001 Rapeli ..... 235/491
6,205,249 B1 3/2001 Moskowitz
6,206,292 B1 3/2001 Robertz et al.
6,207,244 B1 3/2001 Hesch
6,207,344 B1 3/2001 Ramlow et al.
6,209,923 B1 4/2001 Thaxton et al.
6,210,777 B1 4/2001 Vermeulen et al.
6,214,916 B1 4/2001 Mercx et al.
6,214,917 B1 4/2001 Linzmeier et al.
6,219,439 B1 4/2001 Burger
6,219,639 B1 4/2001 Bakis et al.
6,221,552 B1 4/2001 Street et al.
6,223,125 B1 4/2001 Hall
6,226,623 B1 5/2001 Schein et al.
6,233,347 B1 5/2001 Chen et al.
6,233,684 B1 5/2001 Stefik et al.
6,234,537 B1 5/2001 Gutmann et al.
6,236,975 B1 5/2001 Boe et al.
6,238,840 B1 5/2001 Hirayama et al.
6,238,847 B1 5/2001 Axtell, III et al.
6,242,249 B1 6/2001 Burnham et al.
6,243,480 B1 6/2001 Zhao et al.
6,243,713 B1 6/2001 Nelson et al.
6,244,514 B1 6/2001 Otto ..... 235/492
6,246,775 B1 6/2001 Nakamura et al.
6,246,777 B1 6/2001 Agarwal et al.
6,246,933 B1 6/2001 Bague
6,247,644 B1 6/2001 Horne et al.
6,249,226 B1 6/2001 Harrison et al.
6,250,554 B1 6/2001 Leo et al.
6,254,127 B1 7/2001 Breed et al.
6,256,736 B1 7/2001 Coppersmith et al.
6,257,486 B1 7/2001 Teicher et al.
6,258,896 B1 7/2001 Abuelyaman et al.
6,259,506 B1 7/2001 Lawandy
6,260,029 B1 7/2001 Critelli
6,264,296 B1 * 7/2001 Klinefelter et al. ..... 347/4
6,268,804 B1 7/2001 Janky et al.
6,272,176 B1 8/2001 Srinivasan
6,272,248 B1 8/2001 Saitoh et al.
6,272,634 B1 8/2001 Tewfik et al.
6,277,232 B1 8/2001 Wang et al.
6,281,165 B1 8/2001 Cranford
6,283,188 B1 9/2001 Maynard et al. ..... 156/521
6,284,337 B1 9/2001 Lorimor et al.
6,285,776 B1 9/2001 Rhoads
6,286,036 B1 9/2001 Rhoads
6,286,761 B1 9/2001 Wen
6,289,108 B1 9/2001 Rhoads
6,291,551 B1 9/2001 Kniess et al.
6,292,092 B1 9/2001 Chow et al.
6,292,575 B1 9/2001 Bortolussi et al.
6,295,391 B1 9/2001 Rudd et al.
6,301,164 B1 10/2001 Manning et al.
6,301,363 B1 10/2001 Mowry, Jr.
6,302,444 B1 10/2001 Cobben
6,304,345 B1 10/2001 Patton et al.
6,308,187 B1 10/2001 DeStefano
6,311,214 B1 10/2001 Rhoads
6,312,858 B1 11/2001 Yacobucci et al.
6,313,436 B1 11/2001 Harrison
6,314,192 B1 11/2001 Chen et al.
6,314,457 B1 11/2001 Schena et al.
6,316,538 B1 11/2001 Anderson et al.
6,320,675 B1 11/2001 Sakaki et al.
6,321,981 B1 11/2001 Ray et al.
6,324,091 B1 11/2001 Gryko et al.
6,324,573 B1 11/2001 Rhoads
6,184,782 B1 12/2001 Oda et al.
6,325,420 B1 12/2001 Zhang et al.
6,330,976 B1 12/2001 Dymetman et al.
6,332,031 B1 12/2001 Rhoads et al.
6,332,194 B1 12/2001 Bloom et al.
6,334,187 B1 12/2001 Kadono
6,334,721 B1 1/2002 Horigane
6,335,688 B1 1/2002 Sweatte
6,336,096 B1 1/2002 Jernberg
6,336,117 B1 1/2002 Massarani
6,340,725 B1 1/2002 Wang et al.
6,341,169 B1 1/2002 Cadorette et al.
6,343,138 B1 1/2002 Rhoads
6,345,105 B1 2/2002 Rhoads
6,351,537 B1 2/2002 Dovgodko et al.
6,351,815 B1 2/2002 Adams
6,351,893 B1 3/2002 St. Pierre
6,354,630 B1 3/2002 Zhang et al.
6,356,363 B1 3/2002 Cooper et al.
6,357,664 B1 3/2002 Zercher
6,360,234 B2 3/2002 Jain et al.
6,363,360 B1 3/2002 Madden
6,536,672 B1 3/2002 Outwater
6,366,907 B1 4/2002 Fanning
6,367,013 B1 4/2002 Bisbee et al.
6,368,684 B1 4/2002 Onishi et al.
6,372,394 B1 4/2002 Zientek
6,373,965 B1 4/2002 Liang
6,374,260 B1 4/2002 Hoffert et al.
6,380,131 B2 4/2002 Griebel et al.
6,381,561 B1 4/2002 Bomar, Jr. et al.
6,385,330 B1 5/2002 Powell et al.
6,389,151 B1 5/2002 Carr et al.
6,390,362 B1 5/2002 Martin
6,390,375 B2 5/2002 Kayanakis
6,394,358 B1 5/2002 Thaxton et al.
6,397,334 B1 5/2002 Chainer et al.
6,400,386 B1 6/2002 No et al.
6,401,118 B1 6/2002 Thomas
6,404,643 B1 6/2002 Chung
6,404,926 B1 6/2002 Miyahara et al.
6,408,082 B1 6/2002 Rhoads et al.
6,408,304 B1 6/2002 Kumhyr
6,411,725 B1 6/2002 Rhoads
6,500,386 B1 6/2002 No
6,413,687 B1 7/2002 Hattori et al.
6,418,154 B1 7/2002 Kneip et al.
6,421,013 B1 7/2002 Chung
6,424,029 B1 7/2002 Giesler
6,424,249 B1 7/2002 Houvener
6,424,725 B1 7/2002 Rhoads et al.
6,427,744 B2 * 8/2002 Seki et al. ..... 156/353
6,430,306 B2 8/2002 Slocum et al.
6,430,307 B1 8/2002 Souma et al.
6,434,520 B1 8/2002 Kanevsky et al.
6,438,251 B1 8/2002 Yamaguchi
6,441,380 B1 8/2002 Lawandy
6,442,284 B1 8/2002 Gustafson et al.
6,444,068 B1 9/2002 Koops et al.
6,444,377 B1 9/2002 Jotcham et al.
6,445,468 B1 9/2002 Tsai
6,446,086 B1 9/2002 Bartlett et al.
6,446,865 B1 9/2002 Holt et al.
6,449,377 B1 9/2002 Rhoads
6,463,416 B1 10/2002 Messina 6,463,444 B1 10/2002 Jain et al.
6,466,329 B1 10/2002 Mukai
6,473,165 B1 10/2002 Coombs et al.
6,474,695 B1 11/2002 Schneider et al.
6,475,588 B1 11/2002 Schottland et al.
6,478,228 B1 11/2002 Ikefuji et al.
6,478,229 B1 11/2002 Epstein
6,481,753 B2 11/2002 Van Boom et al.
6,482,495 B1 11/2002 Kohama et al.
6,485,319 B2 11/2002 Bricaud et al.
6,487,301 B1 11/2002 Zhao
6,493,650 B1 12/2002 Rodgers et al.
6,503,310 B1 1/2003 Sullivan
6,505,160 B1 1/2003 Levy et al.
6,513,717 B2 2/2003 Hannigan
6,522,770 B1 2/2003 Seder et al.
6,525,672 B2 2/2003 Chainer et al.
6,526,161 B1 2/2003 Yan
6,526,512 B1 2/2003 Siefert et al.
6,532,459 B1 3/2003 Berson
6,536,665 B1 3/2003 Ray et al.
6,542,622 B1 4/2003 Nelson et al.
6,542,933 B1 4/2003 Durst, Jr. et al.
6,546,112 B1 4/2003 Rhoads
6,553,494 B1 4/2003 Glass
6,555,213 B1 4/2003 Koneripalli et al.
6,567,980 B1 5/2003 Jain et al.
6,570,609 B1 5/2003 Heien
6,572,021 B1 6/2003 Lippert
6,577,746 B1 6/2003 Evans et al.
6,580,815 B1 6/2003 Grajewski et al.
6,580,819 B1 6/2003 Rhoads
6,580,835 B1 6/2003 Gallagher et al.
6,581,839 B1 6/2003 Lasch et al.
6,583,813 B1 6/2003 Enright et al.
6,591,249 B2 7/2003 Zoka
6,606,420 B1 8/2003 Loce et al.
6,608,911 B2 8/2003 Lofgren et al.
6,614,914 B1 9/2003 Rhoads et al.
6,616,993 B2 9/2003 Usuki et al.
6,638,635 B2 10/2003 Hattori et al.
6,641,874 B2 11/2003 Kuntz et al.
6,650,761 B1 11/2003 Rodriguez et al.
6,667,815 B1 12/2003 Nagao
6,679,425 B1 1/2004 Sheppard et al.
6,681,028 B2 1/2004 Rodriguez et al.
6,681,032 B2 1/2004 Bortolussi et al.
6,685,312 B2 2/2004 Klinefelter et al.
6,687,345 B1 2/2004 Swartz et al.
6,698,653 B1 3/2004 Diamond et al.
6,702,282 B2 3/2004 Pribula et al.
6,712,397 B1 3/2004 Mayer et al.
6,715,797 B2 4/2004 Curiel
6,719,469 B2 * 4/2004 Yasui et al. ..... 400/603
6,723,479 B2 4/2004 Van De Witte et al.
6,725,383 B2 4/2004 Kyle
6,729,719 B2 5/2004 Klinefelter et al.
6,675,074 B2 6/2004 Hathout et al.
6,748,533 B1 6/2004 Wu et al.
6,751,336 B2 6/2004 Zhao
6,752,432 B1 6/2004 Richardson
6,754,822 B1 6/2004 Zhao
6,758,394 B2 7/2004 Maskatiya et al.
6,758,616 B2 7/2004 Pribula et al.
6,764,014 B2 7/2004 Lasch et al.
6,765,704 B2 7/2004 Drinkwater
6,769,061 B1 7/2004 Ahern
6,771,981 B1 8/2004 Zalewski et al.
6,782,115 B2 8/2004 Decker et al.
6,782,116 B1 8/2004 Zhao et al.
6,783,024 B2 8/2004 Lee
6,786,397 B2 9/2004 Silverbrook et al.
6,788,800 B1 9/2004 Carr et al.
6,794,115 B2 9/2004 Telser et al.
6,803,114 B1 10/2004 Vere et al.
6,804,376 B2 10/2004 Rhoads et al.
6,804,378 B2 10/2004 Rhoads
6,817,530 B2 11/2004 Labrec et al.
6,818,699 B2 11/2004 Kajimaru et al.
6,823,075 B2 11/2004 Perry
6,825,265 B2 11/2004 Daga et al.
6,827,277 B2 12/2004 Bloomberg et al.
6,827,283 B2 12/2004 Kappe et al.
6,829,368 B2 12/2004 Meyer et al.
6,832,205 B1 12/2004 Aragones et al.
6,834,124 B1 12/2004 Lin et al.
6,834,308 B1 12/2004 Ikezoye et al.
6,842,268 B1 1/2005 van Strijp et al.
6,843,422 B2 1/2005 Jones et al.
6,853,739 B2 2/2005 Kyle
6,996,273 B2 2/2005 Mihcak
6,865,011 B2 3/2005 Whitehead et al.
6,869,023 B2 3/2005 Hawes
6,882,737 B2 4/2005 Lofgren et al.
6,883,716 B1 4/2005 De Jong
6,891,555 B2 * 5/2005 Minowa et al. ..... 347/171
6,900,767 B2 5/2005 Hattori
6,903,850 B2 6/2005 Kay et al.
6,923,378 B2 8/2005 Jones et al.
6,925,468 B1 8/2005 Doughty et al.
6,926,203 B1 8/2005 Sehr
6,938,029 B1 8/2005 Tien
6,941,275 B1 9/2005 Swierczek
6,942,331 B2 9/2005 Guillen et al.
6,944,650 B1 9/2005 Urien
6,947,571 B1 9/2005 Rhoads et al.
6,952,741 B1 10/2005 Bartlett et al.
6,954,293 B2 10/2005 Heckenkamp et al.
6,958,346 B2 10/2005 Stoltefuss et al.
6,959,098 B1 10/2005 Alattar
6,961,708 B1 11/2005 Bierenbaum
6,963,659 B2 11/2005 Tumey et al.
6,970,573 B2 11/2005 Carr et al.
6,970,844 B1 11/2005 Bierenbaum
6,978,036 B2 12/2005 Alattar et al.
6,990,453 B2 1/2006 Wang
6,999,936 B2 2/2006 Sehr
7,013,284 B2 3/2006 Guyan
7,016,516 B2 3/2006 Rhoads
7,017,946 B2 * 3/2006 Behnen ..... 283/61
7,024,418 B1 4/2006 Childress et al.
7,024,563 B2 4/2006 Shimosato et al.
7,036,944 B2 5/2006 Budd et al.
7,043,052 B2 5/2006 Rhoads
7,044,395 B1 5/2006 Davis et al.
7,058,223 B2 6/2006 Cox
7,063,264 B2 6/2006 Bi et al.
7,072,526 B2 7/2006 Sakuramoto
7,081,282 B2 7/2006 Kuntz et al.
7,086,666 B2 8/2006 Richardson
7,095,426 B1 8/2006 Childress
7,095,871 B2 8/2006 Jones et al.
7,113,596 B2 9/2006 Rhoads
7,143,434 B1 11/2006 Paek
7,143,950 B2 12/2006 Jones et al.
7,152,786 B2 12/2006 Brundage et al.
7,159,116 B2 1/2007 Moskowitz
7,167,844 B1 1/2007 Leong et al.
7,171,018 B2 1/2007 Rhoads et al.
7,174,293 B2 2/2007 Kenyon
7,181,042 B2 2/2007 Tian
7,183,361 B2 2/2007 Toman
7,185,201 B2 2/2007 Rhoads et al.
7,191,156 B1 3/2007 Seder
7,194,106 B2 3/2007 Brundage et al.
7,196,813 B2 3/2007 Matsumoto 7,197,444 B2 3/2007 Bomar, Jr. et al.
7,199,456 B2 4/2007 Krappe et al.
7,202,970 B1 4/2007 Maher et al.
7,206,820 B1 4/2007 Rhoads et al.
7,207,494 B2 4/2007 Theodossiou et al.
7,209,573 B2 4/2007 Evans et al.
7,222,163 B1 5/2007 Girouard et al.
7,251,475 B2 7/2007 Kawamoto
7,254,285 B1 8/2007 Paek et al.
7,277,891 B2 10/2007 Howard et al.
7,278,580 B2 10/2007 Jones et al.
7,289,643 B2 10/2007 Brunk et al.
7,328,153 B2 2/2008 Wells
7,343,307 B1 3/2008 Childress
7,344,325 B2 3/2008 Meier et al.
7,353,196 B1 4/2008 Bobbitt et al.
7,356,541 B1 4/2008 Doughty
7,359,863 B1 4/2008 Evenshaug et al.
7,359,889 B2 4/2008 Wang
7,363,264 B1 4/2008 Doughty et al.
7,363,278 B2 4/2008 Schmelzer
7,372,976 B2 5/2008 Rhoads et al.
7,398,219 B1 7/2008 Wolfe
7,418,400 B1 8/2008 Lorenz
7,421,376 B1 9/2008 Caruso
7,430,514 B1 9/2008 Childress et al.
7,430,515 B1 9/2008 Wolfe et al.
7,498,075 B2 3/2009 Bloomberg et al.
7,526,487 B1 4/2009 Bobbitt et al.
2001/0001854 A1 5/2001 Schena et al.
2001/0002035 A1 5/2001 Kayanakis
2001/0005837 A1 6/2001 Kojo
2001/0006585 A1 7/2001 Horigane
2001/0007975 A1 7/2001 Nyberg et al.
2001/0013395 A1* 8/2001 Pourmand et al. ..... 156/555
2001/0014169 A1 8/2001 Liang
2001/0021144 A1 9/2001 Oshima et al.
2001/0022667 A1 9/2001 Yoda
2001/0023421 A1 9/2001 Numao et al.
2001/0024510 A1 9/2001 Iwamura
2001/0026377 A1 10/2001 Ikegami
2001/0028727 A1 10/2001 Naito et al.
2001/0030759 A1 10/2001 Hayashi et al.
2001/0030761 A1 10/2001 Ideyama
2001/0033674 A1 10/2001 Chen et al.
2001/0037223 A1 11/2001 Beery et al.
2001/0037309 A1 11/2001 Vrain
2001/0037313 A1 11/2001 Lofgren et al.
2001/0037455 A1 11/2001 Lawandy et al.
2001/0040980 A1 11/2001 Yamaguchi
2001/0043362 A1 11/2001 Hull et al.
2001/0047426 A1 11/2001 Hunter
2001/0052076 A1 12/2001 Kadono
2001/0053235 A1 12/2001 Sato
2001/0054149 A1 12/2001 Kawaguchi et al.
2001/0054644 A1 12/2001 Liang
2001/0056468 A1 12/2001 Okayasu et al.
2002/0007289 A1 1/2002 Malin et al.
2002/0012446 A1 1/2002 Tanaka
2002/0015509 A1 2/2002 Nakamura et al.
2002/0018430 A1 2/2002 Heckenkamp et al.
2002/0018879 A1 2/2002 Barnhart et al.
2002/0020832 A1 2/2002 Oka
2002/0021001 A1 2/2002 Stratford et al.
2002/0021824 A1 2/2002 Reed et al.
2002/0023218 A1 2/2002 Lawandy et al.
2002/0027359 A1 3/2002 Cobben et al.
2002/0027612 A1 3/2002 Brill et al.
2002/0027674 A1 3/2002 Tokunaga et al.
2002/0030587 A1 3/2002 Jackson
2002/0031241 A1 3/2002 Kawaguchi et al.
2002/0032864 A1 3/2002 Rhoads
2002/0033844 A1 3/2002 Levy et al.
2002/0034319 A1 3/2002 Tumey et al.
2002/0034373 A1 3/2002 Morita et al.
2002/0035488 A1 3/2002 Aquila et al.
2002/0037083 A1 3/2002 Weare
2002/0037093 A1 3/2002 Murphy
2002/0040433 A1 4/2002 Kondo
2002/0046171 A1 4/2002 Hoshino
2002/0049619 A1 4/2002 Wahlbin et al.
2002/0051162 A1 5/2002 Kawaguchi et al.
2002/0051569 A1 5/2002 Kita
2002/0052885 A1 5/2002 Levy
2002/0055860 A1 5/2002 Wahlbin et al.
2002/0055861 A1 5/2002 King et al.
2002/0057431 A1 5/2002 Fateley et al.
2002/0059083 A1 5/2002 Wahlbin et al.
2002/0059084 A1 5/2002 Wahlbin et al.
2002/0059085 A1 5/2002 Wahlbin et al.
2002/0059086 A1 5/2002 Wahlbin et al.
2002/0059087 A1 5/2002 Wahlbin et al.
2002/0059097 A1 5/2002 Wahlbin et al.
2002/0062232 A1 5/2002 Wahlbin et al.
2002/0062233 A1 5/2002 Wahlbin et al.
2002/0062234 A1 5/2002 Wahlbin et al.
2002/0062235 A1 5/2002 Wahlbin et al.
2002/0067844 A1 6/2002 Reed et al.
2002/0069091 A1 6/2002 Wahlbin et al.
2002/0069092 A1 6/2002 Wahlbin et al.
2002/0070280 A1 6/2002 Ikefuji et al.
2002/0072982 A1 6/2002 Barton
2002/0072989 A1 6/2002 Van De Sluis
2002/0073317 A1 6/2002 Hars
2002/0077380 A1 6/2002 Wessels et al.
2002/0077983 A1 6/2002 Tagashira
2002/0080271 A1 6/2002 Eveleens et al.
2002/0080396 A1 6/2002 Silverbrook et al.
2002/0080964 A1 6/2002 Stone et al.
2002/0080992 A1 6/2002 Decker et al.
2002/0080994 A1 6/2002 Lofgren et al.
2002/0082873 A1 6/2002 Wahlbin et al.
2002/0087363 A1 7/2002 Wahlbin et al.
2002/0088336 A1 7/2002 Stahl
2002/0105654 A1 8/2002 Goltsos
2002/0106494 A1* 8/2002 Roth et al. ..... 428/198
2002/0114013 A1 8/2002 Hyakutake et al.
2002/0116330 A1 8/2002 Hed et al.
2002/0116508 A1 8/2002 Khan et al.
2002/0118394 A1 8/2002 Mckinley et al.
2002/0126872 A1 9/2002 Brunk et al.
2002/0128881 A1 9/2002 Wahlbin et al.
2002/0136448 A1 9/2002 Bortolussi et al.
2002/0136459 A1 9/2002 Imagawa et al.
2002/0145652 A1 10/2002 Lawrence et al.
2002/0146549 A1 10/2002 Kranenburg-Van Dijk et al.
2002/0150277 A1 10/2002 Nishimoto et al.
2002/0163633 A1 11/2002 Cohen
2002/0166635 A1* 11/2002 Sasaki et al. ..... 156/521
2002/0170966 A1 11/2002 Hannigan et al.
2002/0176600 A1 11/2002 Rhoads et al.
2002/0178410 A1 11/2002 Haitsma et al.
2002/0187215 A1 12/2002 Trapani et al.
2002/0194476 A1 12/2002 Lewis et al.
2003/0002710 A1 1/2003 Rhoads
2003/0005304 A1 1/2003 Lawandy et al.
2003/0012562 A1 1/2003 Lawandy et al.
2003/0021441 A1 1/2003 Levy
2003/0031340 A1 2/2003 Alattar et al.
2003/0031348 A1 2/2003 Kuepper et al.
2003/0032033 A1 2/2003 Anglin et al.
2003/0033321 A1 2/2003 Schrempp
2003/0038174 A1 2/2003 Jones
2003/0040957 A1 2/2003 Rodriguez et al.
2003/0034319 A1 3/2003 Tumey et al.
2003/0052680 A1 3/2003 Konijn 2003/0055638 A1 3/2003 Burns et al.
2003/0056104 A1 3/2003 Carr et al.
2003/0056499 A1 3/2003 Binder et al.
2003/0056500 A1 3/2003 Huynh
2003/0059124 A1 3/2003 Center, Jr.
2003/0126121 A1 3/2003 Khan et al.
2003/0062421 A1 4/2003 Bloomberg et al.
2003/0099379 A1 5/2003 Monk et al.
2003/0102660 A1 6/2003 Rhoads
2003/0105739 A1 6/2003 Essafi
2003/0105762 A1 6/2003 McCaffrey et al.
2003/0114972 A1 6/2003 Takafuji et al.
2003/0115459 A1 6/2003 Monk
2003/0117262 A1 6/2003 Anderegg et al.
2003/0128862 A1 7/2003 Decker et al.
2003/0135623 A1 7/2003 Schrempp
2003/0140025 A1 7/2003 Daum
2003/0141358 A1 7/2003 Hudson et al.
2003/0161507 A1 8/2003 Lawandy
2003/0171939 A1 9/2003 Yagesh et al.
2003/0173406 A1 9/2003 Bi et al.
2003/0178487 A1 9/2003 Rogers
2003/0178495 A1 9/2003 Jones et al.
2003/0183695 A1 10/2003 Labrec et al.
2003/0188659 A1 10/2003 Merry et al.
2003/0200123 A1 10/2003 Burge et al.
2003/0211296 A1 11/2003 Jones et al.
2003/0226897 A1 12/2003 Jones et al.
2003/0234286 A1 12/2003 Labrec et al.
2003/0234292 A1 12/2003 Jones
2004/0011874 A1 1/2004 Theodossiou et al.
2004/0024694 A1 2/2004 Lawrence et al.
2004/0030587 A1 2/2004 Danico
2004/0036574 A1 2/2004 Bostrom
2004/0041804 A1 3/2004 Ives et al.
2004/0049409 A1 3/2004 Wahlbin et al.
2004/0054556 A1 3/2004 Wahlbin et al.
2004/0054557 A1 3/2004 Wahlbin et al.
2004/0054558 A1 3/2004 Wahlbin et al.
2004/0054559 A1 3/2004 Wahlbin et al.
2004/0064415 A1 4/2004 Abdallah et al.
2004/0066441 A1 4/2004 Jones et al.
2004/0074973 A1 4/2004 Duggan et al.
2004/0076310 A1 4/2004 Hersch et al.
2004/0093349 A1 5/2004 Buinevicius et al.
2004/0102984 A1 5/2004 Wahlbin et al.
2004/0102985 A1 5/2004 Wahlbin et al.
2004/0103004 A1 5/2004 Wahlbin et al.
2004/0103005 A1 5/2004 Wahlbin et al.
2004/0103006 A1 5/2004 Wahlbin et al.
2004/0103007 A1 5/2004 Wahlbin et al.
2004/0103008 A1 5/2004 Wahlbin et al.
2004/0103009 A1 5/2004 Wahlbin et al.
2004/0103010 A1 5/2004 Wahlbin et al.
2004/0111301 A1 6/2004 Wahlbin et al.
2004/0133582 A1 7/2004 Howard et al.
2004/0140459 A1 7/2004 Haigh et al.
2004/0158724 A1 8/2004 Carr et al.
2004/0172411 A1 9/2004 Herre
2004/0181671 A1 9/2004 Brundage et al.
2004/0198858 A1 10/2004 Labrec
2004/0213437 A1 10/2004 Howard et al.
2004/0243567 A1 12/2004 Levy
2004/0245346 A1 12/2004 Haddock
2005/0001419 A1 1/2005 Levy et al.
2005/0003297 A1 1/2005 Labrec
2005/0010776 A1 1/2005 Kenen
2005/0035589 A1 2/2005 Richardson
2005/0040243 A1 2/2005 Bi et al.
2005/0042396 A1 2/2005 Jones et al.
2005/0060205 A1 3/2005 Woods et al.
2005/0063562 A1 3/2005 Brunk et al.
2005/0072849 A1 4/2005 Jones
2005/0094848 A1 5/2005 Carr et al.
2005/0095408 A1 5/2005 Labrec et al.
2005/0109850 A1 5/2005 Jones
2005/0141707 A1 6/2005 Haitsma
2005/0144455 A1 6/2005 Haitsma
2005/0160294 A1 7/2005 LaBrec et al.
2005/0161512 A1 7/2005 Jones et al.
2005/0181167 A1* 8/2005 Behnen ..... 428/41.9
2005/0192850 A1 9/2005 Lorenz
2005/0216850 A1 9/2005 Ramos et al.
2005/0259819 A1 11/2005 Oomen
2006/0020630 A1 1/2006 Stager et al.
2006/0027667 A1 2/2006 Jones et al.
2006/0039581 A1 2/2006 Decker et al.
2006/0115108 A1 6/2006 Rodriguez
2006/0213986 A1 9/2006 Register et al.
2007/0016790 A1 1/2007 Brundage et al.
2007/0152067 A1 7/2007 Bi et al.
2007/0158939 A1 7/2007 Jones et al.
2007/0187515 A1 8/2007 Theodossiou et al.
2009/0174526 A1 7/2009 Howard et al.
2009/0187435 A1 7/2009 Carr et al.

FOREIGN PATENT DOCUMENTS

CA 2470094 6/2003
CA 2469956 7/2003
CN 1628318 6/2005
DE 2943436 5/1981
DE 3334009 A1 5/1985
DE 3738636 6/1988
DE 3806411 A1 9/1989
DE 9315294 3/1994
DE 4403513 A1 8/1995
DE 69406213 3/1998
EP 19099 A1 11/1980
EP 058482 A1 8/1982
EP 153547 A1 9/1985
EP 0157568 10/1985
EP 190997 8/1986
EP 222446 A2 5/1987
EP 0233296 8/1987
EP 0279104 8/1988
EP 0280773 9/1988
EP 0356980 3/1990
EP 0356981 3/1990
EP 0356982 3/1990
EP 0362640 4/1990
EP 0366075 A 5/1990
EP 0366923 5/1990
EP 372601 A1 6/1990
EP 0373572 6/1990
EP 0374835 6/1990
EP 411232 A2 2/1991
EP 0420613 4/1991
EP 441702 A1 8/1991
EP 0446834 9/1991
EP 0446846 9/1991
EP 0465018 1/1992
EP 0479265 4/1992
EP 479295 A1 4/1992
EP 493091 A1 7/1992
EP 0523304 1/1993
EP 0539001 4/1993
EP 581317 A2 2/1994
EP 590884 A2 4/1994
EP 629972 12/1994
EP 0636495 2/1995
EP 0637514 2/1995
EP 0649754 4/1995
EP 650146 A1 4/1995
EP 0696518 2/1996
EP 0697433 2/1996

| | | | | |
|---|---|---|---|---|
| EP | 705022 | A2 | | 4/1996 |
| EP | 705025 | A2 | | 4/1996 |
| EP | 0734870 | | | 10/1996 |
| EP | 0736860 | | | 10/1996 |
| EP | 0739748 | | | 10/1996 |
| EP | 788085 | A1 | | 8/1997 |
| EP | 835739 | A2 | | 4/1998 |
| EP | 642060 | | | 3/1999 |
| EP | 0926608 | | | 6/1999 |
| EP | 0975147 | A2 | | 1/2000 |
| EP | 0982149 | | | 3/2000 |
| EP | 0991014 | | | 4/2000 |
| EP | 991014 | A2 | | 4/2000 |
| EP | 991047 | A2 | | 4/2000 |
| EP | 1013463 | | | 6/2000 |
| EP | 1017016 | | | 7/2000 |
| EP | 1035503 | | | 9/2000 |
| EP | 1046515 | | | 10/2000 |
| EP | 1077570 | A2 | | 2/2001 |
| EP | 1110750 | A | | 6/2001 |
| EP | 1117246 | A1 | | 7/2001 |
| EP | 1134710 | A2 | | 9/2001 |
| EP | 1137244 | A2 | | 9/2001 |
| EP | 1147495 | A1 | | 10/2001 |
| EP | 1152592 | A1 | | 11/2001 |
| EP | 0464268 | | | 1/2002 |
| EP | 1173001 | A2 | | 1/2002 |
| EP | 1209897 | A2 | | 5/2002 |
| EP | 1410315 | | | 4/2004 |
| EP | 1909971 | | | 4/2008 |
| GB | 1088318 | | | 10/1967 |
| GB | 1213193 | | | 11/1970 |
| GB | 1472581 | | | 5/1977 |
| GB | 1472581 | A | | 5/1977 |
| GB | 2063018 | A | | 5/1981 |
| GB | 2067871 | A | | 7/1981 |
| GB | 2132136 | | | 7/1984 |
| GB | 2196167 | A | | 4/1988 |
| GB | 2204984 | A | | 11/1988 |
| GB | 2227570 | | | 8/1990 |
| GB | 2240948 | | | 8/1991 |
| GB | 2325765 | A | | 12/1998 |
| GB | 2344482 | A | | 6/2000 |
| GB | 2346110 | A | | 8/2000 |
| GB | 2360659 | A | | 9/2001 |
| JP | 52119681 | A | | 10/1977 |
| JP | 63146909 | | | 6/1988 |
| JP | 03126589 | | | 5/1991 |
| JP | 3185585 | | | 8/1991 |
| JP | 4248771 | A | | 9/1992 |
| JP | 4267149 | A | | 9/1992 |
| JP | 5242217 | A | | 9/1993 |
| JP | 624611 | | | 2/1994 |
| JP | 6234289 | | | 8/1994 |
| JP | 06234289 | | | 8/1994 |
| JP | 07088974 | | | 4/1995 |
| JP | 7088974 | | | 4/1995 |
| JP | 07093567 | | | 4/1995 |
| JP | 07108786 | | | 4/1995 |
| JP | 7115474 | A | | 5/1995 |
| JP | 08-50598 | A | | 2/1996 |
| JP | 09064545 | A | * | 3/1997 |
| JP | 10171758 | A | | 6/1998 |
| JP | 10177613 | A | | 6/1998 |
| JP | 10197285 | | | 7/1998 |
| JP | 10214283 | | | 8/1998 |
| JP | 11161711 | | | 6/1999 |
| JP | 11259620 | | | 9/1999 |
| JP | 11259620 | A | | 9/1999 |
| JP | 11301121 | | | 11/1999 |
| JP | 11321166 | | | 11/1999 |
| JP | 2004355659 | | | 12/2004 |
| JP | 2005525254 | | | 8/2005 |
| JP | 2005525949 | | | 9/2005 |
| JP | 2005276238 | | | 10/2005 |
| JP | 2006190331 | | | 7/2006 |
| WO | WO 82/04149 | | | 11/1982 |
| WO | 89/00319 | | | 1/1989 |
| WO | WO-8907517 | A1 | | 8/1989 |
| WO | WO-8908915 | A1 | | 9/1989 |
| WO | 91/16722 | | | 10/1991 |
| WO | WO-9427228 | A1 | | 11/1994 |
| WO | 95/13597 | | | 5/1995 |
| WO | WO-9513597 | A2 | | 5/1995 |
| WO | WO-9514289 | A2 | | 5/1995 |
| WO | WO-9520291 | A1 | | 7/1995 |
| WO | 96/03286 | | | 2/1996 |
| WO | WO-9603286 | A1 | | 2/1996 |
| WO | WO-9626494 | A1 | | 8/1996 |
| WO | WO-9627259 | A1 | | 9/1996 |
| WO | WO-9636163 | A2 | | 11/1996 |
| WO | 97/01446 | | | 1/1997 |
| WO | 97/18092 | | | 5/1997 |
| WO | 97/32733 | | | 9/1997 |
| WO | WO-9743736 | A1 | | 11/1997 |
| WO | WO-9814887 | A1 | | 4/1998 |
| WO | 98/19869 | | | 5/1998 |
| WO | WO-98/20411 | A1 | | 5/1998 |
| WO | WO-9819869 | | | 5/1998 |
| WO | WO-9820642 | A1 | | 5/1998 |
| WO | WO-9824050 | A1 | | 6/1998 |
| WO | 98/30224 | | | 7/1998 |
| WO | WO-9840823 | A1 | | 9/1998 |
| WO | WO-9849813 | A1 | | 11/1998 |
| WO | WO-99/15299 | A1 | | 4/1999 |
| WO | 99/24934 | | | 5/1999 |
| WO | WO-9924934 | | | 5/1999 |
| WO | WO-9934277 | A2 | | 7/1999 |
| WO | 00/10116 | | | 2/2000 |
| WO | 00/43214 | | | 7/2000 |
| WO | 00/43215 | | | 7/2000 |
| WO | 00/43216 | | | 7/2000 |
| WO | WO-0043216 | | | 7/2000 |
| WO | 00/45344 | | | 8/2000 |
| WO | 00/78554 | | | 12/2000 |
| WO | 01/00719 | | | 1/2001 |
| WO | WO-0105075 | A1 | | 1/2001 |
| WO | WO-0108405 | A1 | | 2/2001 |
| WO | 01/29764 | A1 | | 4/2001 |
| WO | WO-0139121 | A1 | | 5/2001 |
| WO | 01/45559 | | | 6/2001 |
| WO | WO 0143080 | A1 | | 6/2001 |
| WO | 01/56805 | | | 8/2001 |
| WO | WO-0172030 | A2 | | 9/2001 |
| WO | WO-0173997 | A1 | | 10/2001 |
| WO | WO-0175629 | A1 | | 10/2001 |
| WO | WO-0188883 | A1 | | 11/2001 |
| WO | 01/95249 | | | 12/2001 |
| WO | WO-01/96112 | A1 | | 12/2001 |
| WO | WO-0197128 | A1 | | 12/2001 |
| WO | WO-0197175 | A1 | | 12/2001 |
| WO | WO-02/03385 | A1 | | 1/2002 |
| WO | WO-0203328 | A1 | | 1/2002 |
| WO | WO-0219269 | A2 | | 3/2002 |
| WO | WO-0221846 | A1 | | 3/2002 |
| WO | WO-0223481 | A1 | | 3/2002 |
| WO | WO-0225599 | A1 | | 3/2002 |
| WO | 02/26507 | A1 | | 4/2002 |
| WO | 02/27647 | A1 | | 4/2002 |
| WO | WO-0227618 | A2 | | 4/2002 |
| WO | WO-0227720 | A1 | | 4/2002 |
| WO | 02/42371 | | | 5/2002 |
| WO | WO-0239719 | A1 | | 5/2002 |
| WO | 02/45969 | | | 6/2002 |
| WO | 02/052499 | | | 7/2002 |
| WO | 02/053499 | | | 7/2002 |

| | | | |
|---|---|---|---|
| WO | WO-02053499 | | 7/2002 |
| WO | 02/78965 | A1 | 10/2002 |
| WO | WO-02095677 | A2 | 11/2002 |
| WO | 02/096666 | | 12/2002 |
| WO | 03/005291 | | 1/2003 |
| WO | WO-03005291 | | 1/2003 |
| WO | 03/030079 | | 4/2003 |
| WO | 03/055684 | | 7/2003 |
| WO | 03/056500 | | 7/2003 |
| WO | 03/056507 | | 7/2003 |
| WO | 03/095210 | | 11/2003 |
| WO | WO03/096258 | | 11/2003 |
| WO | 2004/034236 | | 4/2004 |
| WO | 2004/049242 | | 6/2004 |

OTHER PUBLICATIONS

U.S. Appl. No. 60/358,321, filed Feb. 19, 2002, Munday et al.
U.S. Appl. No. 60/379,646, filed May 10, 2002, Mailloux et al.
U.S. Appl. No. 60/379,704, May 10, 2002, Bi et al.
U.S. Appl. No. 60/421,254, filed Oct. 25, 2002, Rhoads et al.
U.S. Appl. No. 60/418,762, filed Oct. 15, 2002, Rhoads et al.
U.S. Appl. No. 60/410,544, filed Sep. 13, 2002, Haigh et al.
U.S. Appl. No. 60/418,129, filed Oct. 11, 2002, Howard et al.
U.S. Appl. No. 60/429,501, filed Nov. 26, 2003, Howard et al.
U.S. Appl. No. 60/447,502, filed Feb. 13, 2003, Haigh et al.
U.S. Appl. No. 60/451,840, filed Mar. 3, 2003, Levy.
U.S. Appl. No. 60/459,284, Mar. 31, 2003, Jones.
International Search Report, PCT/US03/15095.
U.S. Appl. No. 60/371,335, published Apr. 9, 2002, Schneck.
U.S. Appl. No. 60/429,115, published Nov. 25, 2002, Jones.
@Fault: Improve Claims Practices Through Greater consistency in Fault Assessment, Computer Sciences corporation, pp. 2, 2004. (g53).
"@ Fault A Commitment to Consistency," Computer Sciences Corporation, Copyright 2000, pp. 1-2.
"About Card Printing How it Works", http://www.racoindustries.com/aboutcardp5.htrn., pp. 1-3 (Dec. 22, 2002).
"Accident Reconstruction Software Maine Computer Group," Maine Computer Group, Copyright 2001, updated Oct. 1, 2001, accessed Oct. 29, 2001, pp. 1-2.
"ADP CSG: Integrated Medical Solutions," ADP Claims Solutions Group, Copyright 2001, accessed Oct. 30, 2001, p. 1.
"Authentication and Security Technologies," I/O Software, Inc., accessed Oct. 10, 2002, 4 pages.
"Biometric Access Control System, Face and Fingerprint Recognition," BioAxs 9800, 4 pages.
"CSC Expands Cost Containment Solutions for Claims and Legal Expenses," Computer Sciences Corporation, Jun. 27, 2001, El Segundo, CA, pp. 1-2.
"CSC Files Suit to protect Intellectual Property", PR Newswire, New York: Jan. 12, 2000, p. 1.
"CSC Introduces Liability Assessment Tool to Improve Claims Consistency," Computer Science Corporation, Oct. 31, 2001, pp. 1-2.
"CSC: Solutions Search," Computer Sciences Corporation, Copyright 2001, accessed Oct. 30, 2001, p. 1.
"Facelt Identification SDK," Identix, Inc., 2002, accessed Oct. 7, 2002, 2 pages.
"Facelt an Award-Winning Facial Recognition Software Engine," Visionics, not dated, 1 page.
"Facial Scan Technology: How it works," Facial-Scan, 1999, 4 pages.
"Facial Scan Vendors and Links," Facial-Scan, 1999, 3 pages.
"Frequently Asked Questions," Facelt software, accessed Oct. 10, 2002, 13 pages.
"ID-2000-Image Detection & Biometric Facial Recognition," 2000, 3 pages.
"Identification Solutions-Driver's Licenses and passports," Image Technologies, Copyright 2001-2002, Accessed Oct. 10, 2002, 1 page.
"IMS ICE," ADP Integrated Medical Solutions, Copyright 2001, Rockville, MD, pp. 1-6.
"Insurance Services Office Strengthens Claims Handling Team," ISO Properties, Inc., Copyright 1996, Accessed Jul. 13, 2009, Jersey City, NJ, pp. 1-3.
"Introducing Smart CCTV," Facelt, Visionics, 2000, 8 pages.
"ISO Claims Outcome Advisor," ISO Properties, Inc., Copyright 1996, Accessed Oct. 30, 2001, Jersey City, NJ, pp. 1- 2.
"ISO to Acquire Claims Outcome Advisor from Computer Sciences and MYND," Dec. 21, 2000, accessed at www.swampfox.ws.
"Lenticular - How it Works", The Vision - Sales Articles from 1998.
"Lenticular Prints", http://www.shortcourses.com/how/lenticular/lentcular.htm, pp. 1-6 (Dec. 16, 2002).
"Multi-Modal Biometrics Authentication System," findbiometrics.com - Multimodal Biometrics Guides and Articles, Oct. 9, 2003, 4 pages.
"Polaroid's Polaprime UV Invisible Ink System Winks at Hollywood As Godzilla's Eye in Promo Display", http://www.polaroid.com/polinfo/press_releases/auqust98/080598a.html., pp. 1-2 (Nov. 26, 2002).
"Policy Management Systems Corporation Announces Pilot Licensing of Claims Outcome Advisor™ to Blue Ridge Insurance Co.," PR Newswire. New York; Aug. 24, 1999, p. 1.
REC-TEC Accident Reconstruction and Analysis Computer Software,' George M. Bonnett, Nov. 2001, Rockledge, FL, pp. 1-5.
"REC-TEC Accident Reconstruction Software," George M. Bonnett, Sep. 2001, Rockledge FL, pp. 1-10.
"Secure ID Center: Design a Secure ID card Key technologies for a secure ID", http://www.datacard.com/secureid/secureid_card_technologies_features.shtm., pp. 1-5 (Dec. 12, 2002).
"Technologies Overview", http://www.nfive.com/Articles/2.htm, pp. 1-2 (Dec. 22, 2002).
"U.S. Unveils New $20 Note With Background Colors", U.S. Bureau of Engraving and Printing New Money Media Center, 2 pages. (Jul. 28, 2003).
"We're Watching Out for You," Business Solution, Accessed Oct. 10, 2002, 3 pages.
"Welcome to Orasee Corporation", http://www.orasee.com/one/main.php3, pp. 1-2, (Dec. 13, 2002).
"What are 'Dye Sublimation Thermal Printers'? (Technology)", http://www.nfive.com/Articles/2.htm., pp. 1-2 (Dec. 22, 2002).
Amended claims from WO/056507, corresponding to those in EP 02 805 980.6, Apr. 24, 2008.
Appeal Brief filed Apr. 11, 2008 and Examiner's Answer dated May 7, 2008 from U.S. Appl. No. 10/893,149.
Aug. 16, 2007 communication from the Canadian Intellectual Property Office in Application No. 2,470,600, and a Feb. 15, 2008 Amendment in response thereto.
Baker, "Don't Throw Your Adjusters to the Lions", *Best's Review*, 95(12):66-69 (1995).
Banking Connections, Computer Sciences Corporation, Apr./May 1999, 44 pages.
Banking Connections, Computer Sciences Corporation, Apr./May 2000, 48 pages.
Banking Connections, Computer Sciences Corporation, Aug./Sep. 1999, 52 pages.
Banking Connections, Computer Sciences Corporation, Dec. 1999, 48 pages.
Banking Connections, Computer Sciences Corporation, Nov./Dec. 2000, 48 pages.
Beigi, "MetaSEEk - A Content-Based Meta-Search Engine for Images," Proc. SPIE Storage and Retrieval for Image and Video Databases, 1998.
Benitez et al., Object-Based Multimedia Content Description Schemes and Applications for MPEG-7, Signal Processing - Image Communication, vol. 16, Issues 1-2, Sep. 2000, pp. 235-269.
Borland, "Running Microsoft Outlook 97", *Microsoft Press*, (1997).
Canadian Patent application 2,469,938, claims as filed, with effective filed of Dec. 20, 2002, 10 pages.
Canadian Patent application 2,469,938, Office Action dated Jul. 24, 2006, 2 pages.
Chang et al., Multimedia Search and Retrieval, a chapter in Advances in Multimedia - Systems, Standards, and Networks, Puri ed., New York-Marcel Dekker, 1999, 28 pages.
Chang, "Visual Information Retrieval from Large Distributed Online Repositories," Communications of the ACM, vol. 40, No. 12, pp. 63-71, Dec. 1997.

Chow et al., "Forgery and Temper-Proof Identification Document," *IEEE Proc. 1993 Int. Carnahan Conf. on Security Technology*, 11-14 (1993).
CIGNA P&C Opens National Premises Liability Center, Mar. 1999, PR Newswire, p. 1.
Clariant Masterbatches Division Price Quotation #474938, Nov. 30, 2000, 2 pages.
Clariant Masterbatches, pricing, #762998, Jan. 9, 2004, 2 pages.
Connections to the Americas, vol. 3, No. 1, CSC Continuum, Jan. 1997, 55 pages.
Connections to the Americas, vol. 3, No. 2, CSC Continuum, Feb. 1997, 55 pages.
Connections to the Americas, vol. 3, No. 3, CSC Continuum, Mar. 1997, 48 pages.
Connections to the Americas, vol. 3, No. 4, CSC Continuum, Apr. 1997, 40 pages.
Connections to the Americas, vol. 3, No. 5, Computer Sciences Corporation, May/Jun. 1997, 66 pages.
Connections to the Americas, vol. 3, No. 6, Computer Sciences Corporation, Jul./Aug. 1997, 56 pages.
Connections to the Americas, vol. 3, No. 7, Computer Sciences Corporation, Sep./Oct. 1997, 76 pages.
Connections to the Americas, vol. 4, No. 1, Computer Sciences Corporation, Jan. 1998, 64 pages.
Connections to the Americas, vol. 4, No. 2, Computer Sciences Corporation, Feb./Mar. 1998, 50 pages.
Connections to the Americas, vol. 4, No. 3, Computer Sciences Corporation, May/Jun. 1998, 48 pages.
Connections to the Americas, vol. 4, No. 4, Computer Sciences Corporation, Sep./Oct. 1998, 62 pages.
Connections, Computer Sciences Corporation, Dec. 2001, 39 pages.
Connections, Computer Sciences Corporation, Jun. 2001, 44 pages.
Connections, Computer Sciences Corporation, Mar./Apr. 2001, 44 pp.
Connections, Computer Sciences Corporation, Oct. 2001, 39 pages.
Continuum Connections to the Americas, vol. 1, No. 1, The Continuum Company, Inc., Sep. 1995, 49 pages.
Continuum Connections to the Americas, vol. 2, No. 1, The Continuum Company, Inc., Jan. 1996, 59 pages.
Continuum Connections to the Americas, vol. 2, No. 2, the Continuum Company, Inc., Mar. 1996, 59 pp.
Continuum Connections to the Americas, vol. 2, No. 3, The Continuum Company, Inc., May 1996, 51 pages.
Continuum Connections to the Americas, vol. 2, No. 4, The Continuum Company, Inc., Jul. 1996, 55 pages.
Continuum Connections to the Americas, vol. 2, No. 5, The Continuum Company, Inc., Sept. 1996, 59 pages.
Continuum Connections, vol. I, No. 1, The Continuum Company, Inc., Nov. 1991, 16 pages.
Continuum Connections, vol. I, No. 2, The Continuum Company, Inc., Jan./Feb. 1992, 17 pages.
Continuum Connections, vol. I, No. 3, The Continuum Company, Inc., Mar./Apr. 1992, 16 pages.
Continuum Connections, vol. I, No. 4, The Continuum Company, Inc., Jul./Aug. 1992, 15 pages.
Continuum Connections, vol. II, No. 1, The Continuum Company, Inc., Oct./Nov. 1992, 16 pages.
Continuum Connections, vol. II, No. 2, The Continuum Company, Inc., Dec./Jan. 1993, 24 pages.
Continuum Connections, vol. II, No. 3, The Continuum Company, Inc., Mar./Apr. 1993, 16 pages.
Continuum Connections, vol. II, No. 4, The Continuum Company, Inc., Jul./Aug. 1993, 16 pages.
Continuum Connections, vol. II, No. 5, The Continuum Company, Inc., Nov./Dec. 1993, 20 pages.
Continuum Connections, vol. II, No. 6, The Continuum Company, Inc., Jan./Feb. 1994, 19 pages.
Continuum Connections, vol. III, No. 1, The Continuum Company, Inc., Mar./Apr. 1994, 24 pages.
Continuum Connections, vol. III, No. 2, The Continuum Company, Inc., Nov./Dec. 1994, 20 pages.
Continuum Connections, vol. III, No. 3, The Continuum Company, Inc., Mar./Apr. 1995, 16 pages.
Continuum Connections, vol. III, No. 4, The Continuum Company, Inc., Oct./Nov. 1995, 24 pages.
Cost Containment: Products and Solutions for the Property and Casualty Insurance Industry, Computer Science Corporation, Oct. 1999, 40 pages.
Datacard DCL30, "The Most Secure Card Personalization System for ID Programs, " 2002, 3 pages.
Davis, "Knowledge on the Beat," Jul. 1999, Knowledge Management Magazine, www.destinationkm.com.
Ditek@http://www.archive.org/web/20000301124742/www.ditec.com, last viewed on Nov. 28, 2005.
effekte, "Plastics on the Rise", Mar. 2001, 12 pages.
EM Industries Inc., Lazer Flair LS Series Pigments, Dec. 11, 2002, 3 pages.
EP 01992398.6 first examination report, dated Jan. 7, 2005.
EP 01992398.6 notice of grant, dated Nov. 28, 2005.
EP 01992398.6 response to first examination report , dated Jul. 18, 2005.
EP02797041.7 Search Report, Mar. 19, 2007, 3 pages.
EP02797041.7, communication pursuant to Article 94(3) EPC, dated Dec. 28, 2007, of related EP counterpart application, 6 pages.
Esters, "Computers Can Help Settle Auto Claims" Apr. 28, 1997, National Underwriter. vol. 101, Iss. 17, p. 10.
Examiner's Report dated May 2, 2006, from CA Application No. 2,470,600 (corresponding to PCT/US02/41681; Published as WO03/056507).
Facelt, "Real Time Facial Surveillance and Identification System," Accessed Oct. 10, 2002, 5 pages.
Facelt-Hands off, continuous and in real-time, Visionics, not dated, 1 page.
Final Rejection, U.S. Appl. No. 10/836,639, Bi et al., filed Apr. 29, 2004, mailed Apr. 1, 2008.
Final Rejection, U.S. Appl. No. 10/836,639, Bi et al., filed Apr. 29, 2004, mailed Sep. 21, 2006.
Frey, Joe, "Putting a price on auto injuries: How software called Colossus evaluates your pain," Insure.com, Oct. 26, 2000, pp. 1-5.
Graff, "Laser Marking Makes Bigger Imprint in Plastics", Aug. 11, 2004, 7 pages.
Harts, "Reel to Real: Should You believe What You See?" Defense Counsel Journal, Oct. 1999, vol. 66. p. 514 from the Dialog File ABI/Inform Global.
Hill, "Cure of Thermoset Industrial Coatings", Proc. 2d Pacific Coatings forum, Nov. 1-3, 1997, 6 pages.
Hirabayashi et al., "AC Power Electroluminescence Maintenance Improvement", pp. 2449, 2452 (1983).
Holding State in Objects with Microsoft Transaction Server, Microsoft Corp., pp. 2, Jun. 1997. (f37).
Hong et al., Integrating Faces and Fingerprints for Personal Identification, IEEE Trans. On Pattern Analysis and Machine Intelligence, vol. 20, No. 12, Dec., 1998, pp. 1295-1307.
Howarth, B., "Outsourcing: Technology on tap", *Information Economy, BRW*, 21(47):1-5 (1998).
Hu et al., "Locating head and face boundaries for head-shoulder images", Patern Recognition, 32(8):1317-1333 (1999) 5230001US.
Huang et al., Multimedia Search and Retrieval - New Concepts, System Implementation, and Application, IEEE Trans on Circuits and Systems for Video Tech., 10(5):679-692 (Aug. 2000).
Identix, Inc., ImageVVare Brings Facial Recognition to the Web, press release, Accessed Oct. 10, 2002, 2 pages.
ImageWare Takes Enterprise ID Management to the World Wide Web, new release, Accessed Oct. 10, 2002, 2 pages.
Indovina, "Multimodal Biometric Authentication Methods," A COTS Approach, 8 pages.
Insurance Connections, Computer Sciences Corporation, Feb./Mar. 1999, 52 pages.
Insurance Connections, Computer Sciences Corporation, Feb./Mar. 2000, 60 pages.
Insurance Connections, Computer Sciences Corporation, Jun./Jul. 1999, 56 pages.
Insurance Connections, Computer Sciences Corporation, Jun./Jul. 2000, 43 pages.
Insurance Connections, Computer Sciences Corporation, Sep./Oct. 2000, 43 pages.

Insurance Connections, Computer Sciences Corporations, Oct./Nov. 1999, 56 pages.
International search report application No. PCT/US01/30822, mailed Jan. 22, 2002, 5 pages.
Jain et al., A Multimodal Biometric System Using fingerprint, Face and Speech, Proc. 2d Int. Conf. on A VBPA, Mar. 1999, pp. 182-187.
Jarvis, "Are Privacy Rights of Citizens Being Eroded Wholesale?" Accessed Oct. 4, 2002, 5 pages.
Juhl, Randy P., "The OTC Revolution"; Drugtopics.com; Mar. 3, 1997, pp. 1-9.
Kahn, "The Premise Behind Premises Liability" Feb. 1994, Security Management, vol. 38, Iss.2 pp. 61-63.
Kang et al., Multimedia database system with embedding MPEG-7 meta data, Proc. SPIE, 4311:187-197 (2001).
Kanopoulos et al., "Design of an image edge detection filter using the sobel operator", *IEEE J. Solid-State Circuits*, 23(2):358-367 (1988).
Kawaguchi et al., "Principle and Applications of BPCS-Streganography," *Proc. SPIE*, 3258:464-473 (1998).
Komatsu et al., "Authentication System Using Concealed Image in Telematics," *Memoirs of the School of Science & Engineering, Waseda Univ.*, No. 52, 45-60 (1988).
Komatsu, et al., "A Proposal on Digital Watermarking in Document Image Communication and Its Application to Realizing a Signature," *Electronics and Communications in Japan*, 73(5):22-23 (1990).
Laser Technology, Inc. "Crash/Crime Scene Mapping" @ http://www.lasertech.com/accidentcsinv.html. Copyright. 1999.
Laser Technology, inc. "QuickMap 3D" http:web.archive.org/web/200003011511/222.lasertech.com/laserproducts/qm3d.html, last viewed on Nov. 28, 2005.
Lhotka et al., "Lenticular Inkjet Printmaking", http://www.dvpratt.com/evesnnind/lentOver.htm, pp. 1-2 (Dec. 16, 2002).
Li et al., "Facial Expression Transformation Based on Sketch Image and Multiscale Edges", *Electronics Comm. Japan*, 84(9):67-75 (2001).
Lindberg, Gunnar, "Calculating Transport Accident Costs: Final report of the Expert Advisors to the high Level group on Infrastructure charging (Working Group 3)." Borlaenge, Sweden. Apr. 27, 1999, 53 pages.
Liu, "A Practical Guide to Biometric Security Technology," 2001 IEEE, Jan./Feb. 2001 IT PRO, pp. 27-32.
Madan, "The Face is Familier," 2001, 2 pages.
Malloy, "Big Time' Match Frame May Be Small, but it has No Problems Working with the Big Boys", San Antonio Business Journal, vol. 5 No. 11, s1, p. aa, Mar. 15, 1999. Dialog ID No. 0205483 from Dialog File 635 (Business Dateline. RTM.).
Marques, Content-Based Visual Information Retrieval, Ch. 3 in Distributed Multimedia Databases, 2003, 22 pages.
McHenry, Brian G., "The Algorithms of Crash," Southeast Coast Collision Conference, Aug. 2001, pp. 1-34.
Mead, Jay, "Measuring the value added by technical documentation: A review of research and practice", *Technical Comunication*, 45(3):353-380 (1998).
Meckbach, "U.S. Universities pick up Ditek's CAD application" Feb. 26, 1999. Computing Canada. vol. 25, Iss. 8 p. 14.
Meng, "Building Efficient and Effective Metasearch Engines," ACM Computing Surveys, pp. 48-89, Mar., 2002.
Merlin, Jr., William F., "Collision Course With The Colossus Program: How to Deal With It," The Merlin Law Group, May 2000, Tampa, FL, pp. 1-17.
Merlin, Jr., William F., "Colossus: What We Know Today," The Merlin Law Group, Aug. 2000, Tampa, FL, pp. 1-8.
Merlin, Jr., William F., "Overcoming Allstate's TradeSecrets and Work-Product Objections," The Merlin Law Group, Mar. 2000, Tampa, FL, pp. 1-31.
Mhatre, "Efficient Search and Retrieval in Biometric Databases," 4 pages.
Microsoft Component Services: Server Operating System A Technology Overview, Microsoft Corp., pp. 1-7, Aug. 15, 1998. (f38).
Moran, R., "3-D Imagery", http://www.flexography.org/flexo/article.cfm?ID=45, pp. 1-3 (Dec. 16, 2002).
Nack, Everything You Wanted to Know About MPEG-7 - Part 2, IEEE Multimedia, 6(4):64-73 (Oct. 1999).
Nandakumar, "Score Normalization in Multimodal Biometric Systems, " 2 pages.
Narin, Geoff, IT and Crime Resolution, It's elementary, Holmes helps UK police solve crimes, Financial Times, Dec. 3, 1997, Financial Times (London, UK), pp. 17.
Nicolle, "Elementary, dear Holmes," Jan. 22, 1997, The Times (London, UK, pg. Interfa).
Non-Final Rejection, U.S. Appl. No. 10/836,639, Bi et al., filed Apr. 29, 2004, mailed Apr. 14, 2009.
Non-Final Rejection, U.S. Appl. No. 10/836,639, Bi et al., filed Apr. 29, 2004, mailed Aug. 8, 2007.
Non-Final Rejection, U.S. Appl. No. 10/836,639, Bi et al., filed Apr. 29, 2004, mailed Mar. 10, 2006.
Non-Final Rejection, U.S. Appl. No. 10/836,639, Bi et al., filed Apr. 29, 2004, mailed Aug. 10, 2005.
Oct. 18, 2007 Communication from the European Patent Office in Application No. EP 02 805 980.6.
Office Action dated Feb. 1, 2007, from U.S. Appl. No. 10/942,321, 10 pages.
Office Action dated May 13, 2008, from U.S. Appl. No. 10/677,092, 5 pages.
Office Action dated Jun. 20, 2007, from U.S. Appl. No. 10/677,092, 6 pages.
Paek, "Self-Describing Schemes for Interoperable MPEG-7 Multimedia Content Descriptions," Proc. SPIE, vol. 3653, p. 1518, Jan. 1999.
Palla, "Classification and Indexing in Large Biometric Databases," 2 pages.
Paulson, B.A., "High Definition Printing Process for Identification Card Production", ICMA, wvwv.icma.com/info/hdprinting91099.htm (Apr. 9, 2002).
PCT - International Search Report for International Application No. PCT/US02/41644, mailed on May 30, 2003.
PCT - International Search Report for International Application No. PCT/US02/41680, mailed on Jun. 5, 2003.
PCT - International Search Report for International Application No. PCT/US02/41681, mailed on Jun. 5, 2003.
PCT - International Search Report for International Application No. PCT/US02/40843, mailed on May 15, 2003.
PCT - International Search Report for the International Application No. PCT/US02/41320, mailed on Jul. 28, 2003.
PCT - Notification of Transmittal of the International Search Report or the Declaration, for International Application No. PCT/US02/40843, mailed on May 15, 2003.
PCT - Notification of Transmittal of the International Search Report or the Declaration, for International Application No. PCT/US02/41644, mailed on May 30, 2003.
PCT - Notification of Transmittal of the International Search Report or the Declaration, for International Application No. PCT/US02/41680, mailed on Jun. 5, 2003.
PCT - Notification of Transmittal of the International Search Report or the Declaration, for International Application No. PCT/US02/41681, mailed on Jun. 5, 2003.
PCT - Notification of Transmittal of the International Search Report or the Declaration, for the International Application No. PCT/US02/41320, mailed on Jul. 28, 2003.
Perry et al., "Digital Watermarks as a Security Feature for Identity Documents", *Proc. Of SPIE*, 3973:80-87 (2000).
Plastics Technology, "Laser Marking Has a Bright Future in Plastics", http://www.plasticstechnology.com/articles/200108fa1.html, Aug. 1, 5 pages.
Printed copy of a PolyOne company web page for FAST MARK colorants, 2 printed pages, printed on Dec. 15, 2003 and accessed from: http://www.polyone.com/bizunit/bizunit_info.asp?ID1={4D07B4ED-C098-43E4-B802-21413A1FA74C}&ID2={8C29FDCA-7C9E-433E-897A-DB6354A01CAA}&ID3={00000000-0000-0000-0000-000000000000}&ID4={FE3434DA-7FA0-4FFF-99AF-CDD99EC16AE1}&bizUnit=NA-P-CM&Iine=&sub=none.
Property and Casualty Solutions: CSC's Property & Casualty Claims Solutions, Computer Sciences Corporation, pp. 2, 2003. (g51).

Rehm, Representing Internet Streaming Media Metadata using MPEG-7 Multimedia Description Schemes, Proceedings of the 2000 ACM workshops on Multimedia, 2000, 6pp.
Ross, "Information Fusion in Biometrics, "Proc. Of 3rd Intl Conf. on Audio-and Video-Based Person Authentication, pp. 354-359, Jun. 6-8, 2001.
Ross, "Multimodal Biometrics: An Overview," 12 European Signal Processing Conf., pp. 1221-1224, Sep. 2004.
Santroprene, "Add Value to Your TPEs with Special Effects", not dated, 12 pages.
Scopus and Entrust: Call Center Sales Helper is Unveiled, Nov. 10, 1997; vol. 162, Issue 217, p. 19.
Scopus Introduces World's Most Complete Call Center Solution for Financial Services; PR Newswire dated Nov. 5, 1997.
Seybold Report on desktop Publishing, "Holographic Signatures for Digital Images", Aug., 1995, 1 page.
Sikora, The MPEG-7 Visual Standard for Content Description-An Overview, *IEEE Transactions on Circuits and Systems for Video Technology*, 11(6):696-702 (Jun. 2001).
Spice, "Police use lasers, computers to map scenes Town of Pewaukee's new system boost accuracy of reconstructions, users say" Sep. 29, 1998. Milwaukee Journal Sentinel. P. 2.
Straight Through Processing: Migration Assessment for Series II Clients Computer Sciences Corporation, pp. 6, 2003. (g50).
Supplemental European Search Report dated Jul. 20, 2006, from EP Application No. 02805980 (Corresponding to PCT/US02/41681; Published as WO03/056507).
Szepanski, "A Signal Theoretic Method for Creating Forgery-Proof Documents for Automatic Verification", 1979 Carnahan Conference on Crime Countermeasures, University of Kentucky, Lexington, Kentucky, May 16-18, 1979, pp. 101-109.
Tomaiuolo, "Are Metasearchers Better Searches?" Searcher, Jan. 1999; vol. 7, No. 1, pp. 30-34.
Trademark for @Fault, accessed from uspto.gov on Feb. 8, 2006.
Traynor, "The Effects of Varying Safety Conditions on the External Costs of Driving," Winter, 1994 Eastern Economic Journal, vol. 20 No. 1 pp. 45-60.
U.S. Patent and Trademark Office, "Communication" for U.S. Appl. No. 09/969,027 mailed Jan. 11, 2008.
U.S. Patent and Trademark Office, "Communication" for U.S. Appl. No. 09/969,017 mailed May 9, 2007.
U.S. Patent and Trademark Office, "Communication" for U.S. Appl. No. 09/969,016 mailed May 3, 2007.
U.S. Patent and Trademark Office, "Communication" for U.S. Appl. No. 09/969,534 mailed May 30, 2007.
U.S. Patent and Trademark Office, "Communication" for U.S. Appl. No. 09/969,027 mailed Jun. 20, 2007.
U.S. Patent and Trademark Office, "Communication" for U.S. Appl. No. 10/306,866 mailed Jun. 21, 2007.
U.S. Patent and Trademark Office, "Communication" for U.S. Appl. No. 10/306,858 mailed Jun. 29, 2007.
U.S. Patent and Trademark Office, "Communication" for U.S. Appl. No. 09/969,021 mailed Mar. 8, 2007.
U.S. Patent and Trademark Office, "Communication" for U.S. Appl. No. 09/969,020 mailed Jul. 5, 2007.
U.S. Patent and Trademark Office, "Communication" for U.S. Appl. No. 09/969,018 mailed Jun. 21, 2007.
U.S. Patent and Trademark Office, "Communication" for U.S. Appl. No. 09/969,024 mailed May 23, 2007.
U.S. Patent and Trademark Office, "Communication" for U.S. Appl. No. 10/306,623 mailed Mar. 7, 2007.
U.S. Patent and Trademark Office, "Communication" for U.S. Appl. No. 10/306,873 mailed Sep. 20, 2007.
U.S. Patent and Trademark Office, "Communication" for U.S. Appl. No. 10/306,804 mailed Oct. 3, 2007.
U.S. Patent and Trademark Office, "Communication" for U.S. Appl. No. 10/306,909 mailed Oct. 5, 2007.
U.S. Patent and Trademark Office, "Communication" for U.S. Appl. No. 10/306,803 mailed Oct. 5, 2007.
U.S. Patent and Trademark Office, "Communication" for U.S. Appl. No. 10/306,908 mailed Oct. 4, 2007.
U.S. Patent and Trademark Office, "Communication" for U.S. Appl. No. 10/306,864 mailed Oct. 4, 2007.
U.S. Patent and Trademark Office, "Communication" for U.S. Appl. No. 09/969,545 mailed Oct. 18, 2006.
U.S. Patent and Trademark Office, "Communication" for U.S. Appl. No. 10/306,628 mailed Oct. 10, 2007.
U.S. Patent and Trademark Office, "Communication" for U.S. Appl. No. 09/969,024 mailed Jan. 31, 2008.
U.S. Patent and Trademark Office, "Communication" for U.S. Appl. No. 09/969,024 mailed Jun. 1, 2006.
U.S. Patent and Trademark Office, "Communication" for U.S. Appl. No. 09/969,022 mailed Apr. 6, 2006.
U.S. Patent and Trademark Office, "Communication" for U.S. Appl. No. 09/969,015 mailed Jun. 1, 2006.
U.S. Patent and Trademark Office, "Communication" for U.S. Appl. No. 09/969,019 mailed Jun. 1, 2006.
U.S. Patent and Trademark Office, "Communication" for U.S. Appl. No. 09/969,546 mailed Mar. 21, 2006.
U.S. Patent and Trademark Office, "Communication" for U.S. Appl. No. 09/969,016 mailed Mar. 21, 2006.
U.S. Patent and Trademark Office, "Communication" for U.S. Appl. No. 09/969,018 mailed Jan. 26, 2006.
U.S. Patent and Trademark Office, "Communication" for U.S. Appl. No. 09/969,018 mailed Jun. 2, 2006.
U.S. Patent and Trademark Office, "Communication" for U.S. Appl. No. 09/969,545 mailed Mar. 23, 2008.
U.S. Patent and Trademark Office, "Communication" for U.S. Appl. No. 09/969,536 mailed Mar. 24, 2006.
U.S. Patent and Trademark Office, "Communication" for U.S. Appl. No. 09/969,516 mailed Aug. 10, 2006.
U.S. Patent and Trademark Office, "Communication" for U.S. Appl. No. 09/970,161 mailed Mar. 23, 2006.
U.S. Patent and Trademark Office, "Communication" for U.S. Appl. No. 09/969,021 mailed Feb. 27, 2006.
U.S. Patent and Trademark Office, "Communication" for U.S. Appl. No. 09/969,146 mailed Feb. 28, 2006.
U.S. Patent and Trademark Office, "Communication" for U.S. Appl. No. 09/969,027 mailed Mar. 3, 2006.
U.S. Patent and Trademark Office, "Communication" for U.S. Appl. No. 09/969,018 mailed Dec. 4, 2006.
U.S. Patent and Trademark Office, "Communication" for U.S. Appl. No. 10/306,858 mailed Dec. 13, 2007.
U.S. Patent and Trademark Office, "Communication" for U.S. Appl. No. 10/238,981 mailed Jan. 25, 2008.
U.S. Patent and Trademark Office, "Communication" for U.S. Appl. No. 10/238,029 mailed Dec. 13, 2007.
U.S. Patent and Trademark Office, "Communication" for U.S. Appl. No. 09/969,021 mailed Jan. 8, 2008.
U.S. Patent and Trademark Office, "Communication" for U.S. Appl. No. 10/238,019 mailed Jan. 11, 2008.
U.S. Patent and Trademark Office, "Communication" for U.S. Appl. No. 10/306,623 mailed Jan. 25, 2008.
U.S. Patent and Trademark Office, "Communication" for U.S. Appl. No. 09/969,017 mailed Apr. 16, 2008.
U.S. Patent and Trademark Office, "Communication" for U.S. Appl. No. 09/969,016 mailed Mar. 17, 2008.
U.S. Patent and Trademark Office, "Communication" for U.S. Appl. No. 09/969,534 mailed Apr. 15, 2008.
U.S. Patent and Trademark Office, "Communication" for U.S. Appl. No. 09/969,019 mailed Feb. 27, 2008.
U.S. Patent and Trademark Office, "Communication" for U.S. Appl. No. 09/969,019 mailed Apr. 28, 2008.
U.S. Patent and Trademark Office, "Communication" for U.S. Appl. No. 09/969,146 mailed Sep. 22, 2006.
U.S. Patent and Trademark Office, "Communication" for U.S. Appl. No. 09/969,146 mailed Oct. 5, 2007.
U.S. Patent and Trademark Office, "Communication" for U.S. Appl. No. 10/306,628 mailed Mar. 27, 2008.
U.S. Patent and Trademark Office, "Communication" for U.S. Appl. No. 10/238,029 mailed May 12, 2008.
U.S. Patent and Trademark Office, "Communication" for U.S. Appl. No. 10/306,864 mailed Mar. 27, 2008.
U.S. Patent and Trademark Office, "Communication" for U.S. Appl. No. 10/306,908 mailed Mar. 21, 2008.

U.S. Patent and Trademark Office, "Communication" for U.S. Appl. No. 10/306,866 mailed May 5, 2008.
U.S. Patent and Tradmark Office, "Communication" for U.S. Appl. No. 09/969,534 mailed Feb. 17, 2006.
U.S. Patent and Tradmark Office, "Communication" for U.S. Appl. No. 09/969,017 mailed Mar. 1, 2006.
U.S. Patent and Tradmark Office, "Communication" for U.S. Appl. No. 09/969,017 mailed Oct. 11, 2006.
U.S. Patent and Tradmark Office, "Communication" for U.S. Appl. No. 09/969/017 mailed May 9, 2007.
U.S. Patent and Tradmark Office, "Communication" for U.S. Appl. No. 09/969,534 mailed May 30, 2007.
U.S. Patent and Tradmark Office, "Communication" for U.S. Appl. No. 09/969,516 mailed Nov. 14, 2007.
U.S. Appl. No. 10/836,639, Bi et al., filed Apr. 29, 2004.
U.S. Appl. No. 09/741,779, filed Dec. 21, 2000.
U.S. Appl. No. 60/456,677, filed Mar. 21, 2003.
U.S. Appl. No. 60/459,284, filed Mar. 31, 2003.
U.S. Appl. No. 60/463,659, filed Apr. 16, 2003.
U.S. Appl. No. 60/463,660, filed Mar. 31, 2003.
U.S. Appl. No. 60/488,536, filed Jul. 17, 2003.
U.S. Appl. No. 60/494,660, filed Aug. 8, 2003.
Unisys Selects Identix for Department of Defense Research on Three Dimensional Facial Recognition, Press Release, Jul. 29, 2003, 3 pages.
Utzaeider, James, "Microsoft Transaction Server and Internet Information Server: Technology for the Web," Microsft Corp., pp. 15. Feb. 6, 1998. (f44).
Villegas et al., "An Environment for Efficient Handling of Digital Assets", Proc. of Workshop on Image Analysis for Multimedia Interactive Services, WIAMIS 2003, Apr. 2003, London, 8 pages.
W. Rankl and W. Effing, "Smart Card Hand Book" 1997, John Wiley & Sons, pp. 35-40.
Warland et al., High-Performance Communication Networks, *Economics*, Chapter 8 through 8.2.1:361-369 (1996).
Watt & Policarpo, "The Computer Image", Addison Wesley, pp. 247-249 (1998).
Wayne Electronics, Inc., What is Facelt? Accessed Oct. 10, 2002, 5 pages.
Willems, "Biometrics: Detecting the 'Goats'", Speech Technology Magazine, Oct. 9, 2003, 6 pages.
WO02/052499 search report, dated Aug. 30, 2002.
WO02/052499 Written Opinion, dated Mar. 18, 2004.
Examiner's Report issued by the Canadian Patent Office on Nov. 10, 2009 in Canadian Application 2,482,834.
Abstract of Japanese Unexamined Patent Application Publication No. 03-239595.
Abstract of Japanese Unexamined Patent Application Publication No. 2001-058485.
Notice of Reason for Rejection issued by the Japanese Patent Office Oct. 27, 2009, Japanese Application No. 2004-503267.
Notice of Reasons for Rejection issue by the Japanese Patent Office Nov. 4, 2009, Japanese Patent Application No. 2004-504171.
Supplemental European Search Report dated Nov. 13, 2009.
U.S. Appl. No. 09/287,940, filed Jun. 17, 2003, Rhoads.
U.S. Appl. No. 09/314,648, filed Jan. 20, 2004, Rodriguez et al.
U.S. Appl. No. 09/342,688, filed Nov. 18, 2003, Rodriguez et al.
U.S. Appl. No. 09/342,689, filed Oct. 30, 2001, Rhoads.
U.S. Appl. No. 09/342,971, filed Jun. 29, 1999, Rodriguez.
U.S. Appl. No. 09/343,104, filed Jun. 29, 1999, Rodriguez et al.
U.S. Appl. No. 09/343,101, filed Jun. 29, 1999, Davis et al.
U.S. Appl. No. 09/433,104, filed Oct. 21, 2003, Rhoads at al.
U.S. Appl. No. 09/452,022, filed Oct. 3, 2000, Alattar at al.
U.S. Appl. No. 09/452,023, filed Jun. 18, 2002, Rhoads.
U.S. Appl. No. 09/465,418, filed Dec. 16, 1999, Rhoads et al.
U.S. Appl. No. 09/503,881, filed Sep. 2, 2003, Rhoads et al.
U.S. Appl. No. 09/531,076, filed Mar. 18, 2000, Rhoads at al.
U.S. Appl. No. 09/547,664, filed Apr. 17, 2007, Rhoads at al.
U.S. Appl. No. 09/553084, filed Jul. 8, 2003, Reed at al.
U.S. Appl. No. 09/562,516, filed May 1, 2000, Hannigan.
U.S. Appl. No. 09/562,517, unknown, Davis at al.
U.S. Appl. No. 09/571,442, filed Oct. 22, 2002, Rhoads at al.
U.S. Appl. No. 09/619264, filed Jul. 19, 2000, Kumar.
U.S. Appl. No. 09/629401, filed Feb. 18, 2003, Seder.
U.S. Appl. No. 09/631,409, filed Aug. 3, 2000, Brundage et al.
U.S. Appl. No. 09/679,261, filed Oct. 4, 2000, Davis at al.
U.S. Appl. No. 09/679262, filed Nov. 15, 2005, Rhoads.
U.S. Appl. No. 09/694465, filed Jul. 13, 2004, Rodriguez at al.
U.S. Appl. No. 09/858189, filed Feb. 27, 2007, Rhoads at al.
U.S. Appl. No. 09/923762, filed Aug. 19, 2003, Lofgren.
U.S. Appl. No. 10/094,593, unknown, Hannigan.
U.S. Appl. No. 10/115,582, filed Jun. 28, 2005, Reed, et al.
U.S. Appl. No. 10/115441, filed Oct. 12, 2004, Reed.
U.S. Appl. No. 10/154621, filed Dec. 6, 2005, Miller.
U.S. Appl. No. 10/172769, filed May 2, 2006, Miller at al.
U.S. Appl. No. 10/233,069, filed Aug. 30, 2002, Carr.
U.S. Appl. No. 10/836639, filed Apr. 29, 2004, Daoshen.
U.S. Appl. No. 10/803,538, filed Jan. 6, 2005, LaBrec.
U.S. Appl. No. 10/991,354, filed Jul. 21, 2005, LaBrec.
U.S. Appl. No. 11/082,182, filed Mar. 15, 2005, Hawes.
U.S. Appl. No. 11/613,088, filed Dec. 16, 2006, Bundage.
U.S. Appl. No. 11/020,651, filed Jul. 28, 2005, Jones.
U.S. Appl. No. 11/279,717, filed Apr. 13, 2006, unknown.
U.S. Appl. No. 60/158,015, filed Oct. 6, 1999, Davis et al.
U.S. Appl. No. 60/344,674, filed Dec. 24, 2001, Howard et al.
U.S. Appl. No. 60/344,674, filed Dec. 24, 2001, LaBrec.
U.S. Appl. No. 60/344,675, filed Dec. 24, 2001, LaBrec.
U.S. Appl. No. 60/344,676, filed Dec. 24, 2001, LaBrec.
U.S. Appl. No. 60/344,677, filed Dec. 24, 2001, LaBrec.
U.S. Appl. No. 60/344,682, filed Dec. 24, 2001, Lopolito.
U.S. Appl. No. 60/344,683, filed Dec. 24, 2001, LaBrec.
U.S. Appl. No. 60/344,686, filed Dec. 24, 2001, Jones et al.
U.S. Appl. No. 60/344,687, filed Dec. 24, 2001, Bloomberg et al.
U.S. Appl. No. 60/344,688, filed Dec. 24, 2001, Rice.
U.S. Appl. No. 60/344,698, filed Dec. 24, 2001, Bloomberg.
U.S. Appl. No. 60/344,709, filed Dec. 24, 2001, LaBrec.
U.S. Appl. No. 60/344,710, filed Dec. 24, 2001.
U.S. Appl. No. 60/344,716, filed Dec. 24, 2001, Theodossiou et al.
U.S. Appl. No. 60/344,717, filed Dec. 24, 2001, Regan et al.
U.S. Appl. No. 60/344,719, filed Dec. 24, 2001, Bi et al.
U.S. Appl. No. 60/344,753, filed Dec. 24, 2001, Rice.
U.S. Appl. No. 60/82,228, filed Jul. 4, 2000, Macor.
U.S. Appl. No. 10/027,783, filed Oct. 30, 2007, Brunk et al.
"Best Practices for the Use of Magnetic Stripes," MVIS Magnetic Stripe Working Group, Report to AAMVA, Version 2.0, Apr. 1996, including a history on p. 3.
"Digimarc Information Embedding Technology Frequently Asked Questions", Sep. 1996, http://www.digimarc.com, 19 pages.
"The Copyright Can of Worms Opened Up by the New Electronic Media," Computergram Internations, pCGN0717006, Jul. 17, 1995 and The Copyright Can of Worms Opened Up by the New Electronic Media-2, Computergram Internations, pCGN07210008, Jul. 21, 1995, 3 pages.
"Access Control and Copyright Protection for Images WorkPackage 8: Watermarking " Jun. 30 1995, 46 pages.
"Access Control and Copyright Protection for Images, Conditional Access and Copyright Protection Based on the Use of Trusted Third Parties," 1995, 43 pages.
"Access Control and Copyright Protection for Images, WorkPackage 3: Evaluation of Existing Systems," Apr. 19, 1995, 68 pages.
"Access Control and Copyright Protection for Images, WorkPackage 1: Access Control and Copyright Protection for Images Need Evaluation," Jun. 1995, 21 pages.
"Copyright Protection for Digital Images, Digital Fingerprinting from FBI, "Highwater FBI brochure 1995, 4 pages.
"Cyphertech Systems: Introduces Digital Encoding Device to Prevent TV Piracy," Hollywood Reporter, Oct. 20, 1993, p. 23.
"Foiling Card Forges With Magnetic Noise," Wall Street Journal, Feb. 8, 1994.
"High Water FBI Limited Presentation Image Copyright Protection Software," FBI Ltd. brochure, Jul. 1995, 17 pages.
"Lenticular Prints", <http://www.shortcourses.com/how/lenticular/lentcular.htm>, pp. 1-6 (Dec. 16, 2002).
"NAB-Cyphertech Starts Anti-Piracy Broadcast Tests", Newsbytes, NEW03230023, Mar. 23, 1994.

Alattar, "Smart Images' Using Digimarc's Watermarking Technology," IS&T/SPIE's 12th Int. Symposium on Electronic Imaging, San Jose, CA Jan. 25, 2000. vol. 3971, No. 25, 10 pages.
Amano, "A Feature Calibration Method for Watermarking of Document Images," Proc. 5.sup.th Int. Conf. on Document Analysis and Recognition, Sep. 1999, pp. 91-94.
American Association of Motor Vehicle Administrators: AAMVA National Standard for the Driver License/Identification Card. Copyright 2000.
Arthur, "Digital Fingerprints Protect Artwork," New Scientist, Nov. 12, 1994, p. 24.
Article entitled "Lenticular Prints," 6 printed pages, printed on Dec. 16, 2002 and accessed from http://www.shortcourses.com/how/lenticular/lenticular.htm.
Battialo et al., "Robust Watermarking for Images Based on Color Manipulation," IH/99 LNCS 1768, pp. 302-317, 2000.
Bender et al, "Applications for Data Hiding," IBM Systems Journal, vol. 39, Nos. 3 & 4, 2000, pp. 547-568.
Bloomberg, "Embedding Digital Data on Paper in Iconic Text" SPIE vol. 3027, Document Recognition IV, pp. 67-80 (1997).
Boland et al, "Watermarking Digital Images for Copyright Protection," Fifth International Conference on Image Processing and its Applications, Conference Data Jul. 4-6, 1995, Conf. Publ. No. 410, pp. 326-330.
Boneh, "Collusion-Secure Fingerprinting for Digital Data," Department of Computer Science, Princeton University, 1995, 31 pages.
Bonny Lhotka, Karin Schminke, Dorothy Simpson Krause, "Lenticular Inkjet Printmaking", 2 printed pages, printed on Dec. 16, 2002 and accessed from http://www.dvpratt.com/evesmind/lentOver.htm.
Bors et al., "Image Watermarking Using DCT Domain Constraints," Proc. Int. Conf. on Image Processing, vol. 3, pp. 231-234.
Bovik, "Handbook of Image and Video Processing," Academic Press, 2000, pp. 133-136, 154, 155.
Brassil et al., Electronic Marking and Identification Techniques to Discourage Document Copying, Proceedings of INFOCOM '94 Conference on Computer, IEEE Commun. Soc Conference, Jun. 12-16, 1994, 1278-1287.
Brown, "S-Tools for Windows, Version 1.00, COPYRGT. 1994 Andy Brown, What is Steganography," Internet reference, Mar. 6, 1994, 6 pages.
Brownwell, "Counterfeiters Dye Over Security Measures," SPIE's OE Magazine, Sep. 2001, pp. 8-9.
Caronni, "Assuring Ownership Rights for Digital Images," Published in the Proceedings of 'Reliable It Systems,' vis '95 HH. Bruggemann and W. Gerhardt-Hackl (Ed.), Vieweg Publishing Company, Germany, 1995, Jun. 14, 1994, 10 pages.
Castro et al., "Registration of Translated and Rotated Images Using Finite Fourier Transforms," IEEE Transactions on Pattern Analysis and Machine Intelligence, vol. PAMI-9, No. 5, Sep. 1987, pp. 700-703.
Chakrabarti et al., "Carnival Booth—an Algorithm for Defeating the Computer-Assisted Passenger Screening System", 30. pp (2002).
Choudhury , et al., "Copyright Protection for Electronic Publishing over Computer Networks," IEEE Network Magazine, Jun. 1994, 18 pages.
Chow et al., "Forgery and Tamper-Proof Identification Document", IEEE Proc. 1993 Int. Carnahan Conf. on Security Technology, 11-14 (Oct. 13-15, 1993).
Clarke, "Invisible Code Tags Electronic Images," Electronic Engineering Times, Jun. 12, 1995, n. 852, p. 42.
Collins et al., "Using Bar Code—Why It's Taking Over", Second Edition, Data Capture Institute, 1990 (Contents & Index). (U.S. Appl. No. 10/094,593).
Dautzenberg, "Watermarking Images," Department of Microelectronics and Electrical Engineering, Trinity College Dublin, 47 pages, Oct. 1994.
Dittman, et al., "Hologram Watermarks for Document Authentications," pp. 60-64, Int. Conference on Information Technology: Coding and Computing (ITCC 2001).
European Search Report for European Application No. 03713599.3-1229, mailed on Jul. 23, 2009.
Fitzgerald, "Invisible Digital Copyright ID," Editor & Publisher, Jun. 25, 1994, p. 62.
Fleet et al., "Embedding Invisible Information in Color Images," Proc. Int. Conf. on Image Processing vol. 1, pp. 532-535, Oct. 1997.
Friedman, "The Trustworthy Digital Camera: Restoring Credibility to the Photographic Image," IEEE Transaction on Consumer Electronics, vol. 39, No. 4, Nov. 1993, pp. 905-910.
Grieco, Jr. et al., "Behind Bars—Bar Coding Principles and Applications", PT Publication, Inc., 1989 (Table of Contents & Index) (U.S. Appl. No. 10/094,593).
Hecht, "Embedded Data Glyph Technology for Hardcopy Digital Documents," SPIE vol. 2171, Feb. 1994, pp. 341-352.
Humphrey, "Stamping Out Crime", Hollywood Reporter, Jan. 26, 1994, p. S48.
International Search Report for PCT/US03/05337, mailed Feb. 17, 2004.
Jain, "Image Coding Via a Nearest Neighbors Image Model", IEEE Transactions on Communications, vol. COM-23, No. 3, Mar. 1975, pp. 318-331.
Johnson, et al., "Bridging the Paper and Electronic Worlds: The Paper User Interface", Interchi '93, pp. 507-512, Apr. 1993.
JPEG Group's JPEG Software (release 4), Ftp.Csua.Berekeley.Edu/Pub/Cypherpunks/Applications/Jsteg/Jpeg.Announcement.Gz, Jun. 7, 1993, 2 pages.
Kassam, Signal Detection in Non-Gaussian Noise, Dowden & Culver, 1988, pp. 1-96.
Knox, "Digital Watermarks Using Stochastic Screens," SPIE, vol. 3018, Apr. 1997, pp. 316-322.
Koch, et al., "Towards Robust and Hidden Image Copyright Labeling," Proc. of 1995 IEEE Workshop on Nonlinear Signal and Image Processing, Jun. 20-22, 1995, 4 pages.
Koch, et al., "Copyright Protection for Multimedia Data," Fraunhofer Institute for Computer Graphics, Dec. 16, 1994, 15 pages.
Kohda et al., "Digital Watermarking Through CDMA Channels Using Spread Spectrum Techniques," 2000 IEEE, pp. 671-674.
Kurak et al., "A Cautionary Note on Image Downgrading," 1992 IEEE, pp. 153-159.
Kutter et al., "Digital Signature of Color Images Using Amplitude Modulation," SPIE vol. 3022, 1997, pp. 518-526.
Levy et al., *Plastics Extrusion Technology Handbook*, 354-360 (1989).
Lin et al., "Generating Robust Digital Signature for Image/Video Authentication" Proc. Multimedia and Security Workshop at ACM Multimedia'98, 49-54 (Sep. 1998).
Luc, "Analysis of Spread Spectrum System Parameters for Design of Hidden Transmission," Radioengineering, vol. 4, No. 2, Jun. 1995, pp. 26-29.
Machado, "Announcing Stego 1.0a2, The First Steganography Tool for the Macintosh," Internet reference, Nov. 28, 1993, 3 pages.
Macq, "Cryptology for Digital TV Broadcasting," Proceedings of the IEEE, vol. 83, No. 6, Jun. 1995, pp. 944-957.
Matsui et al., "Embedding a Signature to Pictures Under Wavelet Transformation" Transactions of the Institute of Electronics Information and Communication Engineers D-II, vol. J79D-II, No. 6, 1017-1024 (Jun. 1996).
Matsui et al., "Video-Steganography: How to Secretly Embed a Signature in a Picture," IMA Intellectual Property Project Proceedings, Jan. 1995, vol. 1, Issue 1, pp. 187-205.
Matthews, "When Seeing is Not Believing," New Scientist, Oct. 16, 1993, pp. 13-15.
Mintzer et al., "Safeguarding Digital library Contents and Users" Digital watermarking, D-Lib Magazine, Dec. 1997: ISSN 1082-9873.
Moller, et al., "Rechnergestutzte Steganographie: Wie sie Funktioniert und warum folglich jede Reglementierung von Verschlusselung unsinnig ist," DuD, Datenschutz und Datensicherung, 18/6 (1994) 318-326.
Nakamura et al., "A Unified Coding Method of Dithered Image and Text Data Using Micropatterns," Electronics and Communications in Japan, Part 1, vol. 72, Nov. 4, 1989, pp. 50-56.
Nakamura et al., "A Unified Coding Method of Image and Text Data Using Discrete Orthogonal Transform," Systems and Computers in Japan, vol. 21, No. 3, 1990, pp. 87-92.

Newman, William, et al. "A Desk Supporting Computer-Based Interaction with paper Documents," ACM Conference on Human Factors in Computing Systems (CHI '92) May 3-7, 1992, pp. 587-592.
Oruanaidh et al, "Watermarking Digital Images for Copyright Protection," http://www.kalman.mee.tcd.ie/people/jjr/eva_pap.html, Feb. 2, 1996, 8 pages.
Palmer, "The Bar Code Book", Third Edition, Helmers Publishing, Inc., 1995 (Contents & Index) (10/094,593).
Peairs, "Iconic Paper," Proceedings of the Third International Conference on Document Analysis and Recognition (ICDAR '95), pp. 1174-1179, 1995.
Pennebaker et al., JPEG Still Image Data Compression Standard, Chapter 3, "Aspects of the Human Visual System," pp. 23-27, 1993 Van Nostrand Reinhold, New York.
Pitas et al., "Applying Signatures on Digital Images," IEEE Workshop on Nonlinear and Signal Processing, Neos Marmaras, Greece, pp. 460-463, Jun., 1995.
Piva et al., "Exploiting the Cross-Correlation of RGB-Channels for Robust Watermarking of Color Images," 1999 IEEE, pp. 306-310.
Port, "Halting Highway Robbery on the Internet," Business Week, Oct. 17, 1994, p. 212.
Printed copy of Orasee company web page entitled "Welcome to Orasee Corporation", 2 printed pages, printed on Dec. 13, 2002 and accessed from: http://www.orasee.com/one/main.php3.
Rao, et al. "Protofoil: Storing and Finding the Information Worker's Paper Documents in an Electric File Cabinet," Human Factors in Computing Systems (CHI '94), pp. 180-186, Boston, MA, Apr. 1994.
Rindfrey, "Towards an Equitable System for Access Control and Copyright Protection in Broadcast Image Services: The Equicrypt Approach," Intellectual Property Rights and New Technologies, Proc. of the Conference, R. Oldenbourg Verlag Wien Munchen 1995, 12 pages.
Robert Moran, "3-D Imagery", 3 printed pages, accessed and printed on Dec. 16, 2002 from http://www.flexography.org/flexo/article.cfm?ID=45.
Roberts, "Picture Coding Using Pseudorandom Noise", IRE Trans. On Information Theory, vol. 8, No. 2, Feb. 1962, pp. 145-154.
Sandford II, et al., "The Data Embedding Method," SPIE vol. 2615, Oct. 23, 1995, pp. 226-259.
Sapwater et al., "Electronic Copyright Protection," Photo>Electronic Imaging, vol. 37, No. 6, 1994, pp. 16-21.
Schneier, "Digital Signatures, Cryptographic Algorithms Can Create Nonforeable Signatures for Electronic Documents, Making Them Valid Legal Instruments" BYTE, No. 1993, pp. 309-312.
Schreiber et al., "A Compatible High-Definition Television System Using the Noise-Margin Method of Hiding Enhancement Information, "SMPTE Journal, Dec. 1989, pp. 873-879.
Seybold Report on desktop Publishing, "Holographic Signatures for Digital Images," Aug. 1995, 1 page.
shaggy@phantom.com, "Hide and Seek v. 4.0," Internet reference, Apr. 10, 1994, 3 pages.
Sheng et al., "Experiments on Pattern Recognition Using Invariant Fourier-Mellin Descriptors," Journal of Optical Society of America, vol. 3, No. 6, Jun., 1986, pp. 771-776.
Short, "Steps Toward Unmasking Secure Communications," International Journal of Bifurcation and Chaos, vol. 4, No. 4, 1994, pp. 959-977.
Simmons, "Subliminal Channels; Past and Present," ETT, vol. 5 No. 4, Jul.-Aug. 1994, pp. 45-59.
Szepanski, "Additive Binary Data Transmiision for Video Signals", Papers Presented at Conf. of Comm. Engineering Soc., Sep. 30-Oct. 3, 1980, Technical Reports, vol. 74, pp. 342-352.
Tanaka et al., "A Visual Retrieval System with Private Information for Image Database," Proceeding International Conference on DSP Applications and Technology, Oct. 1991, pp. 415-421. cited by other.
Tanaka et al., "Embedding Secret Information into a Dithered Multi-Level Image," Proc. IEEE Military Comm. Conf., Sep. 1990, pp. 216-220.
Tanaka et al., "New Integrated Coding Schemes for Computer-Aided Facsimile," Proc. IEEE, Int'l Conf. on Sys. Integration, Apr. 1990, pp. 275-281.
Tanaka, "Embedding the Attribute Information Into a Dithered Image," Systems and Computers in Japan, vol. 21, No. 7, 1990, pp. 43-50.
Tirkel et al, "Electronic Water Mark," DICTA-93, Macquarie University, Sydney, Australia, Dec. 1993, pp. 666-673.
Toga et al., "Registration Revisited," Journal of Neuroscience Methods, 48 (1993), pp. 1-13.
U.S. Appl. No. 09/531,076, Rhoads et al., filed Mar. 18, 2000, "System for Linking from Objects to Remote Resources,".
Van Schyndel et al., "A Digital Watermark," IEEE International Conference on Image Processing, Nov. 13-16, 1994, pp. 86-90.
Vidal et al., "Non-Noticeable Information Embedding in Color Images: Marking and Detection," IEEE (1999), pp. 293-297.
Vielhauer, et al., "Approaches to Biometric watermarks for owner auethentification," Security and Watermarking of Multimedia Contents III, Ping Wah Wong, Edward J. Delp III, Editors, Proceedings of SPIE vol. 4314 (vol. 1).
Voyatzis et al., "Embedding Robust Watermarks by Chaotic Mixing," Digital Signal Processing Proceedings, IEEE Jul. 1977, pp. 213-216, vol. 1.
Wagner, "Fingerprinting," 1983 IEEE, pp. 18-22.
Walton, "Image Authentication for a Slippery New Age," Dr. Dobb's Journal, Apr. 1995, pp. 18-26, 82-87.
Wang et al., "Embedding Digital Watermarks in Halftone Screens," Security and Watermarking of Multimedia Contents II, Proc. of SPIE vol. 3971 (2000) pp. 218-227.
Weber et al., "Correlative Image Registration," Seminars in Nuclear Medicine, vol. XXIV, No. 4, Oct. 1994, pp. 311-323.
Whittaker, et al., "Back to the Future: Pen and Paper Technology Supports Complex Group Coordination," CHI '95, Conference on Human Factors in Computing Systems, Denver, Colorado (May 7-11, 1995) (text copy obtained from ACM).
Wise, "The History of Copyright, Photographers' Rights Span Three Centuries", PHOTO>Electronic Imaging, vol. 37, No. 6, 1994.

* cited by examiner

IDENTIFICATION CARD PRINTER-ASSEMBLER FOR OVER THE COUNTER CARD ISSUING

RELATED APPLICATION DATA

This application claims the priority of the following United States Provisional Applications, the contents of which are incorporated herein by reference in their entirety.

- Identification Card Printer-Assembler For Over-The-Counter Card Issuing (Application No. 60/379,646, Inventors: Dennis Mailloux, Daoshen Bi and Robert Jones), filed May 10, 2002; and
- Application of pigmented jet inks to ID cards (Application No. 60/379,704, Inventors Daoshen Bi, Dennis Mailloux, and Robert Jones), filed May 10, 2002.

This application is also related to the following U.S. patent applications:

- Use of Pearlescent and Other Pigments to Create Security Documents (application Ser. No. 09/969,200, issued as U.S. Pat. No. 6,827,277, Inventors Bentley Bloomberg and Robert L. Jones, filed Oct. 2, 2001);
- Identification Card Printed With Jet Inks and Systems and Methods of Making Same (application Ser. No. 10/289,962, published as US 2003-0211296 A1, Inventors Robert Jones, Dennis Mailloux, and Daoshen Bi, filed Nov. 6, 2002);
- Contact Smart Cards Having a Document Core, Contactless Smart Cards Including Multi-Layered Structure, PET-Based Identification Document, and Methods of Making Same (application Ser. No. 10/329,318, issued as U.S. Pat. No. 6,843,422, filed Dec. 23, 2002—Inventors Robert Jones, Joseph Anderson, Daoshen Bi, Thomas Regan, and Dennis Mailloux,);
- Ink with Cohesive Failure and Identification Document Including Same (application Ser. No. 10/329,315, published as US 2003-0226897 A1, filed Dec. 23, 2002—Inventors Robert Jones and Bentley Bloomberg);
- Laser Engraving Methods and Compositions, and Articles Having Laser Engraving Thereon (application Ser. No. 10/326,886, published as US 2003-0234286 A1, filed Dec. 20, 2002—Inventors Brian Labrec and Robert Jones);
- Multiple Image Security Features for Identification Documents and Methods of Making Same (application Ser. No. 10/325,434, issued as U.S. Pat. No. 6,817,530, filed Dec. 18, 2002—Inventors Brian Labrec, Joseph Anderson, Robert Jones, and Danielle Batey);
- Covert Variable Information on Identification Documents and Methods of Making Same (application Ser. No. 10/330,032, published as US 2003-0173406 A1, filed Dec. 24, 2002—Inventors: Robert Jones and Daoshen Bi);
- Systems, Compositions, and Methods for Full Color Laser Engraving of ID Documents (application Ser. No. 10/330,034, published as US 2003-0234292 A1, filed Dec. 24, 2002—Inventor Robert Jones);
- Laser Etched Security Features for Identification Documents and Methods of Making Same (application Ser. No. 10/330,033, published as US 2004-0011874 A1, filed Dec. 24, 2002—Inventors George Theodossiou and Robert Jones); and
- Image Processing Techniques for Printing Identification Cards and Documents (application Ser. No. 10/411,354, published as US 2004-0074973 A1, filed Apr. 9, 2003—Inventors Chuck Duggan and Nelson Schneck).

The present invention is also related to the following provisional applications:

- Identification Document and Related Methods (Application No. 60/421,254, Inventors: Geoff Rhoads, et al);
- Identification Document and Related Methods (Application No. 60/418,762, Inventors: Geoff Rhoads, et al);
- Shadow Reduction System and Related Techniques for Digital Image Capture (Application No. 60/410,544, filed Sep. 13, 2002—Inventors: Scott D. Haigh and Tuan A. Hoang).
- Systems and Methods for Recognition of Individuals Using Combination of Biometric Techniques (Application No. 60/418,129, filed Oct. 11, 2002—Inventors James V. Howard and Francis Frazier);
- Systems and Methods for Managing and Detecting Fraud in Image Databases Used With Identification Documents (Application No. 60/429,501, filed Nov. 26, 2003—Inventors James V. Howard and Francis Frazier);
- Enhanced Shadow Reduction System and Related Technologies for Digital Image Capture (Application No. 60/447,502, filed Feb. 13, 2003—Inventors Scott D. Haigh, Tuan A. Hoang, Charles R. Duggan, David Bohaker, and Leo M. Kenen);
- Integrating and Enhancing Searching of Media Content and Biometric Databases (Application No. 60/451,840, filed Mar. 3, 2003); and
- Optically Variable Devices with Embedded Data for Authentication of Identity Documents (Application No. 60/459,284, filed Mar. 31, 2003—Inventor Robert Jones).

Each of the above U.S. Patent documents is herein incorporated by reference in its entirety. The present invention is also related to U.S. patent application Ser. Nos. 09/747,735, filed Dec. 22, 2000 (published as US 2003-0038174 A1), Ser. No. 09/602,313, filed Jun. 23, 2000 (issued as U.S. Pat. No. 6,752,432), and Ser. No. 10/094,593, filed Mar. 6, 2002, (published as US 2002-0170966 A1), U.S. Provisional Patent Application No. 60/358,321, filed Feb. 19, 2002, as well as U.S. Pat. No. 6,066,594. Each of the above U.S. Patent documents is herein incorporated by reference.

TECHNICAL FIELD

The present invention generally relates to identification and security documents, and in particular, relates to identification document printing and assembly systems and methods.

BACKGROUND

Identification Documents

Identification documents (hereafter "ID documents") play a critical role in today's society. One example of an ID document is an identification card ("ID card"). ID documents are used on a daily basis—to prove identity, to verify age, to access a secure area, to evidence driving privileges, to cash a check, and so on. Airplane passengers are required to show an ID document during check in, security screening, and prior to boarding their flight. In addition, because we live in an ever-evolving cashless society, ID documents are used to make payments, access an ATM, debit an account, or make a payment, etc.

(For the purposes of this disclosure, ID documents are broadly defined herein, and include, e.g., credit cards, bank cards, phone cards, passports, driver's licenses, network access cards, employee badges, debit cards, security cards, visas, immigration documentation, national ID cards, citizenship cards, social security cards, security badges, certificates, identification cards or documents, voter registration cards, police ID cards, border crossing cards, legal instruments, security clearance badges and cards, gun permits, gift certificates or cards, membership cards or badges, etc., etc. Also, the terms "document," "card," "badge" and "documentation" are used interchangeably throughout this patent application.).

Many types of identification cards and documents, such as driving licenses, national or government identification cards, bank cards, credit cards, controlled access cards and smart cards, carry thereon certain items of information which relate to the identity of the bearer. Examples of such information include name, address, birth date, signature and photographic image; the cards or documents may in addition carry other variant data (i.e., data specific to a particular card or document, for example an employee number) and invariant data (i.e., data common to a large number of cards, for example the name of an employer). All of the cards described above will hereinafter be generically referred to as "ID documents".

In the production of images useful in the field of identification documentation, it is oftentimes desirable to embody into a document (such as an ID card, drivers license, passport or the like) data or indicia representative of the document issuer (e.g., an official seal, or the name or mark of a company or educational institution) and data or indicia representative of the document bearer (e.g., a photographic likeness, name or address). Typically, a pattern, logo or other distinctive marking representative of the document issuer will serve as a means of verifying the authenticity, genuineness or valid issuance of the document. A photographic likeness or other data or indicia personal to the bearer will validate the right of access to certain facilities or the prior authorization to engage in commercial transactions and activities.

Identification documents, such as ID cards, having printed background security patterns, designs or logos and identification data personal to the card bearer have been known and are described, for example, in U.S. Pat. No. 3,758,970, issued Sep. 18, 1973 to M. Annenberg; in Great Britain Pat. No. 1,472,581, issued to G. A. O. Gesellschaft Fur Automation Und Organisation mbH, published Mar. 10, 1976; in International Patent Application PCT/GB82/00150, published Nov. 25, 1982 as Publication No. WO 82/04149; in U.S. Pat. No. 4,653,775, issued Mar. 31, 1987 to T. Raphael, et al.; in U.S. Pat. No. 4,738,949, issued Apr. 19, 1988 to G. S. Sethi, et al.; and in U.S. Pat. No. 5,261,987, issued Nov. 16 1993 to J. W. Luening, et al. All of the aforementioned documents are hereby incorporated by reference. Laminated ID documents are used as certificates of citizenship, identification cards, driver's licenses, member cards, passports, transaction cards, national identification cards, etc., etc., etc Printing Information onto ID Documents The advent of commercial apparatus (printers) for producing dye images by thermal transfer has made relatively commonplace the production of color prints from electronic data acquired by a video camera. In general, this is accomplished by the acquisition of digital image information (electronic signals) representative of the red, green and blue content of an original, using color filters or other known means. These signals are then utilized by a printer having a plurality of small heating elements (e.g., pins) for imagewise heating of each of a series of donor sheets (respectively, carrying sublimable cyan, magenta and yellow dye). The donor sheets are brought into contact with an image-receiving element (which can, for example, be a substrate) which has a layer for receiving the dyes transferred imagewise from the donor sheets. Thermal dye transfer methods as aforesaid are known and described, for example, in U.S. Pat. No. 4,621,271, issued Nov. 4, 1986 to S. Brownstein and U.S. Pat. No. 5,024,989, issued Jun. 18, 1991 to Y. H. Chiang, et al. Each of these patents is hereby incorporated by reference.

Dye diffusion thermal transfer printing ("D2T2") and thermal transfer (also referred to as mass transfer printing) are two printing techniques that have been used to print information on identification cards. For example, D2T2 has been used to print images and pictures, and thermal transfer has been used to print text, bar codes, and single color graphics.

D2T2 is a thermal imaging technology that allows for the production of photographic quality images. In D2T2 printing, one or more thermally transferable dyes (e.g., cyan, yellow, and magenta) are transferred from a donor, such as a donor dye sheet or a set of panels (or ribbons) that are coated with a dye (e.g., cyan, magenta, yellow, black, etc.) to a receiver sheet (which could, for example, be part of an ID document) by the localized application of heat or pressure, via a stylus or thermal printhead at a discrete point. When the dyes are transferred to the receiver, the dyes diffuse into the sheet (or ID card substrate), where the dyes will chemically be bound to the substrate or, if provided, to a receptor coating. Typically, printing with successive color panels across the document creates an image in or on the document's surface. D2T2 can result in a very high printing quality, especially because the energy applied to the thermal printhead can vary to vary the dye density in the image pixels formed on the receiver, to produce a continuous tone image. D2T2 can have an increased cost as compared to other methods, however, because of the special dyes needed and the cost of D2T2 ribbons. Also, the quality of D2T2-printed image may depend at least on an ability of a mechanical printer system to accurately spatially register a printing sequence, e.g., yellow, magenta, cyan, and black.

Another thermal imaging technology is thermal or mass transfer printing. With mass transfer printing, a material to be deposited on a receiver (such as carbon black (referred to by the symbol "K")) is provided on a mass transfer donor medium. When localized heat is applied to the mass transfer donor medium, a portion (mass) of the material is physically transferred to the receiver, where it sits "on top of" the receiver. For example, mass transfer printing often is used to print text, bar codes, and monochrome images. Resin black mass transfer has been used to print grayscale pictures using a dithered gray scale, although the image can sometimes look coarser than an image produced using D2T2. However, mass transfer printing can sometimes be faster than D2T2, and faster printing can be desirable in some situations.

Printing of black ("K") can be accomplished using either D2T2 or mass transfer. For example, black monochrome "K" mass transfer ribbons include Kr (which designates a thermal transfer ribbon) and Kd (which designates dye diffusion).

Both D2T2 and thermal ink have been combined in a single ribbon, which is the well-known YMCK (Yellow-Magenta-Cyan-Black) ribbon (the letter "K" is used to designate the color black in the printing industry). Another panel containing a protectant ("P") or laminate (typically a clear panel) also can be added to the YMCK ribbon).

Manufacture and Printing Environments

Commercial systems for issuing ID documents are of two main types, namely so-called "central" issue (CI), and so-called "on-the-spot" or "over-the-counter" (OTC) issue.

CI type ID documents are not immediately provided to the bearer, but are later issued to the bearer from a central location. For example, in one type of CI environment, a bearer reports to a document station where data is collected, the data are forwarded to a central location where the card is produced, and the card is forwarded to the bearer, often by mail. Another illustrative example of a CI assembling process occurs in a setting where a driver passes a driving test, but then receives her license in the mail from a CI facility a short time later. Still another illustrative example of a CI assembling process occurs in a setting where a driver renews her license by mail or over the Internet, then receives a drivers license card through the mail.

In contrast, a CI assembling process is more of a bulk process facility, where many cards are produced in a centralized facility, one after another. (For example, picture a setting where a driver passes a driving test, but then receives her license in the mail from a CI facility a short time later. The CI facility may process thousands of cards in a continuous manner.).

Centrally issued identification documents can be produced from digitally stored information and generally comprise an opaque core material (also referred to as "substrate"), such as paper or plastic, sandwiched between two layers of clear plastic laminate, such as polyester, to protect the aforementioned items of information from wear, exposure to the elements and tampering. The materials used in such CI identification documents can offer the ultimate in durability. In addition, centrally issued digital identification documents generally offer a higher level of security than OTC identification documents because they offer the ability to pre-print the core of the central issue document with security features such as "micro-printing", ultra-violet security features, security indicia and other features currently unique to centrally issued identification documents.

In addition, a CI assembling process can be more of a bulk process facility, in which many cards are produced in a centralized facility, one after another. The CI facility may, for example, process thousands of cards in a continuous manner. Because the processing occurs in bulk, CI can have an increase in efficiency as compared to some OTC processes, especially those OTC processes that run intermittently. Thus, CI processes can sometimes have a lower cost per ID document, if a large volume of ID documents are manufactured.

In contrast to CI identification documents, OTC identification documents are issued immediately to a bearer who is present at a document-issuing station. An OTC assembling process provides an ID document "on-the-spot". (An illustrative example of an OTC assembling process is a Department of Motor Vehicles ("DMV") setting where a driver's license is issued to person, on the spot, after a successful exam.). In some instances, the very nature of the OTC assembling process results in small, sometimes compact, printing and card assemblers for printing the ID document. It will be appreciated that an OTC card issuing process is by its nature can be an intermittent—in comparison to a continuous—process.

OTC identification documents of the types mentioned above can take a number of forms, depending on cost and desired features. Some OTC ID documents comprise highly plasticized poly(vinyl chloride) or have a composite structure with polyester laminated to 0.5-2.0 mil (13-51 .mu.m) poly (vinyl chloride) film, which provides a suitable receiving layer for heat transferable dyes which form a photographic image, together with any variant or invariant data required for the identification of the bearer. These data are subsequently protected to varying degrees by clear, thin (0.125-0.250 mil, 3-6 .mu.m) overlay patches applied at the printhead, holographic hot stamp foils (0.125-0.250 mil 3-6 ..mu.m), or a clear polyester laminate (0.5-10 mil, 13-254 ..mu.m) supporting common security features. These last two types of protective foil or laminate sometimes are applied at a laminating station separate from the printhead. The choice of laminate dictates the degree of durability and security imparted to the system in protecting the image and other data.

As those skilled in the art know, ID documents such as drivers licenses can contain information such as a photographic image, a bar code (which may contain information specific to the person whose image appears in the photographic image, and/or information that is the same from ID document to ID document), variable personal information, such as an address, signature, and/or birthdate, biometric information associated with the person whose image appears in the photographic image (e.g., a fingerprint), a magnetic stripe (which, for example, can be on the a side of the ID document that is opposite the side with the photographic image), and various security features, such as a security pattern (for example, a printed pattern comprising a tightly printed pattern of finely divided printed and unprinted areas in close proximity to each other, such as a fine-line printed security pattern as is used in the printing of banknote paper, stock certificates, and the like).

An exemplary ID document can comprise a core layer (which can be pre-printed), such as a light-colored, opaque material (e.g., TESLIN (available from PPG Industries) or polyvinyl chloride (PVC) material). The core is laminated with a transparent material, such as clear PVC to form a so-called "card blank". Information, such as variable personal information (e.g., photographic information), is printed on the card blank using a method such as Dye Diffusion Thermal Transfer ("D2T2") printing also described in commonly assigned U.S. Pat. No. 6,066,594, which is incorporated herein by reference in its entirety. The information can, for example, comprise an indicium or indicia, such as the invariant or nonvarying information common to a large number of identification documents, for example the name and logo of the organization issuing the documents. The information may be formed by any known process capable of forming the indicium on the specific core material used.

To protect the information that is printed, an additional layer of transparent overlaminate can be coupled to the card blank and printed information, as is known by those skilled in the art. Illustrative examples of usable materials for overlaminates include biaxially oriented polyester or other optically clear durable plastic film.

FIGS. 1 and 2 illustrate a front view and cross-sectional view (taken along the A-A line), respectively, of an exemplary prior art OTC identification document 1. In FIG. 1, the prior art OTC ID document 1 includes a photographic image 2, personal information 3, and a security pattern 4 (for example, a printed pattern comprising a tightly printed pattern of finely divided printed and unprinted areas in close proximity to each other, such as a fine-line printed security pattern as is used in the printing of banknote paper, stock certificates, and the like). If desired, the security pattern 4 can be part of different pattern designs (e.g., filigree, guilloche) and can be printed in different inks (e.g., UV ink).

Referring to FIG. 2, the prior art OTC ID document 1 comprises a pre-printed core 5 (such as, for example, white PVC material) that is, for example, about 30 mil thick. The core 5 is laminated with clear PVC material 6, which, by way of example, is about 1-5 mil thick. The composite of the core 5 and clear PVC material 6 form a so-called "card blank" 7 that can be about 30 mils thick. Information 8 is printed on the card blank 7 using Dye Diffusion Thermal Transfer ("D2T2") printing (which is described further below). To protect the information 8 printed by D2T2 printing, an additional layer of overlaminate 9 is coupled to the card blank 7 and D2T2 printing using, for example, 1 mil of adhesive (not shown).

One type of OTC identification document, available from the assignee of the present invention is a so-called "Desktop Security Card (DSC), which has a core layer (also referred to as "substrate") formed from a sheet of an opaque printable material, such as an opaque sheet of printable silica-filled polyolefin, such as the materials sold commercially by PPG Industries, Inc., Pittsburgh, Pa. under the Registered Trade Mark "TESLIN". In the currently fielded versions of the DSC card, printing of the ID document in OTC environments is achieved with D2T2 printers. Printing quality of the printed image may depend at least on an ability of a mechanical printer system to accurately register a printing sequence, e.g., yellow, magenta, cyan, and black. Commonly assigned U.S. Pat. No. 6,066,594 describes this type of OTC identification document in greater detail, and the contents of this patent are incorporated hereto by reference in their entirety.

SUMMARY

Manufacturing Costs and other Issues

Printing of ID documents in OTC environments is often achieved with D2T2 printers. The ribbons uses with such D2T2 printers can be quite expensive, and the card blanks printed with D2T2 (e.g., PVC or other more expensive card blanks) also can be expensive. Copending and commonly assigned U.S. provisional patent application Ser. No. 60/379,704, entitled Application of pigmented jet inks to ID cards and U.S. nonprovisional patent application Ser. No. 10/289,962, entitled "Identification Card Printed With Jet Inks and Systems and Methods of Making Same" provide information about inventive methods and techniques for using ink jet printing (which can be significantly less expensive than using D2T2 ribbons) to print on blank sheets (e.g., TESLIN sheets) that can then be laminated to protect the printing.

Presently available dye diffusion printing also can be expensive, especially as compared to the cost of presently available inkjet printers. Part of the expense is attributable to a short life span of the dye diffusion ribbons, e.g., the ribbons can only be used for a few prints (sometimes only one print) before they are depleted. This sometimes occurs because the printing of a single card may require a full set of the D2T2 color panels, resulting in a high percentage of unused (and, unfortunately, wasted) imaging materials. These systems also can diffuse dye to expensive PCV or other, more expensive substrates.

Still another important issue with OTC ID documents is their durability. Many ID documents, such as driver's licenses, can be subjected to environmental conditions, such as humidity, water, dirt, and heat that can cause significant damage to the laminate, images, and/or text on the card. Such environmental conditions reduce the useful life of the card, yet issuers often want cards with lifetimes of up to 10 years. Manufacturing ID documents with such long lifetime, using known techniques and materials, adds greatly to the cost of the card.

Yet another issue with OTC manufacturing of ID documents is efficiency. In some environments, the OTC card issuing process can be at times an intermittent process. Intermittent operation of the OTC assembling process sometimes results in waste of the raw materials used to form the ID documents. Wasted raw materials increase the cost per ID card. It is possible, however, that the OTC card assembling process can be continuous, or can have intermittent periods of continuous operation).

Because many issuers of ID documents are often under budgetary pressure to keep the cost of ID documents low, while still maintaining a high quality, durable card, it would be desirable to improve the design and/or manufacture of ID documents to reduce ID document cost while maintaining ID document quality and durability.

We have found that in OTC applications we can achieve excellent printing and durability results by using ink jet printing to print on a substrate sheet. In one embodiment, the substrate street comprises a microporous material, e.g., a TESLIN sheet. (TESLIN is a synthetic material available from PPG Industries, One PPG Place, Pittsburgh, Pa. 15272 U.S.A). The microporous material includes a plurality of voids, and, because of the affinity between the microporous material and the pigments in the ink jet ink, at least a portion of the ink jet ink fills the voids. The ink jet printed substrate is then preferably over laminated with, e.g., polyester laminates and then cut into a typical ID card size (e.g., conforming to an ISO standard). Our inventive methods and systems produce an ID document with superior durability and tamper resistance, yet is a lower cost solution, therefore yielding a superior product at lower cost.

Another aspect of the present invention is to use a so-called carrier web to carry and control the orientation of laminate patches in an ID document lamination process. The carrier web can be of a paper-based material. It will be appreciated that an OTC card issuing process is by its nature an intermittent—in comparison to a continuous—process. While so-called continuous roll laminating provides a fast and efficient method of card lamination in a central issue environment, the same continuous lamination process is not typically compatible with an intermittent process, due to poor material utilization. For example, consider a situation where only one card is produced in a run. Many inches (or even feet) of the roll lamination would be wasted since a subsequent card would not directly follow the first card. The use of a carrier web provides a unique method of using roll lamination in an intermittent card assembly environment with a high laminate yield.

In one implementation of the present invention we perforate the carrier web and/or substrate along a printing and/or laminating machine direction edge to provide a physical registration feature. Our perforation holes (or "form feed holes") can be used to reliably convey materials-and to accurately register multiple card layers (laminate—substrate—laminate) as the layers are combined to make a laminated ID document. In some implementations we place holes along two parallel directional edges of the web or substrate.

In one embodiment, we provide a system to intermittently assemble identification documents, the identification document comprising a substrate with a top surface and a bottom surface, the top and bottom surfaces being laminated, said system comprising a first ink jet printer, a conveyor, a second ink jet printer, a laminator, and a cutter. The first ink jet printer is operable to print first information on a top surface of a substrate sheet, said first ink jet printer including a print tray or input to receive the substrate sheet. The conveyor conveys the once printed substrate sheet from the first ink jet printer. The second ink jet printer receives the once printed substrate sheet from the conveyor, the once printed substrate sheet being conveyed in such a manner so as to position a bottom surface of the substrate sheet to receive second information from the second ink jet printer, the second ink jet printer being operable to print the second information on the bottom surface of the substrate sheet.

The laminator is operable to receive the twice printed substrate sheet and to provide a top laminate in contact with the top surface of the twice printed substrate sheet and a bottom laminate in contact with the bottom surface of the twice printed substrate sheet, the laminator laminating the top laminate to the top surface of the twice printed substrate sheet and laminating the bottom laminate to the bottom surface of the twice printed substrate sheet. The cutter is operable to cut excess material from the laminated, twice printed substrate sheet, the cut, laminated twice printed substrate sheet forming the identification document.

In another embodiment, we provide another system to intermittently assemble identification documents, an identification document comprising a substrate with a top surface and a bottom surface, the top and bottom surfaces being laminated, said system comprising a first ink jet printer, a first conveyor, a second conveyor, and a laminator.

The first ink jet printer is operable to print first information on a top surface of a substrate sheet, said first ink jet printer including an input to receive the substrate sheet and an output from which a printed substrate sheet exits the first ink jet printer. The first conveyor conveys a once printed substrate sheet from the first ink jet printer output back to the first ink jet printer input, the first conveyor conveying the once printed substrate sheet so as to be positioned to receive printed information on a bottom surface of the substrate sheet, the top and bottom substrate surfaces being different surfaces, the first ink jet printer being operable to print second information on the bottom surface of the substrate sheet. The second conveyor conveys a twice-printed substrate sheet from the first ink jet printer output.

The laminator is operable to receive the twice printed substrate sheet and to provide a top laminate in contact with the top surface of the twice printed substrate sheet and a bottom laminate in contact with the bottom surface of the twice printed substrate sheet, the laminator laminating the top laminate to the top surface of the twice printed substrate sheet and laminating the bottom laminate to the bottom surface of the twice printed substrate sheet. The cutter cuts excess material from the laminated, twice printed substrate sheet, the cut, laminated twice printed sheet forming the identification document.

In a further embodiment, we provide a system to intermittently assemble identification documents, an identification document comprising a substrate with a top surface and a bottom surface, the top and bottom surfaces being laminated, said system comprising first and second ink jet printers and a laminator.

The first ink jet printer is operable to print first information on a top surface of a substrate sheet. The second ink jet printer is operable to print second information on a bottom surface of a substrate sheet, the second ink jet printer being constructed and arranged relative to the first ink jet printer such that the substrate sheet can travel along a predetermined path and have its top side printed by the first ink jet printer and its bottom side printed by the second ink jet printer without having to change the orientation of the substrate along the predetermined path. The laminator is operable to receive the twice printed substrate sheet and to provide a top laminate in contact with the top surface of the twice printed substrate sheet and a bottom laminate in contact with the bottom surface of the twice printed substrate sheet, the laminator laminating the top laminate to the top surface of the twice printed substrate sheet and laminating the bottom laminate to the bottom surface of the twice printed substrate sheet, the laminated, twice printed substrate sheet comprising the identification document. In a further embodiment, the first and second ink jet printers are constructed and arranged to print the substrate sheet at substantially the same time.

In still another embodiment, we provide a method of assembling an identification document, the assembled identification document including at least a substrate having a top surface and a bottom surface, the substrate being laminated.

A substrate having printing thereon is provided, the substrate sheet having been perforated or cut so as to include the outline of card. The card is separated from the substrate sheet, the card having a top surface and a bottom surface. A top laminate is provided so as to contact the card's top surface, and bottom laminate is provided so as to contact the card's bottom surface, said top laminate, substrate and bottom laminate forming a card sandwich, said providing laminates steps being preformed at a first station. The card sandwich is heated and pressed to facilitate lamination of the card sandwich at a second station, the second station being separate from the first station. The laminated card sandwich is cooled at a third station, the third station being separate from the first and second stations.

In a further embodiment, we provide a method of assembling an identification document in an intermittent assembling environment. Ink jet printing is controlled so as to print first information on a first surface of the document substrate and to print second information on a second surface of the document substrate, the second information including at least one set of data that is unique with respect to the first information. Lamination of the printed document substrate is controlled so as to provide a top laminate in contact with the first surface of the document substrate and to provide a bottom laminate in contact with the second surface of the document substrate. Alignment of the laminated document substrate is controlled through at least form feed holes placed along at least one of an edge of the document substrate and a carrier web that carries the top or bottom laminate, wherein the alignment relates to at least one of cutting, material registration and the placement of security features on the laminated document substrate.

In yet another embodiment, we provide system to produce an identification document from a substrate having first and second sides and comprising a predetermined material, the system comprising means for printing to the first side of the substrate, said means for printing operable to print the identification document using an ink having an affinity for the predetermined material, means for laminating at least one side of the identification document, and means for transferring the printed substrate to the means for laminating;

The foregoing and other features and advantages of the present invention will be even more readily apparent from the following Detailed Description, which proceeds with reference to the accompanying drawings.

BRIEF DESCRIPTION OF THE DRAWINGS

The drawings are not necessarily to scale, emphasis instead generally being placed upon illustrating the principles of the invention. In addition, in the figures, like numbers refer to like elements.

DETAILED DESCRIPTION

Figure 1:
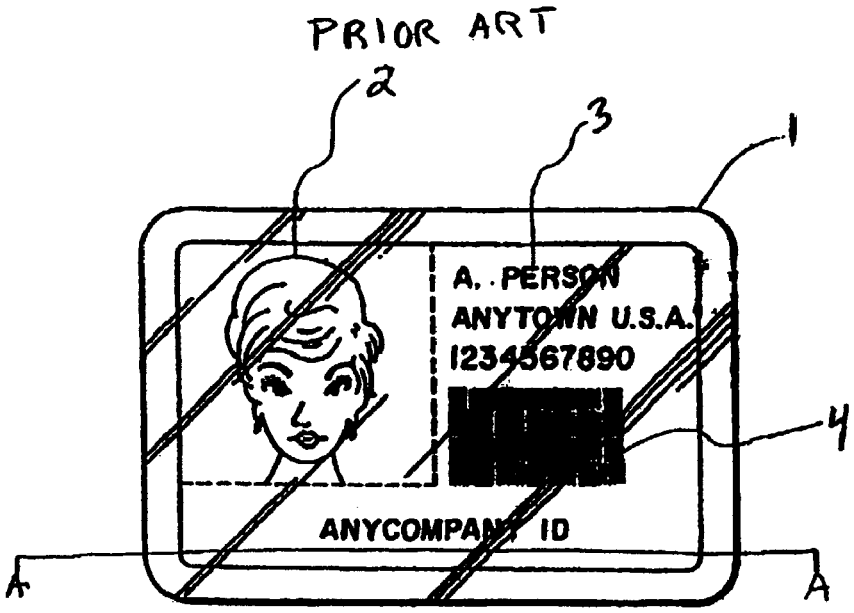
FIG. 1 is an illustrative example of a prior art identification document.

The following detailed description discloses multiple embodiments of our present invention. It should be appreciated that the disclosure found in one embodiment section can be readily combined with the disclosure found in another section.

In the foregoing discussion, the use of the word "card" is intended to include all types of ID documents. (For the purposes of this disclosure, the terms "document," "card," "badge" and "documentation" are used interchangeably. In addition, ID document shall include, without limitation, documents, magnetic disks, CD's, or any other suitable items that may record information, images, and/or other data, which may be associated with an object or other entity to be identified.)

While ink jet printers have been available for some time now, their use in ID card printing has been limited due to several factors. Common dye based inks, as traditionally used in ink jet printers, can lack the stability to resist fading over time or under prolonged exposure to sunlight. In laminated ID cards, it is preferred that ink that is deposited on a substrate (e.g., a TESLIN sheet) not interferes with the bonding of the protective laminates that are often coupled to the substrate. Any interference may defeat security provided by the laminates or long life of the resultant ID document.

The inventors have found that dye-based ink jet inks require a so-called receiving layer (or thin coating) to be applied to the ID document substrate in order to produce a high quality print appearance. Conventional receiving layers have water absorptive characteristics that can weaken the ID card's physical integrity. For example, a card substrate that is treated with a receiving layer absorbs water, particularly at the card's edges. Absorbing water can have disastrous effects—the card can swell or warp, the laminate can peel away, a weakness point can form providing an intrusion entry point, and the printed ink can be blurred or even lost. The inventors of the instant application also have discovered that a receiving layer often weakens the bond between the substrate and laminate.

Another weakness of conventional dye based ink jet inks is the mobility of the inks in the document substrate. Often, after application to a document substrate, dye-based ink jet ink will penetrate through the entire thickness of the substrate, particularly when a receiving layer is not applied to the substrate. Ink mobility has at least two negative results. First, the ink visible on the surface of the document substrate is reduced, leading to a "washed out" image. Second, in a worst-case scenario, ink printed on a front surface of the substrate becomes visible on a back surface of the substrate.

We have discovered that the use of pigmented ink jet inks substantially eliminates or at least significantly reduces most of these issues, making such pigmented ink jet inks suitable for printing information to ID card substrates. The light and aging stability of such pigmented inks are excellent. We have also determined that a receiving layer is not required when printing with these pigmented inks, making laminate bonds to the printed substrate acceptable, while maintaining excellent moisture resistance. The pigment particles exhibit a controlled level of penetration into the substrate, such as a microporous polyethylene-polymer containing materials such as a TESLIN (manufactured by PPG Industries, Inc., of Pittsburgh, Pa.) substrate, producing excellent quality, high-density images, with little to no bleed though to the back surface of the substrate. In particular, the instant inventors have discovered

- The light and aging stability of such pigments inks are excellent.
- A receiving layer is not required when printing a microporous core such as a TESLIN sheet with pigment inks. Microporous core materials such as TESLIN tend to filter pigment particles out of pigmented ink leaving, in some instances, the vast majority of the ink's pigment close to the surface. Some penetration into the pores of the TESLIN does appear to occur, which aids in locking the pigment to the substrate. However, the pigmented ink penetration has been observed to be slight in comparison to traditional dye inks. The resulting bond strength of the laminate to the microporous material is excellent, and appears to be substantially unaffected by moisture.
- Since the level of penetration of the pigment into the substrate can be limited, bleed through from a front surface to a back surface of the substrate has not been observed.
- Attempts at delamination can result in showing obvious evidence that tampering has occurred. For example, if laminate is removed from a TESLIN-based substrate printed with pigmented ink jet inks, either he TESLIN can fracture cohesively (down the thickness of the material) or the ink fractures cohesively (most ink staying with the laminate and the remainder with the TESLIN) or a combination of these two modes. These failure modes make alteration quite obvious, photo replacement or data changing very difficult, and relamination impossible without adding an adhesive layer.

We believe that our use of pigmented ink jet inks also may have application in central issue manufacturing of ID documents as well as over the counter manufacturing of ID documents, especially in situations where the resolution of ink jet printers surpasses that of laser printers used to print on TESLIN for the purpose of making ID cards. More details about our inventive use of pigmented inks can be found in our commonly assigned U.S. patent application Ser. No. 10/289,962, published as US 2002-0211296 A1, entitled "Identification Card Printed with Jet Inks and Systems and Methods of Making Same", the contents of which are incorporated herein by reference.

Figure 3:
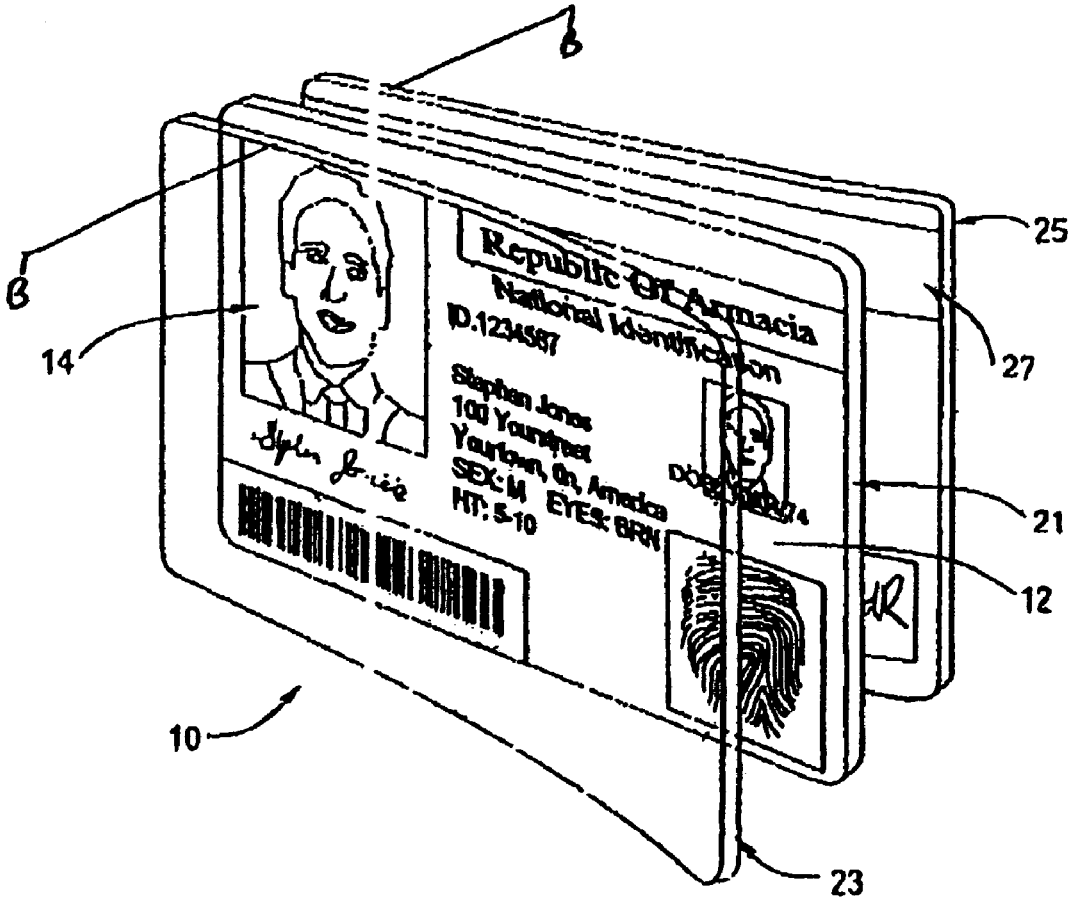
FIG. 3 is an illustrative example of an identification document in accordance with an embodiment of the invention.

FIG. 3 is an illustrative example of an ID document 10 manufactured in accordance with one embodiment of the invention, The ID document 10 includes substrate 21 (which for illustrative purposes only is illustrated as having a "card-like" shape) and the ID document 10 optionally can be sealed between first and second laminate layers 23, 25 (it should be understood that the ID document 10 also may be sealed with only one laminate layer (either the first layer 23 or the second layer 25), and also may be sealed with a plurality of laminate layers.

Although not required for the instant invention, the ID document 10 may include a photograph 14 and various printed information 12, e.g., such as data, textual information, graphics, bar codes, biometric information (e.g., fingerprint), personal information (e.g., name, address, etc.), or the like. At least a portion of the photograph and/or printed information 12 is printed on the substrate 21 with ink jet ink printing. In at least one embodiment, both sides of substrate 21 can receive printing, such as ink jet color printing or ink jet black and white printing. In some embodiments, information may also be optically or magnetically stored on recording media (e.g., magnetic stripe 27) carried by one or both of the laminates 23, 25.

Heat and/or adhesive are used to bond the laminate sheets 23 and 25 with the substrate 21. The adhesive can even be coated or provided on a substrate-engaging side of the laminates 23 and 25. Or a laminate can include a pouch into which the substrate 21 slips. Again, heat and/or adhesives would be used to bond the substrate 21 with the pouch laminate. Hence, our preferred finished ID document includes at least a three-layer structure (e.g., laminate—substrate—laminate). The lamination provides a protective covering for the printed substrates and provides a level of protection against unauthorized tampering. (For example, a laminate would have to be removed to alter the printed information and then subsequently replaced after the alteration.). Various lamination processes are disclosed in assignee's U.S. Pat. Nos. 5,783,024, 6,007,660 and 6,159,327. Other lamination processes are disclosed, e.g., in U.S. Pat. Nos. 6,283,188 and 6,003,581. Each of these U.S. Patents is herein incorporated by reference. Our present disclosure provides improvements over these lamination techniques.

Any or all of the printed information and/or images on the substrate may also include one or more built in security features, as well, to help reduce identity fraud. For example, in one embodiment of the invention, portions of the ID document 10, such as an image or a bar code, can include a digital watermark. Digital watermarking is a process for modifying physical or electronic media to embed a machine-readable code therein. The media may be modified such that the embedded code is imperceptible or nearly imperceptible to the user, yet may be detected through an automated detection process. The code may be embedded, e.g., in a photograph, text, graphic, image, substrate or laminate texture, and/or a background pattern or tint of the photo-identification document. The code can even be conveyed through ultraviolet or infrared inks and dyes.

Digital watermarking systems typically have two primary components: an encoder that embeds the digital watermark in a host media signal, and a decoder that detects and reads the embedded digital watermark from a signal suspected of containing a digital watermark. The encoder embeds a digital watermark by altering a host media signal. To illustrate, if the host media signal includes a photograph, the digital watermark can be embedded in the photograph, and the embedded photograph can be printed on a photo-identification document. The decoding component analyzes a suspect signal to detect whether a digital watermark is present. In applications where the digital watermark encodes information (e.g., a unique identifier), the decoding component extracts this information from the detected digital watermark.

Several particular digital watermarking techniques have been developed. The reader is presumed to be familiar with the literature in this field. Particular techniques for embedding and detecting imperceptible watermarks in media are detailed, e.g., in Digimarc's co-pending U.S. patent application Ser. No. 09/503,881 (issued as U.S. Pat. No. 6,614,914) and U.S. patent application Ser. No. 6,122,403. Techniques for embedding digital watermarks in identification documents are even further detailed, e.g., in Digimarc's co-pending U.S. patent application Ser. No. 10/094,593, filed Mar. 6, 2002 (published as US 2002-0170966 A1), and Ser. No. 10/170,223, filed Jun. 10, 2002 (published as US 2003-0031340 A1), co-pending U.S. Provisional Patent Application No. 60/358,321, filed Feb. 19, 2002, and U.S. Pat. No. 5,841,886. Each of the above-mentioned U.S. Patent documents is herein incorporated by reference.

Embodiment 1—Process for Ink Jet Printing an Identification Document

Figure 4:
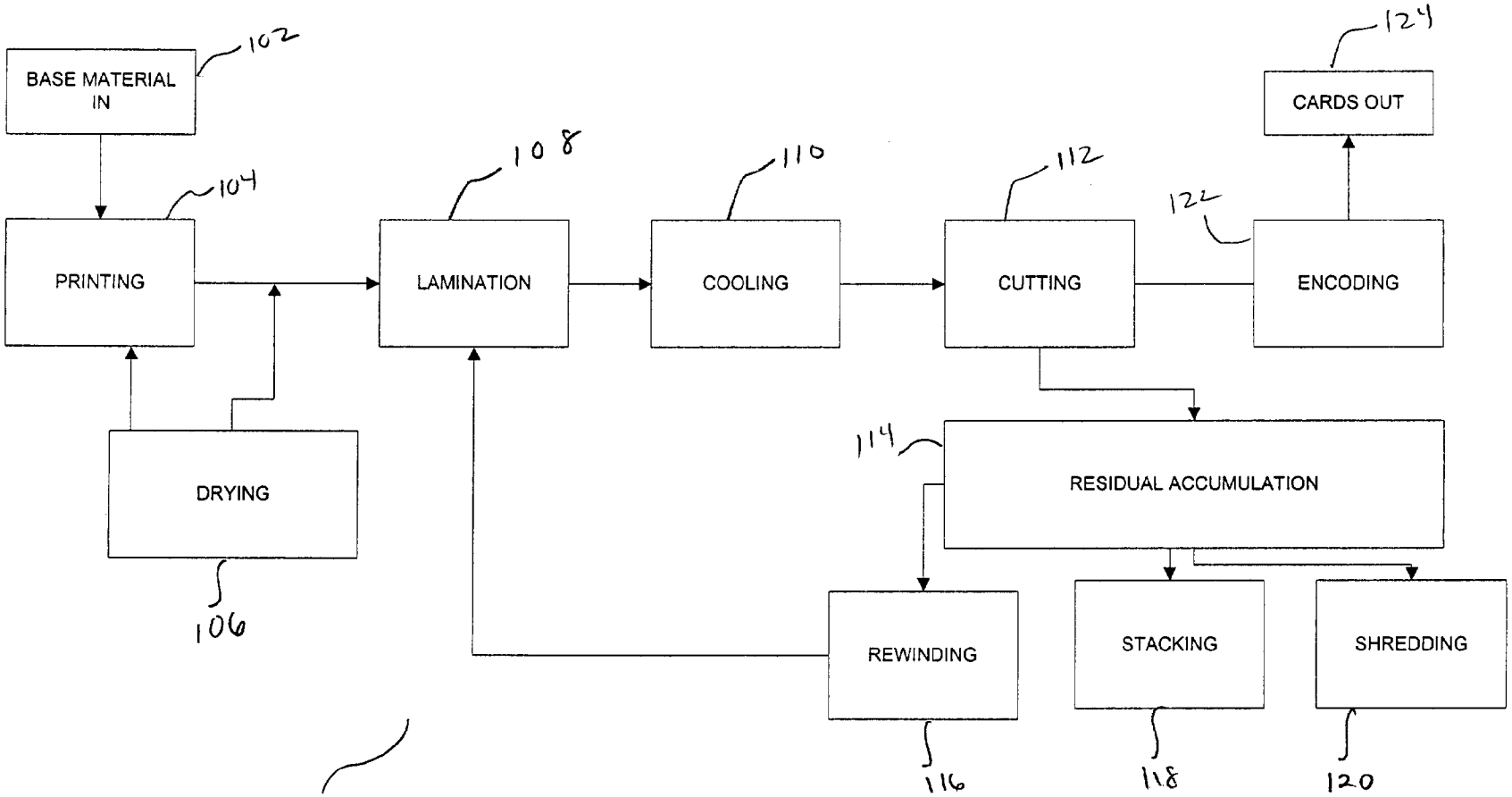
FIG. 4 is a flow diagram of the processes in an over-the-counter ID document assembling system in accordance with one embodiment of the invention.

FIG. 4 is a flow diagram of the general processes included in an over-the-counter ID document assembling system 100 in accordance with one embodiment of the invention. This general process is applicable to at least some of the other embodiments of the invention described herein and is provided to give the reader a general overview of the processes, systems, apparatuses, and techniques to be further described herein. Any or all of the following processes can be controlled manually, using hardware, using software, or using any combination of two or more of these.

Base material is provided for printing (steps 102, 104). The base material provided depends at least in part on the type of printer used. In one embodiment, the printing is accomplished using one or more inkjet-type printers and the base material is a material capable of being inkjet printed. In one embodiment, the printing is accomplished using one or more inkjet type printers that are supplied with a given pigmented ink jet ink and the base material is a material that has an affinity for the given pigmented ink jet ink. As those skilled in the art will appreciate, suitable ink jet printers are available from many different vendors, such as Hewlett Packard (3000 Hanover Street, Palo Alto, Calif. 94304), Epson (including, for example, the Epson Photo 2000P model) (3840 Kilroy Airport Way Long Beach, Calif. 90806), Canon U.S.A., Inc. (One Canon Plaza, Lake Success, N.Y. 11042) and Lexmark (740 West New Circle Road, Lexington, Ky. 40550).

As an optional step, during and/or after printing of the base material, the base material can be dried (step 108), using, for example, an air dryer, heat lamp, or other drying device. Such forced drying advantageously can help to harden the ink printed onto the base material, speeding up the card manufacture and helping the printing to withstand rough handling (e.g., conveyors) between printing passes. Forced drying also can help to reduce bubbles and other problems that can occur during lamination, to help reduce such defects the final cards. If time permits, the drying of step 108 also can be accomplished by waiting or delaying the passage of the base material a predetermined amount of time necessary for the ink jet printing to dry. Those skilled in the art will appreciate that combinations of forced drying and time delays also can be used to accomplish drying.

Laminating step 106 can be accomplished using virtually any lamination system known in the art, including systems of heated rollers, pouches, patches of laminate applied directly to base material, platen lamination, carrier supported lamination, manual lamination, etc. Depending on the type of lamination used, during cooling (step 110) of the laminated base material, additional pressure can be applied to the laminated base material (such as a series of rollers and/or one or more plates) to help to keep the laminate flat during cooling.

Cutting of the laminated base material (step 112) can be accomplished in many different ways, depending on the type of base material and the configuration of the processes. For example, in at least some embodiments of the invention, base materials (as further described herein) are provided on carrier webs and are then laminated (including by methods such as patch lamination), such that the laminated base materials can be punched out, torn off, peeled away, or otherwise removed from the carrier web during cutting. For laminations accomplished using methods such as injection molding, cutting step 112 can encompass removing the injected molded base material from the mold. Depending on the particular lamination technique used, varying types and amounts of scrap material may result, and is accumulated by a residual accumulation (114) as discussed immediately below. For roll-type laminations, scrap material can be rewound (step 116) and later re-used. For platen and carrier supported laminations, scrap material can be accumulated as stacks or piles (step 118) and/or can be shredded (step 120). Shredding can be advantageous where the scrap may contain proprietary material (e.g., covert logs contained on the laminate material).

If the laminated base material has portions to be encoded (e.g., a magnetic stripe or bar code) (step 122), that can be done following cutting step (112). Of course, it will be appreciated that steps 112 and 122 can, of course, be reversed, especially in systems where orientation and registration of the base material can be controlled. After encoding, the laminated base material can be output as ID documents (step 124).

Embodiment 2—Dual Ink jet Printing Process

This embodiment provides an inventive over-the-counter ("OTC") ID document printing system and related methods. As a general overview, and with reference to FIG. 5, our inventive OTC system 200 preferably includes two ink jet printers 202 and 204 (e.g., such as those manufactured by HP, Epson, Canon and Lexmark) a roll type laminator 205, cooler 214, pulling rollers 216, and a cutter 218. Although not illustrated in FIG. 5, those skilled in the art will appreciate that the system 200 of FIG. 5 can include mechanisms to power and drive the illustrated elements, such as a motor(s) and drive assembly to drive the rollers, etc. In at least one embodiment, the above components cooperate with a controller (not shown) to facilitate the smooth transition of a substrate through our inventive assembling system. The controller can be a software module executing on general-purpose processing circuitry. Or the controller can alternatively be implemented with hardware controls or hardware/software controls. The controller may even cooperate with various system sensors. Control also can be completely or partially manual.

A substrate sheet 219 (made of a material capable of being reliably printed with ink from the ink jet printer,) is provided to the first ink jet printer 202 with for printing. In at least one embodiment, the ink jet printers are supplied with a pigmented ink jet ink and the substrate sheet is a sheet of TESLIN, where the TESLIN does not require a receiver layer because the ink jet ink has been pre-selected to have an affinity for the TESLIN material. In at least one embodiment, however, the TESLIN can be pre-coated with a receiver layer and the ink jet ink need not be specially pre-selected for the TESLIN.

Our ID document substrate is formed from the substrate sheet. The sheet is preferably somewhat larger than the size of a finished card. This over-sizing allows extra material to help, e.g., transport the sheet through system. This extra substrate material can be later trimmed to achieve a specified size. (Of course, the substrate sheet can be sized to a finished card as well.). The substrate sheet is placed in a sheet feeder 202*a* of the first ink jet printer 202. The first ink jet printer 202 prints desired printing (e.g., variable information, photographs, bar codes, graphics, etc.) to a first side of the substrate sheet.

The substrate sheet 219 is conveyed along a path 203 into a feed tray 204*a* of the second ink jet printer 204 preferably in a manner that presents a second side of the sheet to the second ink jet printer 204. (For example, path 203 is "C" shaped to present a second side of the sheet to the second ink jet printer's print head.). Path 203 can be achieved with a belt, roller system and/or vacuum, etc., as will be appreciated by those skilled in the art The second ink jet printer 204 applies desired printing to the second side of the sheet. The printed sheet is then conveyed from the second ink jet printer 204 to a laminator 205.

Laminator 205 preferably includes a laminate supply 212, guide rollers 210, preheating rollers 208, and laminator rollers 206. (We note that in an alternative implementation, laminator 205 includes a subset of these components, such as only laminator rollers 206, or preheating rollers 208 and laminator rollers 206.). Although laminator 205 is shown as including the cooler 214, the cooler 214 need not be part of the laminator and can, in fact, be a separate item. Likewise, of course, any of the elements shown in FIG. 5 can be implemented individually and/or be provided as a combined element. For example, the printers 202, 204 could be combined as a single double sided printer, or can be combined with a laminator in a single housing, etc. The laminator 205 provides protective laminate layers for the substrate. In one embodiment, the laminator activates adhesive on the laminate web and then, using pressure between the laminator's nip rolls 206, press the laminates onto both sides of the printed substrate.

A common lamination material includes polycarbonate or polyester. Most frequently, such laminates include an adhesive layer or coating, such as EVA, EVA blends, etc. The laminator 205 receives laminate in the form of continuous webs from upper laminate supply 212*a* and lower laminate supply 212*b*. The laminate webs are fed from the supplies 212*a* and 212*b* via guide rolls 210*a* and 210*b*, respectively. The laminate webs are preheated with upper and lower preheating rollers 208*a* and 208*b*. An adhesive side of the laminate preferably faces (and contacts) the preheating rollers 208. The preheating rollers 208*a* and 208*b* heat their respective laminates so as to bring the temperature of the laminate adhesive slightly below an activation temperature (around 170° F.) of the adhesive (e.g., between about 5-20° F. below the activation temperature). The preheating temperature is preferably such that the laminate material (e.g., amorphous polyester) does not soften to a point where it would unduly stretch from the preheating rollers 208 to the laminator roller 206. Laminator rolls 206*a* and 206*b* provide heat to activate the laminate adhesive, and press the upper and lower laminate onto respective upper and lower sides of the printed substrate sheet. In one implementation the laminator rollers 206 raise the laminate temperature from the activation temperature to about 230-240° F. In another implementation, we maintain our preheating rollers 208 between 150-180° F., and our laminator rollers 206 between 250-330° F. Since the speed of lamination is proportional to the lamination temperature (e.g., hotter is faster), in some implementations we raise the laminator rolls 206 above 330° F.

(It should be understood that, to simplify the discussion we have taken some liberty with the use of the term "roller" and "roll." Conventionally the term "roller" is used to specifically imply a metal or anodized metal surface, while the term "roll" is used to specifically imply a rubber coated roll that fits over or otherwise surrounds the metal roller. Such distinctions are not critical to the understanding of the present invention. Accordingly we use the terms roller and roll interchangeable herein.).

The laminated substrate sheet is provided to the cooler 214. In one embodiment, the cooler 214 includes a plurality of cooling rollers 215 to keep the laminates flat while cooling. In an alternative cooler 214 implementation (not shown) we provide flat heat sinks (instead of rollers) to contact the laminate surfaces. Those skilled in the art will appreciate that other ways of cooling the substrate sheet (e.g., immersion in a substance capable of cooling the laminate, directing cool air at the laminate, etc.) can be usable to cool the laminated substrate sheet.

The cooled, laminated substrate sheet is provided to the cutter 218. A die set actuator 221 can be provided to aid the cutter 218. We note that a pair of pull rollers 216 can be provided and selectively activated to pull the continuous laminate web through the laminator 205 and cooler 214. Once the laminated substrate sheet is positioned within the cutter 218, the pull rollers 216 are deactivated, which stops the laminate web motion. The cutter 218 is cycled, cutting a card-shape ID document out of the laminated web. The resulting ID document is ejected from the cutter 218 onto, e.g., a conveyor to exit the card from system 200.

Since the printing and laminating/cutting processes are independent, it is possible to start printing another ID document while the laminating/cutting operations are processing a previous card. The laminating/cutting process duration is generally shorter than the printing process time; hence, the total cycle time after the first card can be reduced to the printing cycle time.

Figure 5:
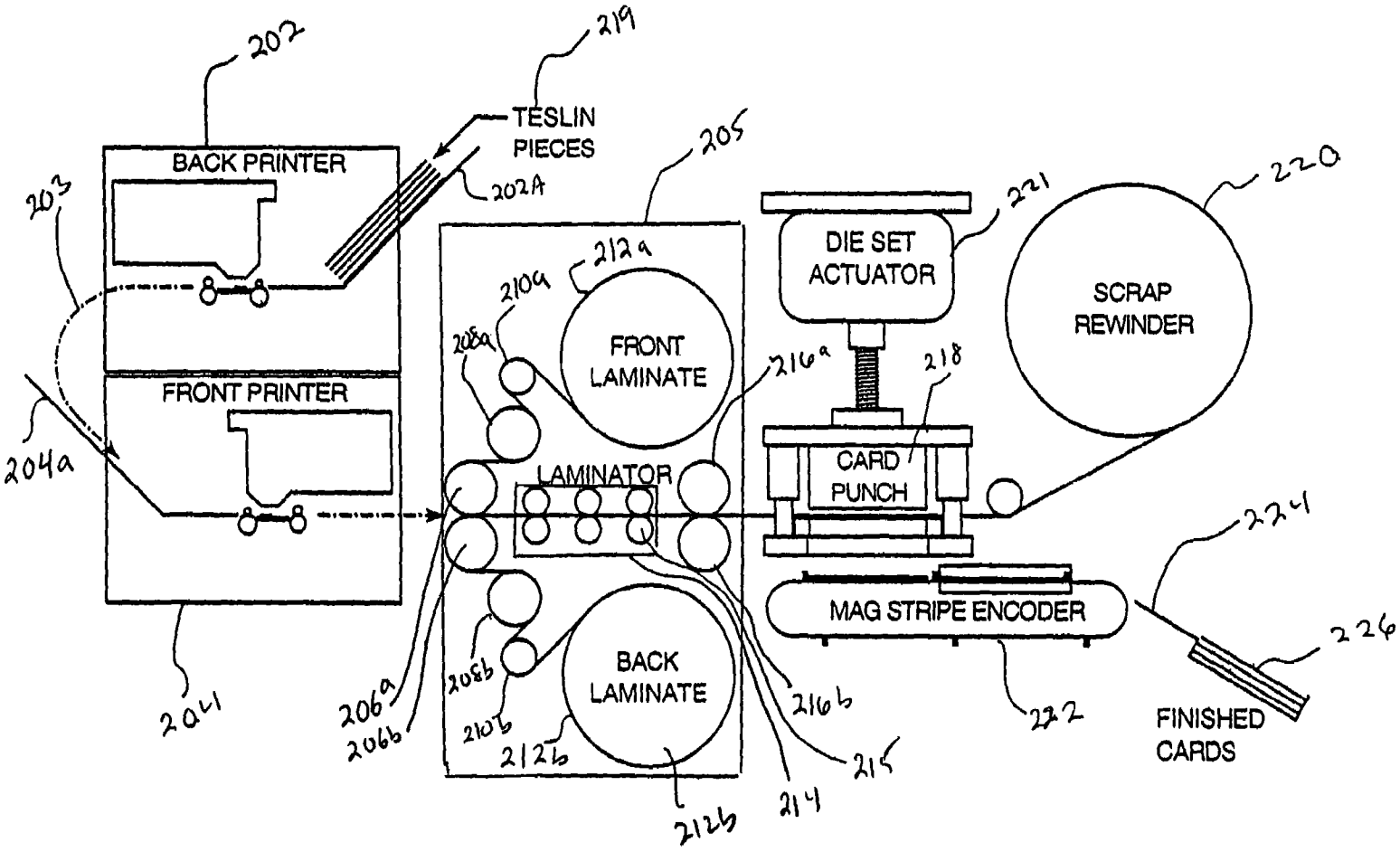
FIG. 5 is a diagram of an over-the-counter ID document assembling system including a first example of a dual ink jet printer implementation, in accordance with one embodiment of the invention.

In at least one embodiment, the system of FIG. 5 includes additional components such as a magnetic stripe encoder (writer) 222 for when the laminate (or substrate) includes a magnetic stripe suitable for carrying data. The magnetic stripe encoder 222 encodes (or writes) data within the magnetic strip. MagTek, Inc. in Carson, Calif. 90746 USA, provides suitable magnetic stripe technology, among other companies. The encoded data can be related to the printed information, or can include information such as biometric information, personal information, access permissions, privileges, etc.

In at least one embodiment, the system of FIG. 5 includes a residual material accumulator 220 to accumulate scrap or residual web laminate. For example, the residual material accumulator 220 can be a scrap rewinder, as shown in FIG. 5. The accumulator 220 may include or cooperate with a residual rewinder to rewind residual web laminate. A conveyer belt or other ejection mechanism 224 can be provided to eject the card from the system 200 onto a finished card collector 226. Alternatively, accumulator 220 includes a shredder. An advantage of a shedder is that it reduces the size of residual materials, and destroys any residual security features that remain on the accumulated materials.

One or more dryers (not shown in FIG. 5) can be added to the system 200 to dry the printed substrate after and/or during printing. For example a dryer can be positioned along the 203 path and/or along a path 204*b* from the second printer 204 to the laminator 205. While a dryer may include radiant heating or the like, we prefer a forced hot air dryer. Forced drying has at least two advantages. First, forced drying produces "hardening" of the ink so that it can withstand rough handling between printing passes. Second, the drying of the sheet after final printing (e.g., after printing by the second printer 204) may also be useful in preventing moisture bubbles. Moisture bubbles occur during lamination and often produce visual defects in a finished card. In one embodiment, air drying for a predetermined time (such as by delaying the substrate along the path 203 and/or the path between the front printer 204 and the laminator 205) can be used in place of forced drying.

Figure 6:
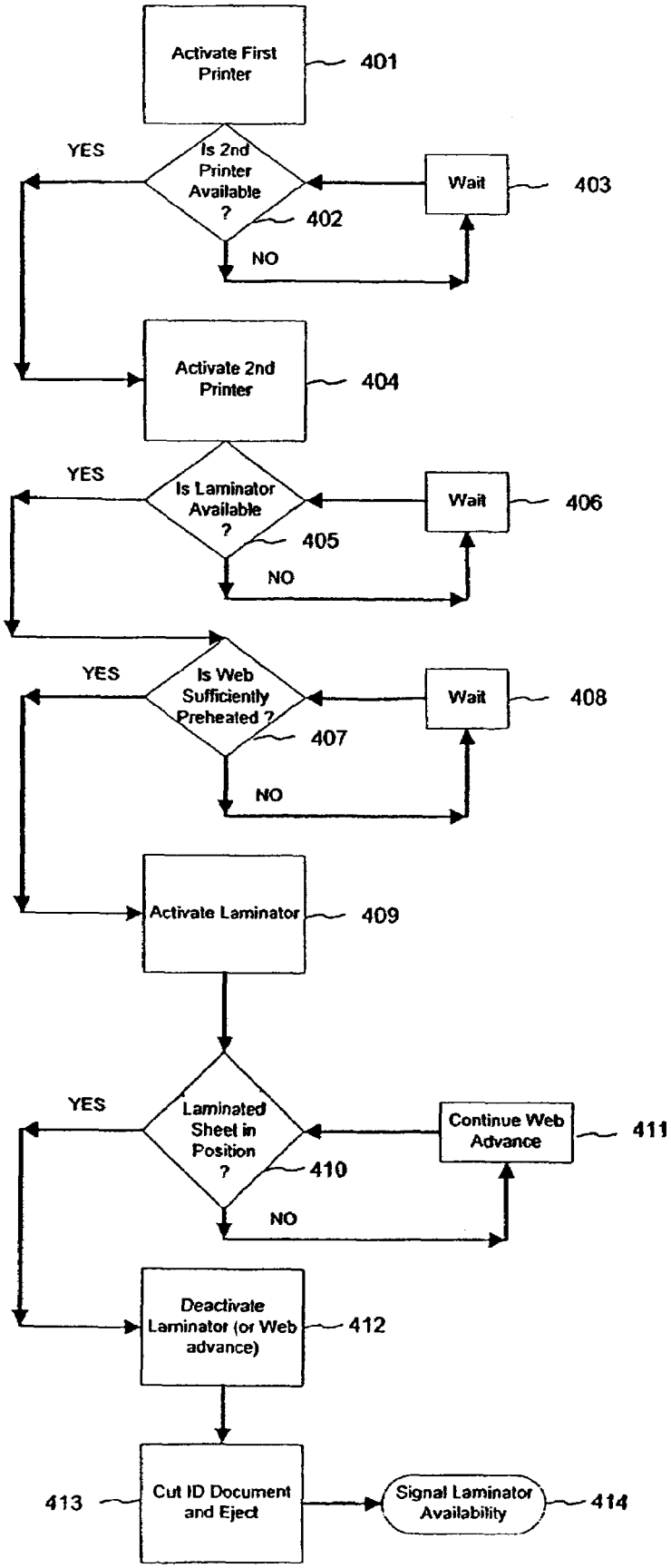
FIG. 6 is a flow diagram outlining one control process according to an implementation of the present invention.

With reference to FIG. 6 we provide an overview of one implementation of a system controller. The FIG. 6 implementation is ideally suited for a multi-card printing process. We also note that the illustrated control process need not continue to completion before a second iteration of the control process of initiated. The first printer is activated in step 401. The printer can be activated by an activation signal from the controller, or upon an indication that a substrate sheet is positioned within the feed tray. We note that the activation step may include receiving in the first printer print data to be printed on the substrate sheet. After (or during) printing of the first side of the sheet, it is determined whether the second printer is available (step 402). (We note that this step can be eliminated when printing a single card.). If not available, the process waits (403) until the second printer becomes available. The second printer may not be available for a number of reasons, including waiting on the laminator or die cutter, printing another sheet, etc.

The second printer is activated (404) when it becomes available. After (or during) printing of the second side of the sheet, the controller determines whether the laminator is available (405). The laminator may not be available for a number of reasons, including the processing of a preceding card, waiting for the lamination web to be heated, waiting for cooling, etc. As an optional step, it can be determined whether the web is sufficiently heated (steps 407 and 408). The process preferably waits (406) if the laminator is not available.

If available, the laminator is activated (409). Activating the laminator may include a number of steps, such as pulling the laminate web, e.g., with the pull rollers, heating rollers if needed, accounting for cooling time if needed, etc. The laminate web is pulled until it is determined whether the laminated sheet is positioned in the cutter (step 410 and 411), at which point the laminator is deactivated (412). The laminated sheet is cut into an ID card and is ejected from the system (413). After cutting (or after ejection) the controller can generate a signal (414) to indicate that the laminator is available. The signal can be used, e.g., as input at step 405.

We note that there are many variations of the FIG. 6 control process. For example, the process can be segmented into various control sections, such as a printing section and a lamination/cutting section. The control of each section can be separately handled. Or if precise timing of the printing and lamination sections is determined, the control process can be simplified. In the simplified implementation, the control process may start printing and then simply check whether the laminator is available prior to advancing a printed sheet to the laminator. In still other implementations, the controller relies on signals from the printers, laminator, cooler, sensors and/or cutter to regulate the advancement of a substrate (or substrates) through the system. Of course, other control process can be implemented to control the FIG. 2 system 200.

Embodiment 3—Dual Ink jet Printing Process with Alternate Printer Configurations While the FIG. 5 embodiment (and various alternative embodiments related to FIG. 5) describe a first ink jet printer positioned directly over, and positioned in an opposite direction of, a second ink jet printer, the present invention is not so limited.

For example, the printers 202 and 204 can be arranged one above the other, but both facing in the same direction and positioned on opposite sides of a substrate sheet such that the first printer prints one side of the sheet, and the sheet travels in a straight path into the second printer where the other side of the sheet is printed. Since the second printer is positioned "upside down," the ink droplets travel horizontally (or vertically, depending on printer positioning) to the sheet without the normal assistance of gravity. Our experiments reveal satisfactory printing under such upside down printing conditions.

Figure 7:
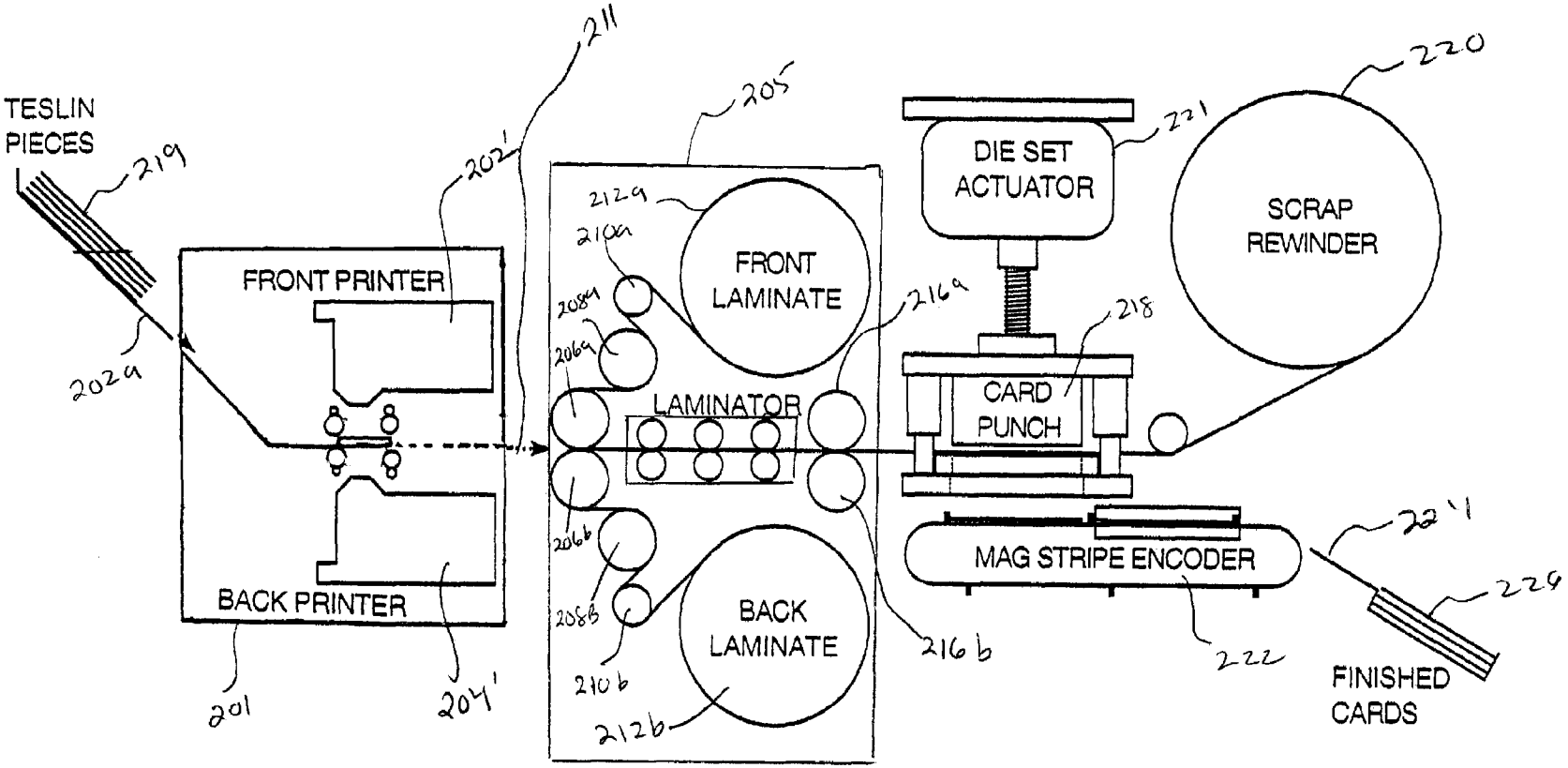
FIG. 7 is a diagram of an over-the-counter ID document assembling system including a second example of a dual ink jet printer implementation, in accordance with one embodiment of the invention.

Another implementation, shown in FIG. 7, prints both substrate sides at substantially the same time. Referring to FIG. 7, an ink jet printer 201 is configured with two print heads 202', 204', each to respectively perform printing on a respective side of a substrate. A substrate is printed as it travels between the two print heads. Since the print cycle time is a major time factor in an ID document manufacture, and since a dual print head configuration significantly reduces the overall size of the processing unit, a simultaneous or substantially simultaneous printing configuration is an attractive embodiment. Although not shown in FIG. 7, a one or more dryers could be positioned along path 211 to dry one or more sides of the substrate. The dryer or dryers can, of course, be configured to dry both sides of the substrate at the same time.

Embodiment 4—Dual Ink Jet Printing Process with Alternate Laminator

In this embodiment, platen lamination is used in alternative embodiments instead of a roll laminator 205 describe in the previous systems. A platen lamination process basically involves placing a platen (e.g., metal, glass or ceramic surface) in contact with a laminate to impart heat and/or pressure, so as to activate the laminate adhesives. Some laminates (e.g., amorphous polyester laminates) soften during a lamination process, and as a result the laminate may take on a finish of the laminating or cooling surfaces (e.g., rollers or platen).

So-called gloss finish platens can be provided to provide a smooth or glossy laminate finish. Alternatively, a belt with release properties that allows release from a cooled belt can be used as an interleaf between the card and platen. In order to prevent air entrapment between the gloss finish platen (or gloss finish belt) and the laminate, a matte finish can be provided on the outer surfaces of the laminates.

Platen lamination is not understood to have been heretofore used for over-the-counter (OTC) ID card lamination because of the large-sized hardware and complexity in comparison to a roll type laminator; however, we have found that platen lamination offers some unique capabilities that offset these drawbacks. For example, materials that have poor dimensional stability at lamination temperatures can often be processed only in platen presses where both heating and cooling occurs while the materials are under pressure and constrained from unwanted dimensional or physical changes. The heating and cooling steps can be carried out in one or more stations. When carried out in only one station, the hardware size is smaller, but the platens must cycle between the heating temperature and the cooling temperature, which can result in longer cycle times. When carried out in two stations, the hardware size increases but the cycle time decreases because the platens in each station are maintained at the proper processing temperature. A platen embodiment is later below.

Embodiment 5—Single Ink Jet Printing Process

Figure 8:
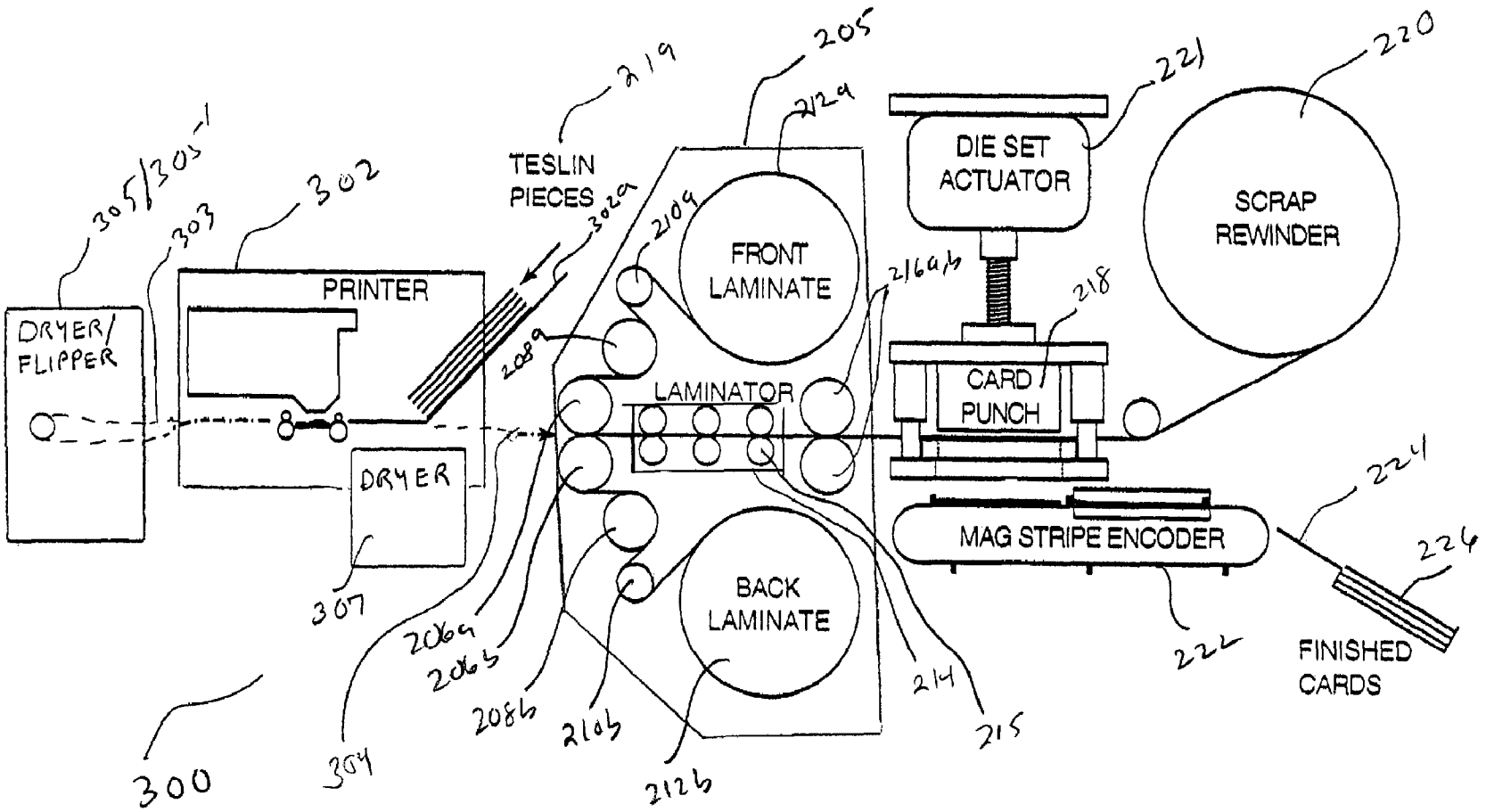
FIG. 8 is a diagram of an over-the-counter ID document assembling system including a single ink jet printer implementation; in accordance with one embodiment of the invention

The FIG. 5 embodiment can be modified to include a single printer system 300, instead of the dual printer system 200, as shown in FIG. 8. A single ink jet printer 302 is used to print both sides of an ID document substrate. A substrate sheet 219 (e.g., a TESLIN sheet) is placed in print tray 302*a*. Printer 302 prints a first side of the sheet. A first sheet conveyor 303 (e.g., a conveyor belt, guide rollers, vacuum, or etc.) is provided to return the printed sheet 219 to the print tray 302*a*. The first sheet conveyor 303 preferably returns the printed sheet 219 to the print tray 302 in an orientation that allows printing of a second side of the substrate sheet by printer 302. Optionally, the system 300 can include a dryer 305 to dry the first printed side of the substrate 219 along the path 303. Optionally, the system 300 can include a dryer 305' to dry the other printed substrate along the path 304. Optionally, a dryer 305' can be configured to dry both sides of the substrate simultaneously along the path 304 (not shown in FIG. 8). Optionally, the system 300 can include a "flipper" 305', which can assist the first sheet conveyor 303 in returning the printed sheet 219 in an orientation that allows printing of a second side of the substrate by printer 202 by automatically turning the substrate 219 over. Such "flipping" can, of course, also be accommodated manually.

Referring again to FIG. 8, a second sheet conveyor 304 then conveys the laminated sheet to laminator 205. We note that like components including the same functionally are labeled with the same reference numbers in FIGS. 2 and 3.

Of course a controller (not shown) can be used with system 300 to control the printing and conveyance of the substrate sheet and of the lamination and cutting of the printed sheet.

The dryer 305 (not shown) can be added to the system 300 to dry the printed substrate after printing. For example a dryer can be positioned along the 303 and/or 304 paths. Dryer advantages are discussed above with respect to FIG. 5.

One advantage of system 300 over system 200 is that one printer 302 accomplishes the work of two printers 202 and 204—saving hardware cost and size. We note that system 300 does not experience a significant increase in printing time over system 200 since system 200 sequentially prints the front and back of a substrate sheet.

Embodiment 6—Ink Jet Printing with Carrier Supported Laminates

We note that a substrate sheet is typically much shorter than the assembling path that the laminate web travels (e.g., referring to FIG. 5, starting at the guide rollers 210*a* and 210*b*, past the preheating rollers 208*a* and 208*b*, through the pressure (or "nip") rolls 206*a* and 206*b*, cooler 214, through the pull roller 216 to the cutter 218). Thus the amount of laminate that is consumed in processing one substrate sheet is often 4 or 5 times the amount of substrate used, resulting in a laminate design yield of no more than 20% to 25%. We can improve the yield with our following inventive techniques.

Any or all of the systems of FIGS. 4-8 are modified to reduce the amount of laminate required to manufacture an ID document by using patches or discrete card-sized sheets of laminate. The laminate patches are bonded to or otherwise carried by a carrier web. We space the laminate patches along the carrier web such that the carrier web—and not laminate—spans the majority of the assembling path. This configuration significantly raises the laminate yield, while reducing overall costs.

Figure 9:
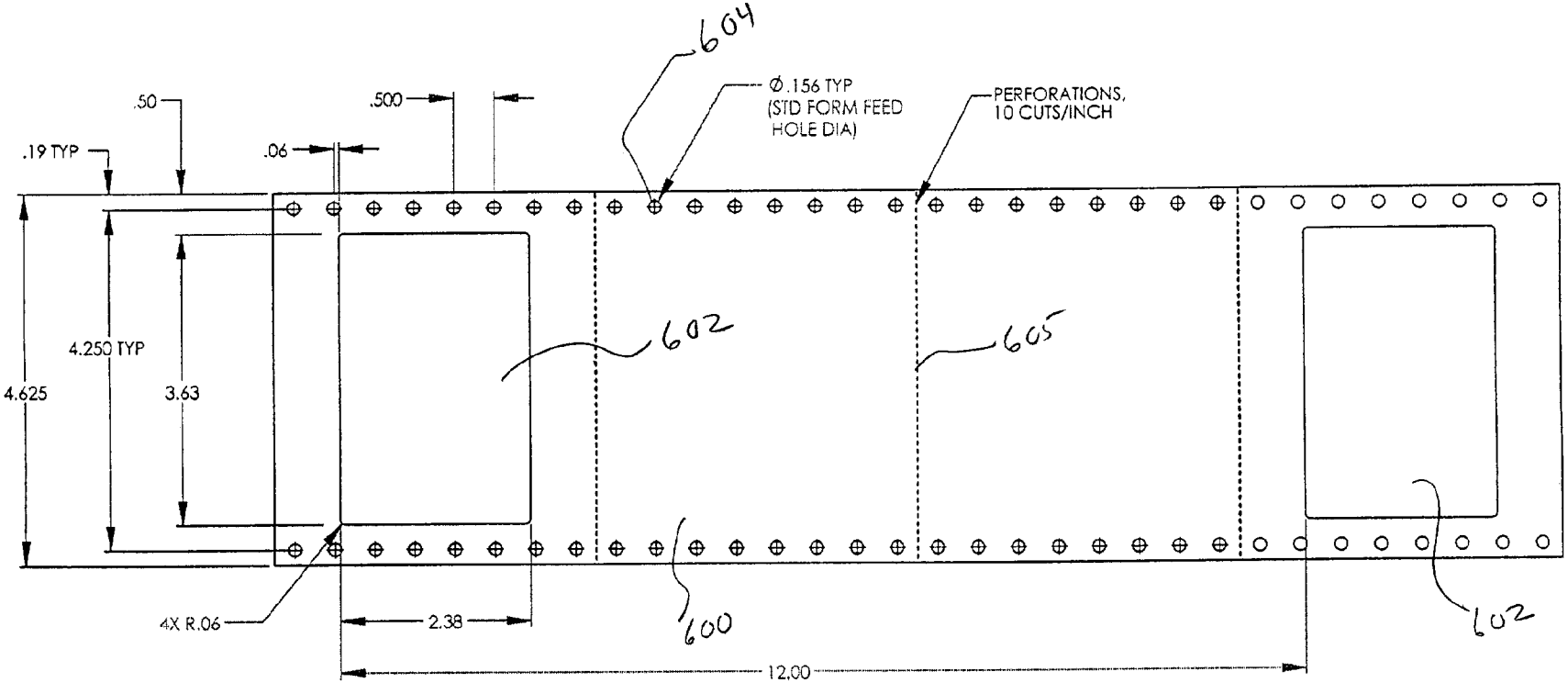
FIG. 9 is an illustration of a carrier web usable with at least one embodiment of the invention.
Figure 10:
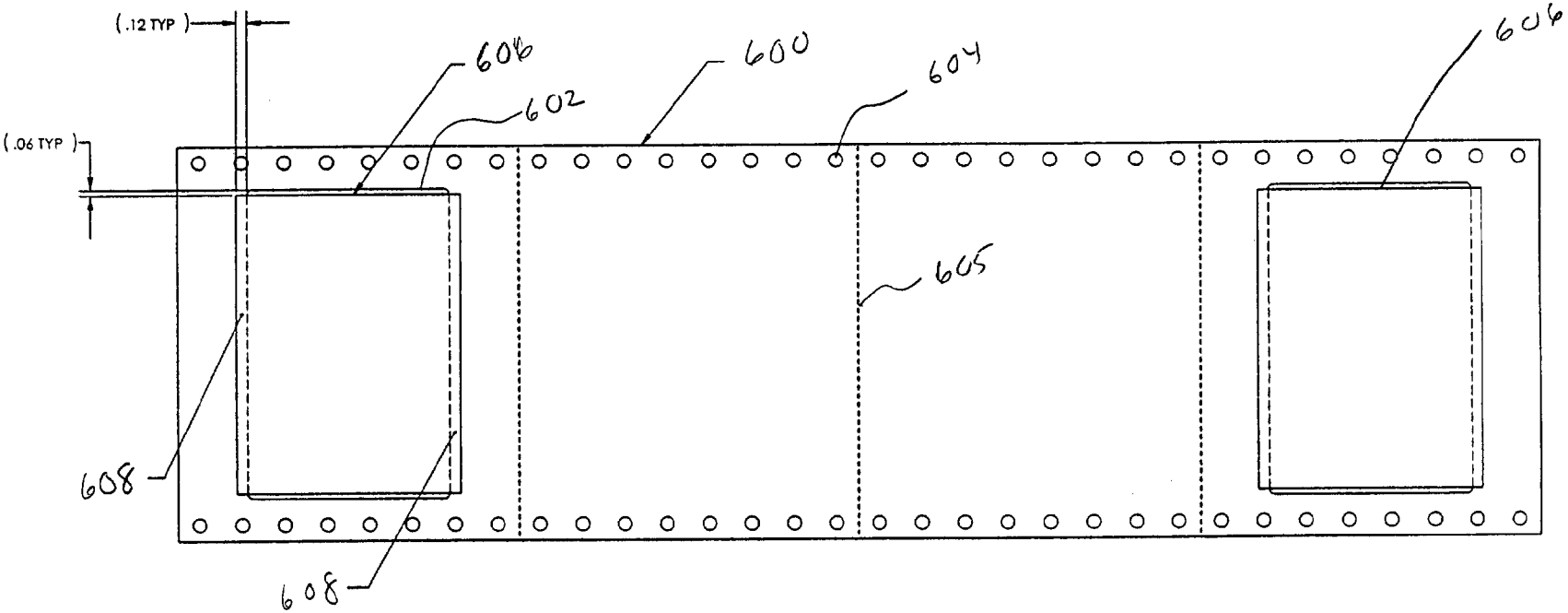
FIG. 10 is an illustration showing laminate patches on the carrier web of FIG. 9.

FIG. 9 is an illustration of a carrier web 600 usable with at least one embodiment of the invention, and FIG. 10 is an illustration showing laminate patches on the carrier web 600 of FIG. 9 (it should be understood that in FIGS. 9 and 10, the dimensions shown are not limiting and provided by way of illustration only). Referring to FIGS. 9 and 10, the carrier 600 preferably has "windows" 602 throughout the web (e.g., with no carrier material in the windows). In one Embodiment, the carrier 600 is made from 2 mil liner paper. In this example, the carrier web 600 is constructed for use in form feeding (as described further herein) and includes a plurality of form feed holes 604, but the invention does not, of course, require that the carrier web 600 be used in a form feeding type environment. The laminate patches 606 are bonded to the carrier web 600 at (or over) these carrier windows 602. In one embodiment, one or more heat seals 608 bond the laminate patches 606 to the carrier web 600. The windows 602 help prevent carrier material from being introduced into a final ID) card. Referring again to FIG. 5, the laminate patches 606 (and carrier windows 602) can be spaced so as to enter the laminator 205 (e.g., enter the preheating rollers 208*a* and 208*b* or laminator rollers 206*a* and 206*b*) when a previous laminate patch is in the cutter 218.

(In one implementation, by way of example, the laminate patch is about ¼ inch larger in all four directions than the substrate sheet. This over-sizing allows a buffer for, e.g., sufficient laminate overlap, extra material to be handled by the rollers, cutting imprecision, and even a so-called "dead zone," if desired, to buffer the lamination roller 206 from riding up over the laminate on the carrier web.).

Figure 2:
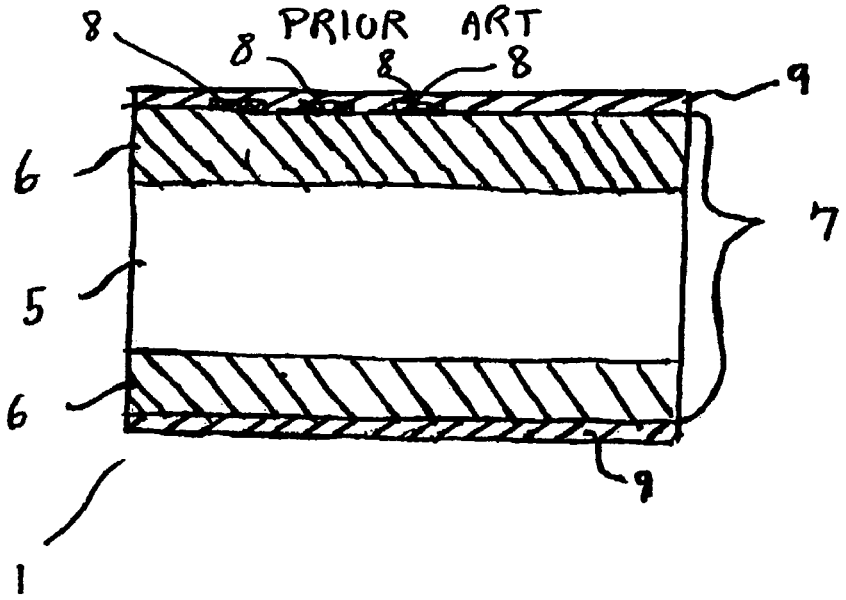
FIG. 2 is a cross section of the prior art identification document of FIG. 1, taken along the A-A line.

We note that the carrier web 600, including the bonded or carried laminate patches 606 over the carrier web windows, can be introduced to the laminator 205 in roll form (e.g., replacing the laminate web supply 212*a* and 212*b* shown in FIGS. 2 and 3). As an alternative, the carrier web is feed through a guide roller (e.g., rollers 210*a* and 210*b*) from a box or other source of fan-folded laminate patches on carrier web. In this alternative implementation, the source of fan-folded laminate patches 606 on carrier web 600 replaces the upper and lower laminate supply 212*a* and 212*b*.

Figure 11:
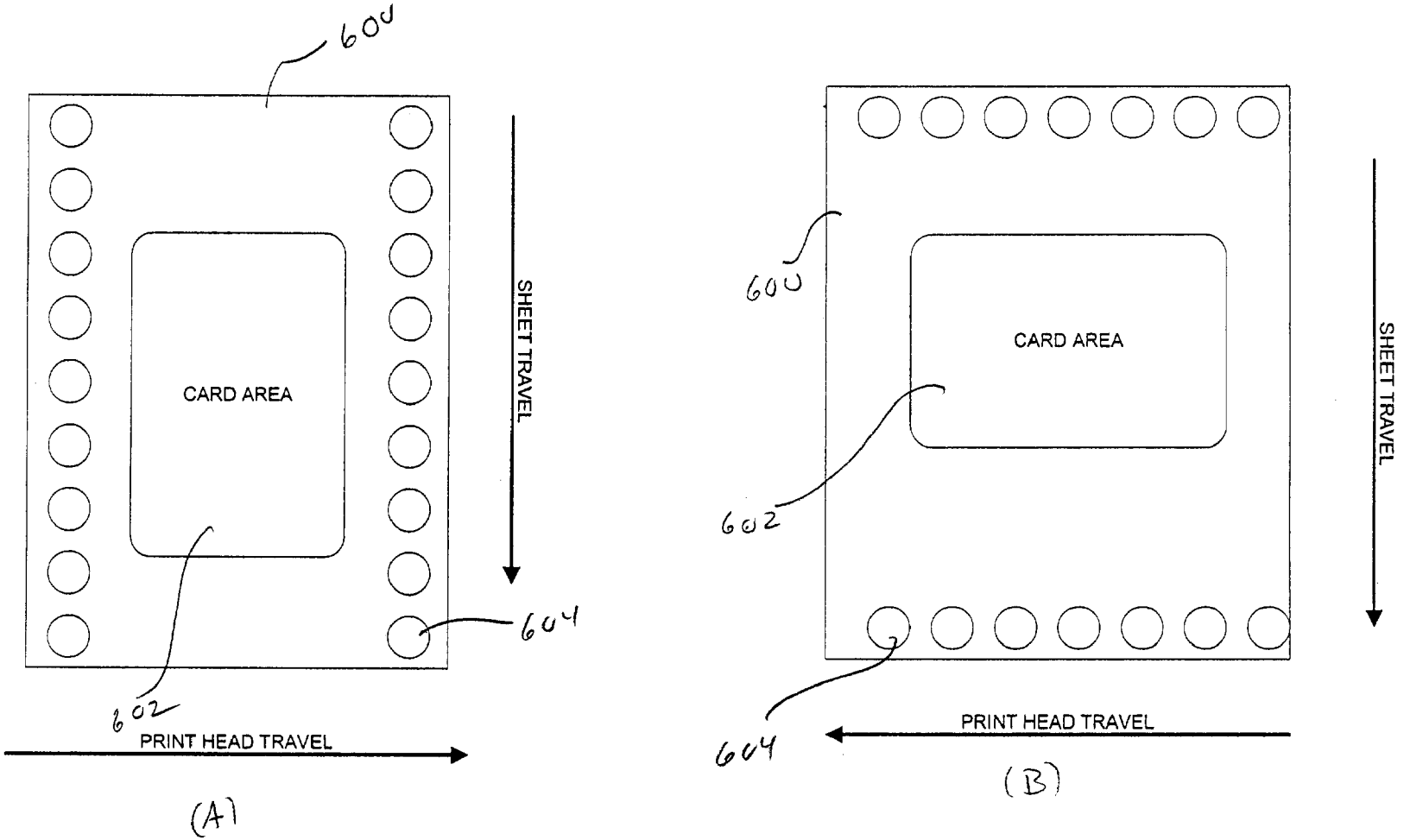
FIGS. 11A-11B are illustrative examples of sheet and print directions for first and second travel orientations, in accordance with embodiments of the invention.

The orientation of the card and laminate patches 606 is not limited to that illustrated in FIGS. 9 an 10. FIGS. 11A-11B are illustrative examples of sheet and print directions for first and second travel orientations, in accordance with embodiments of the invention. For the example of ID documents having a substantially rectangular shape, the windows 602 can be oriented on the carrier web 600 such that the long axis of the ID document travels in the machine direction (long orientation, FIG. 11A) or such that the short axis of the card travels in the machine direction (short orientation, FIG. 11B).

In the long orientation, the sheet moves through the printer so that the axis of the long dimension of the ID document runs parallel to the direction of travel of the sheet. The printhead therefore traverses the short dimension of the ID document making many short traverses to print the ID document. In the short orientation, the axis of the short dimension of the ID document runs parallel to the direction of travel of the sheet. The printhead therefore traverses the long dimension of the card and is required to make fewer but longer distance traverses in printing the card.

During experimentation with an Epson Photo 2000P printer, we found that the time required to print the front of a sheet was 69 seconds with the long orientation sheet where the print head makes many short traverses and 45 seconds with the short orientation sheet where the print head makes fewer but longer traverses. When set at the high quality print setting, the long orientation sheet required 134 seconds to print the front of the card, and the short orientation required 93 seconds.

Several other advantages result from our carrier web improvements, in addition to improving laminate yield.

First, between card cycles, in the processes illustrated by FIGS. 4-8, the thermoplastic laminate is in contact with heated rollers (e.g., preheating rollers 208 and/or laminator rollers 206). Such heated roller contact may require that the roller temperature be reduced between cycles and then reset when a next assembling cycle begins. With a carrier web laminate system, however, the carrier is in contact with the laminator rolls between card cycles instead of the laminate material. The carrier web can be tailored to withstand various temperatures. For example, paper-based carrier webs are relatively inexpensive and more temperature resistant than the laminates at laminating temperatures.

Second, a paper-based carrier web is dimensionally stable at the laminating temperatures and pressures. Hence the carrier web provides support for the thermoplastic laminate, which looses dimensional stability (e.g., the laminate softens and stretches) during the lamination process.

Figure 12:
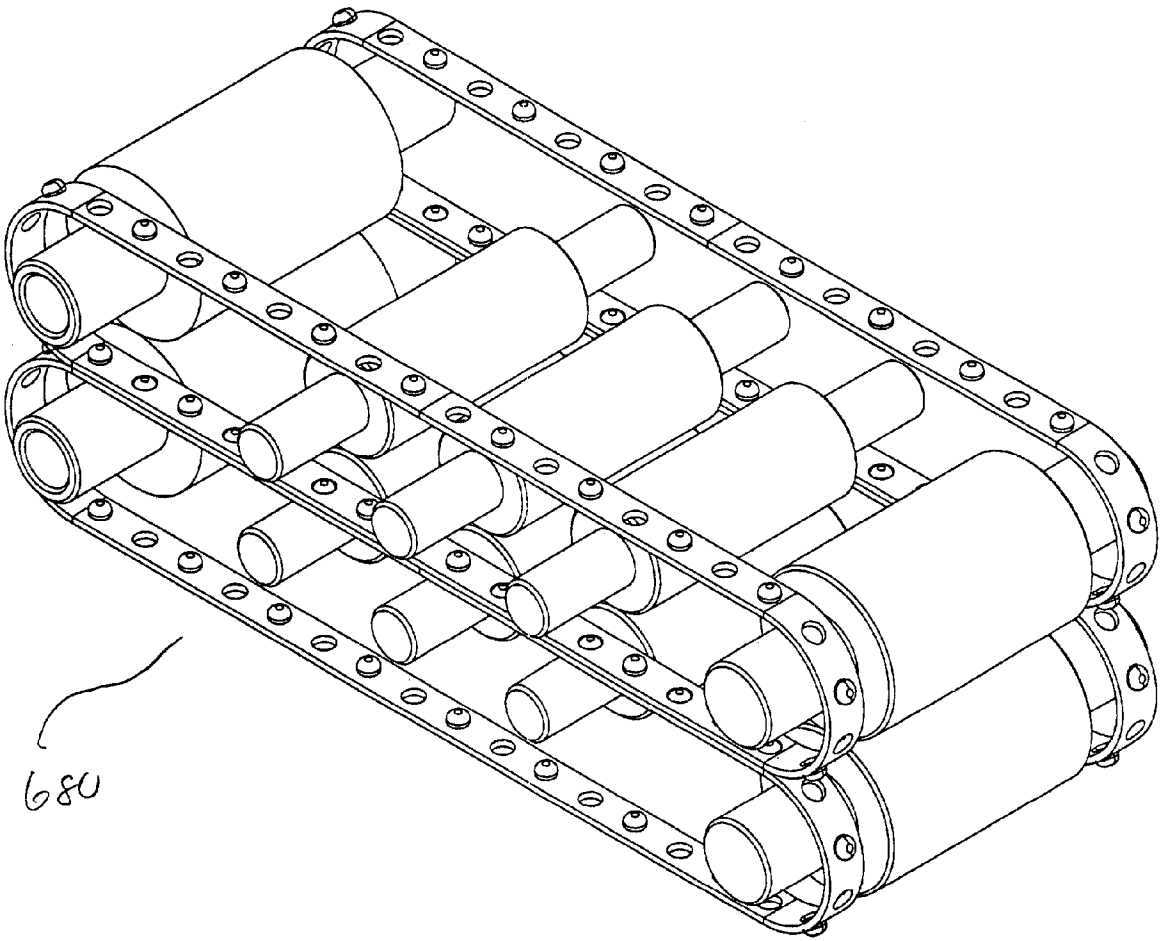
FIG. 12 is a perspective illustration of a laminator roll assembly usable with at least one embodiment of the invention.

Third, a dimensionally stable carrier web can be provided with form feed holes (or perforated holes or notches) punched or otherwise provided in the edges of the carrier web. For example, FIG. 12 is a perspective illustration of a laminator roll assembly 680 (including, e.g., rolls 206*a*, 206*b*, 215 (all rolls), 216*a*, and 216*b*) adapted to be used with carriers having form feed holes. Those skilled in the art will appreciate that the laminator roll assembly 680 is merely illustrative and that many different ways of using form feed holes with rollers are, of course, usable. The carrier web then not only provides laminate transportation, e.g., by moving the carrier web through the lamination and cutting processes using pin or notch engagements, but the carrier web can also be used to accurately register laminates with respect to each other and to a substrate sheet. Providing form feed holes in the substrate sheet further enhances this registration process. The form feed holes provide enhanced registration of the substrate with the top and bottom laminate patches (in comparison to edge guiding or optical registration methods). The form feed holes also enhance registration of security features provided to the laminate surface, if desired, along with improving registration for the cutter 218. We can print information closer to a substrate edge as our cutting registration improves.

Figure 13:
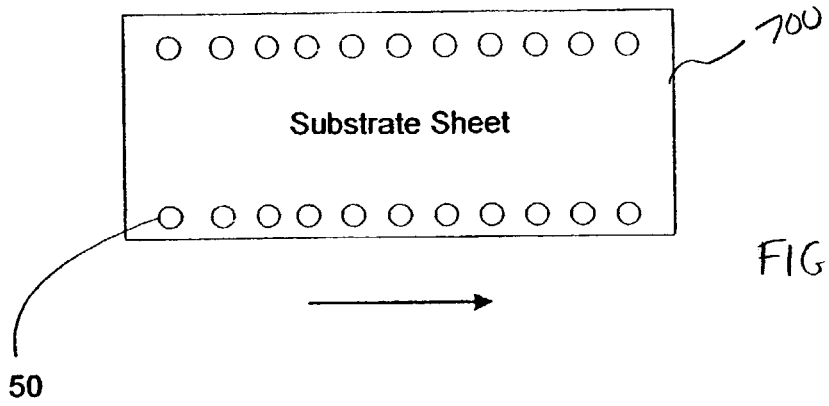
FIG. 13 is a diagram of a substrate sheet including a plurality of form feed holes along its direction edges.

Now consider a process set in any of the FIGS. 4-8 system environments, with the following modifications, which leverages the above third advantage. The process receives a substrate sheet. With reference to FIG. 13, form feed holes (or other notches or openings) 50 are pre-punched along directional edges of the substrate sheet 700. For example, the arrow in FIG. 13 shows a directional edge of the sheet 700, e.g., the direction the sheet 700 typically travels in an assembling system. The form feed holes 50 are placed outside an area in which the card will be cut or where information will be printed. The substrate sheet 700 is preferably over-sized to allow room for placement of the form feed holes. The substrate can be later trimmed to a specified size.

(In an alternative implementation, not shown, we only include form feed holes along one of the directional edges.).

In one implementation, we start with about a ½ inch additional material on the two directional edges that receive the form feed holes, and about ⅛ inch on the two edges that run perpendicular to the directional edges. This particular sizing produces about a 69% material utilization. Of course these over-sizing dimensions can be changed to system needs and/or material utilization requirements.

Referring to FIGS. 5 and 7, e.g., after printing by the first 202 and second 204 printers (or, referring to FIG. 8, after the printer 302 prints both sides of the substrate), the perforated, printed substrate is conveyed into laminator 205. Such conveyance can be accomplished using the form feed holes, if desired (see e.g., FIG. 12). For example a pin belt or wheel including a plurality of pins is provided, as will be readily understood by those skilled in the art. The pins engage the form feed holes, and cycling the belt or wheel conveys the substrate through engagement of the pins with the holes. The arrival of the substrate sheet at the laminator 205 is preferably timed to coincide with an arrival of the laminate on the carrier web. For example a sensor can sense a position of a printed substrate sheet (e.g., senses a leading for trailing edge of the sheet) as it is conveyed from the printer. It can also be determined when a timing marker (or position or counter) reaches a predetermined position, indicating a pin engaged in the leading hole of the sheet is at the same distance from a merge point as the laminate patches. A substrate conveyer (or pin belt) motor can be slaved to the laminator motor causing the ID card's three components (laminate-substrate-laminate) to arrive at the laminator 5 in registration. The form feed holes in the printed sheet are engaged by the pins conveying the supported laminate around the laminator rolls. In an alternative implementation, sensors (or timing modules) sense or otherwise determine the position of the laminate and/or substrate, and the controller controls the relative conveyance (or arrival) of the substrate and/or laminates to the laminator 205.

In one implementation, we register the placement of the substrate sheet and laminate patch by aligning form feed holes on the substrate sheet with form feed holes on the carrier web. Pins engaging the aligned form feed holes can be used to transport the supported substrate and laminates into and through the laminator 205. The laminator 205 activates the laminate adhesive, and then using pressure between the rollers 206 presses the laminates onto both sides of the printed substrate sheet. A cooler 214 keeps the laminate flat while cooling. The cooled laminate then enters the cutter 218. The laminator 205 and carrier web motion are deactivated once the laminated substrate is properly positioned within the cutter 218. The positioning of the laminate substrate in the cutter 218 is enhanced through alignment of the form feed holes or through transporting the laminated substrate via engagement of the holes.

We note that residual carrier web and laminate can be accumulated with an accumulator (including a shedder). Cutting, encoding, scrap accumulation and shredding, and ejection otherwise proceed as discussed above with respect to FIGS. 4-8.

We note that the pull rollers 216 can be replaced with a pin or notch-based conveyance system in this third embodiment. A pin or notch system can also be optionally used in the printer paths 203 and 204*b*.

As an alternative implementation, the substrate is provided as a roll (e.g., web), instead of sheets. The system then includes a sheet cutter to cut a substrate at some point prior to the printing process.

Similar modifications can be made to the embodiments of FIGS. 4-8. For example, a pin or notch-based conveyance method can be used to transport a printed substrate along paths 303 and 304 and/or transporting the substrate, laminate piece and carrier webs through the laminator 205, cooler 214 and into the cutter 218.

Embodiment 7—Additional Alternative Implementation

While using a carrier web is an attractive solution to improve lamination yield, excess carrier web waste may be an unintended byproduct. We have developed an implementation to significantly reduce subsequent carrier web waste. Instead of using a carrier web as a "continuous" web that is controlled by maintaining down web tension (e.g., by puller roller 216) a discrete piece or sheet of carrier can be used for each individual laminate piece. Similar to the embodiments shown in FIGS. 9 and 10, a single piece of laminate is "picture framed" on and then bonded to (or otherwise carried by) each carrier sheet. These individual carrier sheets can be provided from a roll or fan folded box of continuous carrier with laminate patches. The carrier pieces are then cut into the single pieces prior to entering the laminator 205, or are separated from the roll by fracturing the carrier along a cross web perforation line 605 (FIG. 9). Or a carrier sheet can be obtained from a stack of carrier sheets. As with the carrier web above, the carrier sheet includes and opening or window 602 over which the laminate piece 606 is placed (or bound). Form feed holes 604 along the edge(s) of a carrier sheet are used to convey the individual carrier sheet through the laminator 205, cooler 214 and cutter 218. Pin feed mechanisms control the carrier sheet/laminate motion and alignment by transferring forces through engagement of the carrier web form feed holes.

Consider the following modifications to the embodiments of FIGS. 4-8. Form feed holes are pre-punched along directional edges of a substrate sheet, and along at least the carrier sheet. Once the substrate is printed, the printed sheet is conveyed into the laminator 205, using the form feed holes, in registration (e.g., alignment) with the laminate patches on the carrier sheet that has been started into the laminator 205. Once laminated and cooled, the laminated substrate is transported to and positioned in the cutter by using a pin belt with pins engaging the form feed holes.

Die Cutter Configurations

Blanking dies are ideally suited to serve as cutter 218 (see FIGS. 2*b* and 3*b*). This is because of the precision with which resulting card dimensions can be maintained, an important issue in meeting, for example, ISO specifications, particularly for card height which has a tolerance of only +/−0.002". Accordingly, we can favorably use a blanking die cutter as cutter 218. The present invention, however, should not be construed as being limited to such.

For example, a rotary die cutter can alternatively be used. A rotary die cutter produces similar dimensional precision, in comparison to a blanking die, as well as providing a continuous motion process that might offer some design advantages when coupled with other continuous motion processes. Of course, the complexity of a rotary die cutter and the high forces required to cut the two cross web sides of a card are two of the major issues to be considered when using a rotary die cutter.

Steel rule die cutting is also another alternative cutter. The big advantage of this die cutting method is the relatively low cost of the tooling. An issue that needs to be considered when using a steel rule die cutter is the high force that is required to cut the entire perimeter of the card at one time. The hardware capable of generating that type of force is typically either physically large, or noisy in that a large amount of previously stored energy is released from a flywheel or other type of energy storage device when the card is cut. The other issue is manufacturing dies with a dimensional accuracy required, e.g., by ISO card height tolerance specification.

Laser cutting can also be used. Some factors to consider when using a laser cutter are avoiding card edge char, addressing roughness of a cut card edge, the personal safety requirements needed for such devices, and the environmental handling requirement of the laser off-gases.

Die Cutter Press Configurations

Several alternative methods can be used to generate a force required to blank die cut a card in the processes described above. Since a blanking die can be fashioned with a shear angle or double shear angle on the face of a punch without sacrificing dimensional accuracy of the card product, only a small portion of the total card perimeter is cut at a given instant in a cutting cycle. This greatly reduces the force required to cut the card. Therefore a small electric motor driving a high mechanical advantage screw or other drive mechanism would be sufficient to slowly cut the cards. Faster cycle times would be possible with an energy storage system like a spring or flywheel device that becomes "charged" during the relatively long off-duty cycle time and is discharged during the brief cutting cycle.

Hydraulic or compressed air presses can be used for many of the cutting methods described above.

An inventive improvement to powering conventional blanking dies is to use a bank of low profile electrical solenoids to provide a driving force to drive a blanking die. At least two major advantages derive from this solenoid method: high speed of operation and a small volume required for the hardware.

Card and Card Component Conveying

While a number of conveying mechanisms have been discussed above, we note that belts may offer advantages in conveying thin flexible materials (e.g., laminate and substrate sheets) used in our card constructions. Belt drives are simple, reliable and can be tailored to provide a level of belt friction required for positive feeding or controlled slip. For example, belts can be used as printer paths 203, 204*b*, 303 and 304. And belts can be used along the laminator path, cooler path and ejection path.

Yet, we believe pin belts that positively engage a form feed hole or feature cut into a card component is perhaps the best method to accurately register parts to one another, and transport material through our inventive systems.

Roller feeds have many of the same characteristics as belt conveyors, and can be alternatively employed in our system.

A vacuum-based conveyance is also an alternative method for conveying.

Embodiment 8—Rotary Table or Linear Carriage Using Platen Lamination

Platen lamination is ideally suited for a rotary table or a linear carriage. Rotary tables and linear carriages comprise dedicated stations that are respectively devoted to a specific processing step, and ID document parts (e.g., front laminate, substrate sheet, and back laminate) are fed into or unloaded from each station.

Figure 14:
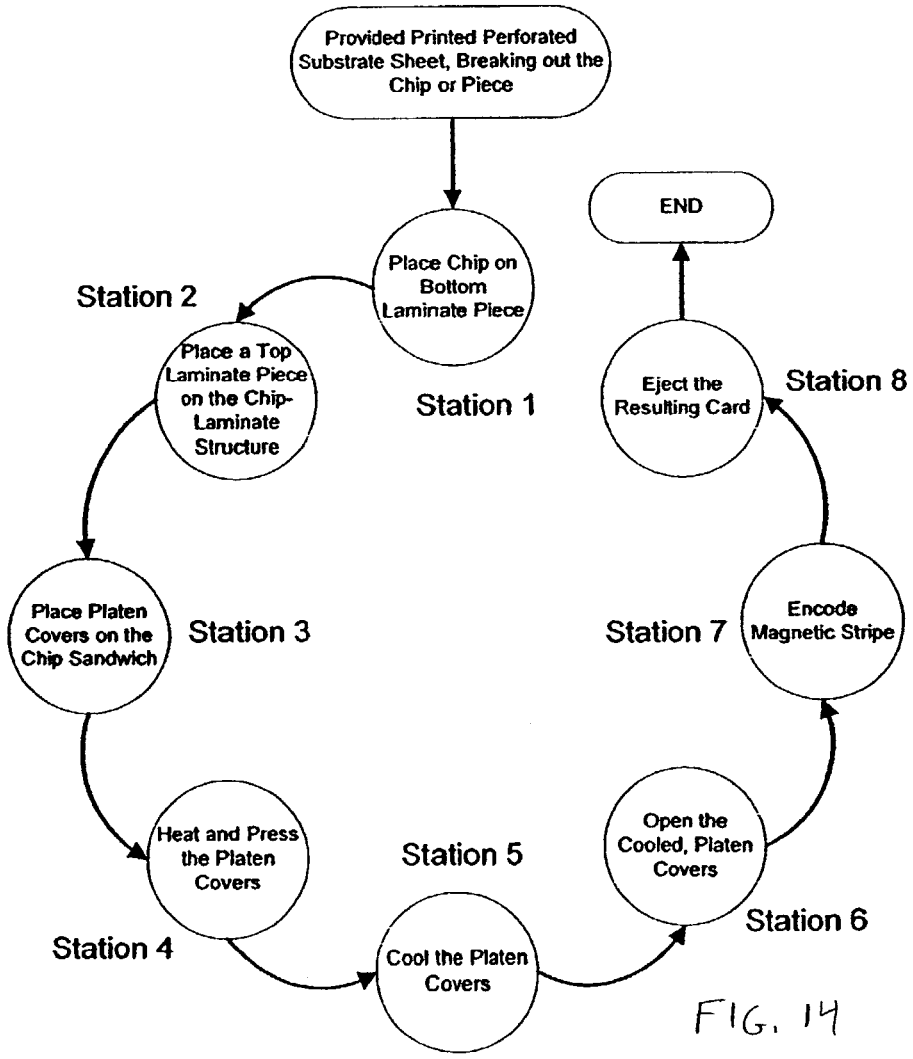
FIG. 14 is a diagram of a rotary table processing method according to an implementation of the present invention.

Consider our inventive rotary table ID card assembling process with reference to FIG. 14. Our process starts with small sheets of substrate that are somewhat larger than the size of a finished ID document. The sheets are preferably precut or perforated such that a final card-sized chip is contained within the overall small substrate sheet. The substrate sheet is placed in a sheet feeder of a first ink jet printer. The first ink jet printer applies desired printing to one side of the substrate sheet. The substrate sheet is conveyed into the feed tray of the second ink jet printer in a manner that presents the reverse side of the sheet to the printer. The second ink jet printer applies desired printing to the reverse side of the sheet. (Alternatively, the second printing cycle is performed by the first printer as discussed, e.g., with respect to FIG. 5.). The printed substrate sheet is provided to a first station.

(The printed substrate is preferably conveyed to the first station around a sharp or otherwise pronounced bend in order to break the precut, final-sized chip or piece from its surrounding substrate material. This technique is similar to a method of applying pressure sensitive adhesive labels from a release liner. The separated chip or piece is provided to a first station of the rotary table. Alternatively, the "breaking" can be accomplished in a pre-station.).

The first station positions a card-sized laminate piece (e.g., obtained from a magazine or supply of such laminate pieces) with its adhesive side facing upward up, so that the printed substrate chip can be provided on top of the laminate. The chip is placed on top of the laminate so as to contact the adhesive side of the laminate piece with a bottom side of the chip. The chip and laminate are provided to a second station.

The second station picks a card-sized laminate piece and places an adhesive side of the laminate piece to contact a top side of the chip. The laminate-chip-laminate structure forms a chip sandwich that is provided to a third station.

A third station closes a platen cover on top of the chip sandwich. (In some case the sandwich is placed on a bottom platen cover. However, a bottom platen cover is generally not needed since subsequent stations will often include a station nest having a fixed bottom platen cover.).

In a fourth station, a heated platen press closes on the platen top (and perhaps bottom, if provided) cover to heat and press the chip sandwich together.

In the fifth station, a cooling press closes on or around the top (and perhaps bottom, if provided) platen plate, cooling the chip sandwich.

In a sixth station, the platen covers are opened.

In an optional seventh station, the cooled ID card is magnetic stripe encoded.

And in an eighth station, a finished card is ejected from the rotary table. Of course, the card can alternatively be ejected after the platen covers open (station 6), or after the magnetic stripe is encoded (station 7).

While this approach has multiple steps, it does have the advantage of eliminating a cutter. An alternative might be to introduce precut laminate pieces from a carrier web where the laminate pieces are attached to the carrier with low bond strength adhesive such that the pieces could be "label fed" from the carrier onto the table. We also note that some of the above mentioned stations can be combined, such as stations 1 and 2, and 5 and 6.

Embodiment9—Semi-Automated Process

Manual intervention can be used to simplify our inventive processes. Such semi-automated systems with typically use one or two ink jet printers, a belt laminator, a manual die cutter and, optionally, a magnetic stripe encoder. Consider the following inventive process.

An operator places a substrate sheet in a printer sheet feeder of a first ink jet printer. The first ink jet printer applies the desired printing to a first side of the substrate sheet. The sheet is then conveyed into a feed tray of a second ink jet printer in a manner that presents a second side of the sheet to the printer. We note that either the operator or a conveyance path (e.g., path 203) can present the substrate sheet to the second printer. The second ink jet printer applies the desired printing to the reverse side of the sheet. (As an alternative, we note that a single printer system can be used as described above with respect to FIG. 5.)

The operator removes the printed substrate and places it between pieces of front and back laminate. Alternatively, the operator slips the printed substrate into a so-called lamination pouch. The operator then introduces the stack of materials (e.g., laminate-substrate-laminate) onto a laminator where the stack is heated, cooled and then fed out of the laminator. The operator then places the laminated stack into a hand cutter, and cuts the finished card.

In an alternative implementation, only a subset of the above manual operations is manually carried out, while the remaining operations are automated.

A matte finish on the outside surfaces of the laminates can be provided to help prevent air bubble between a laminator (e.g., a gloss finish laminator belt) and the laminate. Of course, a belt laminator can be replaced with a roll laminator as discussed above with respect to FIGS. 4-8. Again a matte finish on the outside surfaces of the laminates may help prevent air bubbles.

Embodiment 10—Injection Molding Process

An injection molding process is used as an alternative to the above described lamination processes.

Either a single or dual printing system is used to print a substrate sheet as described above with respect to FIGS. 4-8. The printed substrate sheet is then placed into an open mold including, e.g., two halves. The mold halves close over the printed substrate sheet and polymer (or other protective coating) is injected into the mold, preferably on both sides of the substrate sheet. (We note that the polymer is ideally thermoplastic or thermoset to avoid undue shear forces to the substrate due to viscosity.) At the end of the molding cycle, the mold is opened and the molded substrate is removed. The substrate that extends beyond the polymer edge, if any, can be removed with cutting. Those skilled in the art will further appreciate that other methods of injection molding are, of course, usable.

Concluding Remarks

Having described and illustrated the principles of the technology with reference to specific implementations, it will be recognized that the technology can be implemented in many other, different, forms, and in many different environments.

For example, we note that our preferred laminate material is polymer-based and typically softens at a temperature required to soften and activate a laminate adhesive. This softening point is an excellent feature in a finished ID card because it makes tampering with the card evident due to the stretching and distortion of the laminate that occurs when heat is used to try to remove the laminate. Accordingly, a laminator will sometimes deal with the stretching and distortion aspect and, therefore, we have introduced the concepts of belts, cooling rollers or special pouch carriers. Of course, these elements can be simplified if laminates, which use a base polymer that does not soften at the adhesive laminating temperature, are used instead. The tradeoff, however, is that tamper resistance of a finished card will likely be inferior.

While we have provided specific temperature ranges by way of example, the invention is not limited to such. Indeed, the adhesive activation temperature and the adhesive bonding temperatures mentioned can be changed depending on the adhesive material used, the laminate material used, and so on. Similarly, while we have provided some specific dimensions for the card and laminate material, the present invention is not limited to such. Dimensional changes can be made without deviating from the scope of our invention.

While we have provided specific dimensions by way of example, the invention is not limited to such dimensions.

We note that a substrate sheet, e.g., TESLIN, can be treated to better receive ink jet printing as discussed in assignee's U.S. Provisional Patent Application No. 60/344,685 and copending U.S. Nonprovisional patent application Ser. No. 10/289,962 (published as US 2003-0211296A1). We also note and expressly contemplate that the techniques and pigmented ink disclosed in these applications can be combined with the inventive features of the present application.

To provide a comprehensive disclosure without unduly lengthening the specification, applicant herein incorporates by reference each of the U.S. patent documents referenced above.

The particular combinations of elements and features in the above-detailed embodiments are exemplary only; the interchanging and substitution of these teachings with other teachings in this and the incorporated-by-reference patent documents are also expressly contemplated.

Further, although certain words, languages, phrases, terminology, and product brands have been used herein to describe the various features of the embodiments of the invention, their use is not intended as limiting. Use of a given word, phrase, language, terminology, or product brand is intended to include all grammatical, literal, scientific, technical, and functional equivalents.

As those skilled in the art will recognize, variations, modifications, and other implementations of what is described herein can occur to those of ordinary skill in the art without departing from the spirit and the scope of the invention as claimed. Accordingly, the foregoing description is by way of example only and is not intended as limiting. The invention's scope is defined in the following claims and the equivalents thereto.

What is claimed is:

1. A system to intermittently assemble identification documents, an identification document comprising a substrate with a top surface and a bottom surface, the top and bottom surfaces being laminated, said system comprising:

a first ink jet printer operable to print first information on a top surface of a substrate sheet, said first ink jet printer including an input to receive the substrate sheet and an output from which a printed substrate sheet exits the first ink jet printer;

a first conveyor to convey a once printed substrate sheet from the first ink jet printer output back to the first ink jet printer input, the first conveyor to convey the once printed substrate sheet so as to be positioned to receive printed information on a bottom surface of the substrate sheet, the top and bottom substrate surfaces being different surfaces, the first ink jet printer being operable to print second information on the bottom surface of the substrate sheet;

a second conveyor to convey a twice-printed substrate sheet from the first ink jet printer output;

a laminator operable to receive the twice printed substrate sheet and to provide a top laminate in contact with the top surface of the twice printed substrate sheet and a bottom laminate in contact with the bottom surface of the twice printed substrate sheet, the laminator to laminate the top laminate to the top surface of the twice printed substrate sheet and to laminate the bottom laminate to the bottom surface of the twice printed substrate sheet;

a cutter to cut excess material from the laminated, twice printed substrate sheet, the cut, laminated twice printed sheet forming the identification document;

a cooler to receive a recently laminated twice printed substrate sheet, the cooler comprising at least one of a plurality of rollers, a cooling belt or a heat sink;

wherein the laminator comprises a top laminate supply and at least a laminator roller to heat and press the top laminate obtained from the top laminate supply to the top surface of the twice printed substrate sheet;

wherein the laminator further comprises a bottom laminate supply and at least a laminator roller to heat and press the bottom laminate obtained from the bottom laminate supply to the bottom surface of the twice printed substrate sheet, the bottom laminator roller being relatively positioned below the top laminator roller;

wherein at least one of the top laminate and bottom laminate comprises an individual sheet of lamination material, said top laminate and bottom laminate being respectively carried by a top carrier web and a bottom carrier web, wherein the top carrier web comprises a top opening and the top laminate is positioned over the top opening, and wherein the bottom carrier web comprises a bottom opening and the bottom laminate is positioned over the bottom opening; and wherein at least one of the top carrier web and bottom carrier web includes a plurality of form feed holes, and said system further comprises a pin belt including a plurality of pins to engage at least one of the top form feed holes and bottom form feed holes.

2. The system of claim 1, wherein the engagement serves to transport at least one of the top carrier web and bottom carrier web through the laminator and cooler as the pin belt moves.

3. The system of claim 1, wherein the engagement serves to transport the carrier web including the laminated substrate sheet to the cutter as the pin belt moves.

4. The system of claim 3, wherein the engagement serves to align the carrier web in the cutter.

5. The system of claim 1, wherein the substrate sheet including a plurality of form feed holes.

6. The system of claim 5, wherein the form feed holes of the substrate sheet and at least one of the top carrier web form feed holes and bottom carrier web form feed holes are aligned to register the substrate with respect to at least one of the top laminate and bottom laminate.

* * * * *